US010264337B2

(12) United States Patent
Brogan

(10) Patent No.: US 10,264,337 B2
(45) Date of Patent: Apr. 16, 2019

(54) SPEAKER DEVICE

(71) Applicant: Hugh Brogan, Ramsey (GB)

(72) Inventor: Hugh Brogan, Ramsey (GB)

( * ) Notice: Subject to any disclaimer, the term of this patent is extended or adjusted under 35 U.S.C. 154(b) by 0 days.

(21) Appl. No.: 15/308,022

(22) PCT Filed: May 1, 2015

(86) PCT No.: PCT/GB2015/051303

§ 371 (c)(1),
(2) Date: Oct. 31, 2016

(87) PCT Pub. No.: WO2015/166285

PCT Pub. Date: Nov. 5, 2015

(65) Prior Publication Data

US 2017/0055054 A1 Feb. 23, 2017

(30) Foreign Application Priority Data

May 1, 2014 (GB) ..... 1407650.9
Apr. 9, 2015 (GB) ..... 1506028.8

(51) Int. Cl.
*H04R 1/02* (2006.01)
*H04R 1/28* (2006.01)
(Continued)

(52) U.S. Cl.
CPC ..... *H04R 1/026* (2013.01); *A45C 11/00* (2013.01); *H04R 1/028* (2013.01); *H04R 1/2803* (2013.01);
(Continued)

(58) Field of Classification Search
None
See application file for complete search history.

(56) References Cited

U.S. PATENT DOCUMENTS 2,547,447 A 4/1951 De Boer
5,119,421 A 6/1992 Reime
(Continued)

FOREIGN PATENT DOCUMENTS

CN 201869362 U 6/2011
EP 0 847 661 3/1997
(Continued)

OTHER PUBLICATIONS

Carnoy, David "Speck CandyShell Amped: Will this case make your iPhone louder?" pp. 1-3. Apr. 25, 2014.*
(Continued)

*Primary Examiner* — Curtis A Kuntz
*Assistant Examiner* — Qin Zhu
(74) *Attorney, Agent, or Firm* — Saul Ewing Arnstein & Lehr LLP

(57) ABSTRACT

The field of the invention relates to speaker devices, to speaker panels for speaker devices, to mechanical assemblies and mountings for speaker devices, to uses of speaker devices for example as products or as components for products, and to computer program products operable to control speaker devices. There is provided a speaker device, the speaker device including a body and a speaker panel assembly, the speaker panel assembly movable between an open configuration and a closed configuration, wherein in the open configuration the speaker panel assembly is displaced relative to the body, and in the closed configuration the speaker panel assembly is retracted into the body. The speaker device may be a smart device. The speaker device may be one configured to receive and to store a mobile device.

44 Claims, 54 Drawing Sheets

(51) Int. Cl.
*A45C 11/00* (2006.01)
*H04R 7/04* (2006.01)

(52) U.S. Cl.
CPC ..... *H04R 7/045* (2013.01); *A45C 2011/002* (2013.01); *H04R 2201/025* (2013.01); *H04R 2400/11* (2013.01); *H04R 2420/07* (2013.01); *H04R 2440/05* (2013.01); *H04R 2499/10* (2013.01); *H04R 2499/11* (2013.01); *H04R 2499/15* (2013.01)

(56) References Cited

U.S. PATENT DOCUMENTS 5,675,426 A 10/1997 Meisner et al.
5,838,537 A * 11/1998 Lundgren ..... G06F 1/1616 361/679.27
6,005,642 A 12/1999 Meisner et al.
6,151,401 A 11/2000 Annaratone
6,243,473 B1 6/2001 Azima et al.
2004/0209641 A1 10/2004 Hong
2005/0031148 A1* 2/2005 McNary ..... H04R 1/2811 381/334
2007/0014426 A1* 1/2007 Sung ..... G03B 31/00 381/386
2008/0220812 A1 9/2008 Wang
2009/0010479 A1 1/2009 Chen
2009/0156263 A1 6/2009 Park et al.
2009/0186264 A1 7/2009 Huang
2009/0304212 A1 12/2009 Han et al.
2010/0072334 A1* 3/2010 Le Gette ..... F16M 11/041 248/176.3
2011/0204843 A1* 8/2011 Foster ..... A45C 11/00 320/101
2011/0235847 A1 9/2011 Bhutani et al.
2012/0275636 A1 11/2012 Vissia et al.
2012/0303520 A1* 11/2012 Huang ..... H01M 10/46 705/39
2012/0308064 A1 12/2012 Matthews
2013/0170689 A1* 7/2013 Guenther ..... H04R 1/2819 381/350
2013/0177181 A1 7/2013 Marcus
2013/0230202 A1 9/2013 Widner et al.
2014/0004915 A1* 1/2014 Huang ..... H04M 1/0202 455/575.8
2014/0140558 A1* 5/2014 Kwong ..... H04R 3/007 381/345
2014/0190844 A1* 7/2014 Hsieh ..... G06F 1/1624 206/45.23
2014/0355806 A1* 12/2014 Graff ..... H04R 1/025 381/334
2015/0155903 A1* 6/2015 Jang ..... H04B 1/3888 455/575.8
2015/0172431 A1* 6/2015 Huang ..... H04B 1/3888 455/556.1
2015/0282579 A1* 10/2015 Piro ..... H04B 1/3888 206/756
2015/0341712 A1* 11/2015 Wilcox ..... H04R 7/045 381/332
2016/0014489 A1* 1/2016 Davis ..... H04R 1/026 381/333
2016/0197637 A1* 7/2016 Lee ..... G06F 3/14 455/566
2017/0026498 A1* 1/2017 Goldfain ..... A45C 11/182

FOREIGN PATENT DOCUMENTS

GB 2 338 141 A 12/1999
GB 2 422 503 A 7/2006
JP 2002099353 A 4/2002
KR 20010105089 A 11/2001
TW M456735 U1 7/2013
WO 97/09856 3/1997
WO 00/13464 3/2000
WO 00/36875 6/2000
WO 2004/064369 A2 7/2004
WO 2005/053355 A2 6/2005
WO 2006/095277 A1 9/2006

OTHER PUBLICATIONS

International Search Report, dated Sep. 28, 2015, and Written Opinion, issued in International Application No. PCT/GB2015/051303.
Examination Report, dated Jun. 7, 2016, issued in corresponding UK Application No. GB 1507593.0.
Anonymous: "Distributed mode loudspeaker," Wikipedia, the free encyclopedia, retrieved from the Internet: URL:https://en.wikipedia.org/w/index.php?title=Distributed_mode_loudspeaker&oldid=592383409 [retrieved on Jul. 9, 2015] Jan. 25, 2014 XP055201229.

* cited by examiner

SPEAKER DEVICE

CROSS REFERENCE TO RELATED APPLICATIONS

This application claims the priority of PCT/GB2015/051303, filed on May 1, 2015, which claims the benefit of priority to Great Britain Application No. GB 1407650.9, filed on May 1, 2014, and Great Britain Application No. GB 1506028.8, filed on Apr. 9, 2015, the entire contents of each of which are fully incorporated herein by reference.

BACKGROUND OF THE INVENTION

1. Field of the Invention

The field of the invention relates to speaker devices, to speaker panels for speaker devices, to mechanical assemblies and mountings for speaker devices, to uses of speaker devices for example as products or as components for products, and to computer program products operable to control speaker devices.

2. Technical Background

Smart Devices continue to integrate more functionality. This places limitations on the device's speaker size and therefore performance. The fundamental rule in audio is you need to move air in order to create sound: the more air you move the louder the sound is—air movement is proportional to power and speaker size. Speaker size is proportional as well to frequency response: the larger the speaker the lower the frequencies it can produce, all of which are constrained in smart devices, which are typically somewhat small so they are portable.

Consumers want to be able to listen and enjoy music wherever they are. Bluetooth speakers serve this need but are not ideal as a separate or bulky speaker is yet another thing to carry around with you and therefore in many instances they are just not there when you need them.

Consumers actively access, store and listen to music on their mobile devices, they want to be able to listen and enjoy their music whenever and wherever they are. Today this is mainly done through headphones making it a solitary experience. Although many devices have built-in speakers, consumers often do not like to listen to music on their mobile device speakers as the low volume and poor quality of the speakers reduce the listening pleasure: consequently there has been a huge growth in the demand for mobile speaker systems. Consumers want to share their music listening experience and do not want to have to wear headphones all the time to get good quality sound: this need has driven the wireless speaker market. The solutions on offer are often bulky and because they are separate devices that a user does not typically carry with them when on a day-to-day basis. Hence when an opportunity arises to listen to music they do not have the speaker available and cannot use it. A further problem is that portable speakers may be damaged when not in use. It is desirable to protect portable speakers when they are not in use.

3. Discussion of Related Art

A problem with using the phone housing as the speaker is that phone housings need to be rigid in order to be robust and durable. This makes them hard to move in the context of producing sound. A calculation indicates that 0.3 kW to 10 kW of power is required to make a phone case produce loud sounds. A mobile phone battery can provide around 16 watts. A typical tablet battery can provide around 30 watts, which is not suitable. Therefore mobile phone batteries and tablet batteries and other portable electronic products batteries are not suitable to drive device cases as speakers to make loud sounds.

SUMMARY OF THE INVENTION

A speaker device is provided in which a speaker panel is movable from the housing. An advantage is that by suspending the panel in free space, the rigidity of the device case is removed as a constraint from moving the speaker panel and substantially reduces the power required to produce audio and by allowing the speaker panel to move more freely. The speaker panel can then articulate back into the device housing or device case. The speaker panel becomes one with the device housing or device case and is therefore very portable. The speaker device provides portability as it is part of the smart device (eg. phone) or part of the device case (which about 70% of smart device consumers use) which may be bought for a smart device, and in the example where it is a phone cover it may include a phone charger (eg. battery) giving instant additional power and allowing the phone to be recharged, solving the two key issues consumers have: poor battery life and poor audio performance. The mounting and suspension of the speaker panel enable lower and higher acoustic frequencies to be generated more effectively than if the edges of the speaker were subject to greater mechanical constraints, leading to improved low and high frequency acoustic generation efficiency, and to better acoustic performance over a wider acoustic range.

According to a first aspect of the invention, there is provided a speaker device, the speaker device including a body and a speaker panel assembly, the speaker panel assembly movable between an open configuration and a closed configuration, wherein in the open configuration the speaker panel assembly is displaced relative to the body, and in the closed configuration the speaker panel assembly is retracted into the body. Advantages are that the speaker panel acoustic properties are not restricted by the mechanical properties of the body, and that the speaker panel can be stored when not in use. An advantage is that the speaker panel forms part of the device and is always with the user of the device and therefore the user may be able to enjoy high quality audio wherever they are—once the user has finished listening to audio the speaker panel and associated mounting can be retracted back into the device without unduly compromising the device's portability.

The speaker device may be one wherein in the open configuration, the panel is suspended in free space. An advantage is better acoustic performance over a wider acoustic range.

The speaker device may be one wherein the speaker panel assembly includes a speaker panel suspension system that provides frequency response optimization.

The speaker device may be one wherein when the speaker panel assembly is retracted into the body, and or the speaker panel assembly is articulated back into the body. An advantage is that the speaker panel can be brought back into storage after a period of use.

The speaker device may be one wherein when the speaker device is in the closed configuration the panel assembly is retracted into the body of the device such that a panel of the panel assembly cannot be seen on the outside surface of the device. An advantage is that the panel is protected from damage when not in use.

The speaker device may be one wherein the speaker device is portable. An advantage is that a user can take the speaker device with them as they travel.

The speaker device may be one wherein the speaker device is operable to receive power from a connected device. An advantage is that the speaker device is not constrained by its own power resources. Alternatively, the speaker device may have its own internal power source.

The speaker device may be one wherein the speaker device is operable to receive power from the connected device, from an audio jack of the connected device.

The speaker device may be one wherein the speaker device is configurable to communicate wirelessly.

The speaker device may be one wherein the speaker device includes Bluetooth.

The speaker device may be one wherein the speaker device can be connected wirelessly via a Network, Bluetooth, Wifi or other wireless/wired communications system, individually or in combination.

The speaker device may be one wherein the speaker device can be connected wirelessly to multiple Networks, Bluetooth, Wifi or other wireless/wired communications systems, individually or in combination.

The speaker device may be one wherein the speaker device can be connected wirelessly via a Network, Bluetooth, Wifi or other wireless/wired communications system, individually or in combination, to another speaker device or devices.

The speaker device may be one wherein the speaker device can be connected to multiple other speaker devices.

The speaker device may be one wherein the speaker device, when put in an open configuration, automatically turns the speaker device on and may activate wireless capabilities of the speaker device and may check the availability of other devices, previously connected devices, or begins a search/becomes available to connect to new devices. The speaker device may be one wherein the speaker device, when put in an open configuration, automatically begins playing music or audio.

The speaker device may be one that includes its own battery and electronics and is operable to provide power to external devices via a power connection on the speaker device.

The speaker device may be one wherein the speaker device includes its own electronics.

The speaker device may be one wherein the speaker device includes detachable pieces.

The speaker device may be one wherein the speaker device includes a battery.

The speaker device may be one which is a back cover of a portable device, wherein the speaker device includes an actuator which is mounted to the back cover, wherein the back cover includes the speaker panel assembly that contains a speaker panel. An advantage is ready integration into a previous device configuration.

The speaker device may be one wherein in the closed configuration, no speaker panel can be seen by a user of the speaker device, and in the open configuration in which the back cover of the speaker device opens, a speaker panel is revealed in the back cover of the device.

The speaker device may be one wherein the body includes a battery which is removable or non-removable, and a speaker panel of the speaker panel assembly includes an aperture, wherein the aperture is configured to fit around the battery in the closed configuration in a compact arrangement.

The speaker device may be one wherein the speaker panel assembly houses a main battery of the speaker device.

The speaker device may be one wherein the speaker device includes indicator lights.

The speaker device may be one wherein the indicator lights allow a user to check the status of an internal battery, The speaker device may be one wherein the speaker device includes a status LED or LEDS.

The speaker device may be one wherein the speaker device includes a microphone, to enable voice control of the device or connected devices and or conference calling via the speaker device whilst connected to a smart device.

The speaker device may be one wherein the speaker device is operable as a hands free speaker.

The speaker device may be one wherein the speaker device is arranged to receive voice prompts. The speaker device may provide voice prompts to the user to enable operation and confirmation of status and or configuration of the speaker device and/or the smart device. An application may be executable on the speaker device, or on a device in connection with the speaker device, to receive prompts, to enable communication through the speaker device about what is happening, such as to provide a warning or information about connectivity, or to tell a user where they are.

The speaker device may be one wherein the body includes a housing.

The speaker device may be one wherein the body includes a speaker case.

The speaker device may be one wherein the speaker case is provided with tuned ports in the case with waveguides to optimise frequency response. An advantage is an optimized frequency response. The tuned ports may provide an optimized frequency response passively or in combination with electronic or program methods contained in the speaker device or in the connected device.

The speaker device may be one wherein the tuned ports are under the speaker panel assembly or in the panel mounting frame or in the speaker device case that operate in one tuned length when the panel is in the open configuration but have a different (or same) tuned length in a closed configuration.

The speaker device may be one wherein an electronic or software controller audio equalizer is incorporated into the electronics of the speaker device; speaker device operation is controlled by software and/or electronic hardware in the smart device, or by software and electronic hardware means in the speaker device; smart device function may be enabled or changed by buttons on the speaker device or by the position of the panel to optimise the performance of the speaker panel in different panel positions.

The speaker device may be one wherein the speaker device does not include a battery.

The speaker device may be one wherein the speaker device is a smart device.

The speaker device may be one wherein the speaker device is a smart device case.

The speaker device may be one wherein the smart device case includes a wallet.

The speaker device may be one wherein the wallet is openable to reveal a speaker panel.

The speaker device may be one wherein the wallet is openable to reveal a front screen of the speaker device, or the wallet is openable to reveal a front screen of a device received within the speaker device.

The speaker device may be a portable speaker with wired or wireless connectivity.

The speaker device may be one wherein the speaker device is configurable to act as a stand.

The speaker device may be one wherein the speaker device is configurable to act as a stand to allow a great media experience.

The speaker device may be one wherein the speaker device is configured to receive and to store a mobile device. An advantage is that the speaker device can be retrofitted to an existing mobile device. An advantage is that an existing mobile device can be upgraded according to the needs of a user.

The speaker device may be one wherein the mobile device is removable from the speaker device. An advantage is that a user can take off the speaker device if they think they are not going to use the speaker device for a while.

The speaker device may be one wherein the speaker device is attachable to the mobile device.

The speaker device may be one wherein the mobile device is a smartphone, a laptop, a tablet or a phablet, or a mobile gaming device or Cameras, or Personal Navigation, Devices, or E-Book readers or MP3 players, or Technology enabled wearables devices.

The speaker device may be one wherein, in the closed configuration, a speaker panel is not visible to a user of the speaker device.

The speaker device may be one wherein the speaker device includes an aperture through which a camera of a stored mobile device may view outside the speaker device.

The speaker device may be one wherein the speaker device comprises a top part and a bottom part which are assemble-able into the speaker device.

The speaker device may be one wherein the speaker device is assemble-able using a snap fit.

The speaker device may be one wherein the top part and the bottom part of the speaker device may clip together using an interference fit set of latches.

The speaker device may be one wherein the top part and a bottom part are configured to release the mobile device only when the top part and the bottom part are separated. An advantage is that the mobile device cannot inadvertently fall out of the speaker device, and that the speaker device case can provide protection to the mobile device for example if the device were dropped.

The speaker device may be one wherein the speaker device is wirelessly connectable to the mobile device.

The speaker device may be one wherein the speaker device is connectable to the mobile device by wires.

The speaker device may be one wherein the speaker panel assembly is extendable from an opposite major face of the speaker device to a major face on which a screen of the mobile device received in the speaker device is displayed, such that the speaker panel assembly may act as a stand for the speaker device.

The speaker device may be one wherein the speaker panel assembly folds out from a shorter edge of the speaker device.

The speaker device may be one wherein the speaker device is ruggedized.

The speaker device may be one wherein the speaker device is ruggedized in that a ruggedized, rubber sealed case is provided.

The speaker device may be one wherein the speaker device is configurable to position a speaker panel of the speaker panel assembly in a plane parallel to the general plane of a mobile device which has been received in the speaker device, such that the speaker panel and the speaker device may lie together flat on a flat surface.

The speaker device may be one wherein the speaker device includes a charger. This may be for the mobile device or for externally connectable mobile device.

The speaker device may be one wherein the charger is a battery and/or other power sources and associated electronics.

The speaker device may be one wherein the charger is operable to charge a connected device.

The speaker device may be one wherein the speaker device includes a power supply to power itself.

The speaker device may be one wherein the speaker panel assembly includes a speaker panel mounting frame, wherein a speaker panel is housed by the frame.

The speaker device may be one wherein the frame includes one actuator or a plurality of actuators.

The speaker device may be one wherein the frame provides mounting for the actuators—and mechanical grounding to the actuators.

The speaker device may be one wherein the frame provides grounding points to the hinges and/or to the body to adjust the panel frequency response.

The speaker device may be one wherein the frame provides support to the panel and attachment points for hinges and/or for the panel.

The speaker device may be one wherein the frame provides an acoustic baffle and/or acoustic porting to the speaker panel.

The speaker device may be one wherein the frame includes rubber or other materials around a frame edge and/or in other frame positions that can interact with the speaker panel to alter the frequency response of the panel and/or provide mechanical support and stabilization.

The speaker device may be one wherein the frame provides acoustic and thermal porting. An advantage of thermal porting is that it helps to cool an actuator or actuators and or when the panel assembly is mounted in a mobile device provides thermal cooling to the device electronics eg microprocessor.

The speaker device may be one wherein the frame is provided with tuned ports with waveguides to optimise frequency response.

The speaker device may be one wherein the frame when in a closed position aligns with ports and ducts in the speaker or device case that alter to change the wavelength of the waveguides to adjust the performance of the speaker device between open and closed positions.

The speaker device may be one wherein the frame when in a closed position activates a different electronic manipulation of the audio signal or settings of the electronics producing sound so to alter the performance of the speaker device between open and closed positions and other positions of the speaker panel.

The speaker device may be one wherein the speaker panel is permanently attached to the frame.

The speaker device may be one wherein the speaker panel is detachable from the frame.

The speaker device may be one wherein the speaker panel is detachable from the frame using a magnetic mechanism or a clip mechanism.

The speaker device may be one wherein the speaker panel is held in a hinged frame and the speaker panel may rotate on the hinges.

The speaker device may be one wherein the speaker panel assembly includes a fixed or removable cover to protect the speaker panel.

The speaker device may be one wherein the speaker panel assembly includes no rear cover.

The speaker device may be one wherein the speaker panel assembly includes a fixed or adjustable baffle.

The speaker device may be one wherein the speaker panel assembly includes a speaker panel but no frame. The speaker device may be one wherein the speaker panel assembly includes a speaker panel but no frame but may be mounted to the device or the device case on a mounting assembly that is not a frame.

The speaker device may be one wherein the speaker panel is detachable from the speaker device.

The speaker device may be one wherein the speaker panel assembly includes spring loaded pins.

The speaker device may be one wherein the speaker panel assembly includes a Push Push or other release mechanism attached to a frame wherein the panel is mounted in the frame and frame is suspended on springs or other mounting method into the case or into the device, and an advantage of this system is that the panel size can be made larger as it requires no hinges and therefore the panel size can be increased relative to the device size. A "push push" mechanism is one in which a user can push the speaker panel to release the assembly, and a user can provide a further push to the speaker panel to return the assembly. The speaker panel and or speaker panel frame assembly may also be released and retained by a latch.

The speaker device may be one wherein the speaker panel assembly includes hinges, wherein the hinges support a speaker panel.

The speaker device may be one wherein actuators are mounted on the hinges.

The speaker device may be one wherein the hinges are articulating hinges.

The speaker device may be one wherein the hinges include aluminium, or other material.

The speaker device may be one wherein the hinges are fixed into the speaker assembly on a friction hinge.

The speaker device may be one wherein the hinges route connections to be made to actuators.

The speaker device may be one wherein the speaker panel is pivotable with respect to the hinges. An advantage is that sound output is directed.

The speaker device may be one wherein the speaker panel is pivotable with respect to the hinges such that the speaker panel is rotatable through 180 or 360 degrees with respect to the hinges.

The speaker device may be one wherein when in the closed configuration, either side of the speaker panel may be displayed. An advantage is that different designs printed on the panels may be displayed.

The speaker device may be one wherein the speaker panel has different designs on each side.

The speaker device may be one wherein the speaker panel includes carbon fibre,/carbon fibre composite and or Kevlar/Kevlar composite or other material.

The speaker device may be one wherein the hinges can slide and articulate at either end of the speaker panel.

The speaker device may be one wherein the hinges are a pair of hinges or maybe a single hinge.

The speaker device may be one wherein the speaker panel is detachable from the hinges or speaker panel frame assembly using a magnetic mechanism or a clip mechanism. An advantage is that a broken speaker panel may be replaced.

The speaker device may be one wherein the speaker panel has a mechanically free edge. An advantage is improved frequency range response.

The speaker device may be one wherein the speaker panel has a plurality of mechanically free edges. An advantage is improved frequency range response.

The speaker device may be one wherein the speaker panel includes a single actuator arranged to actuate the speaker panel.

The speaker device may be one wherein the speaker panel includes a plurality of actuators arranged to actuate the speaker panel. An advantage is improved output power and frequency range of actuation.

The speaker device may be one wherein the speaker panel assembly includes a single speaker panel.

The speaker device may be one wherein the single speaker panel includes two pieces of different material to create one assembly that has two speakers.

The speaker device may be one wherein the two pieces of different material are connected by a flexible or semi rigid material.

The speaker device may be one wherein the speaker panel assembly includes a plurality of actuators.

The speaker device may be one wherein the actuators include dual mode actuators (DMA).

The speaker device may be one wherein actuators are mounted on a panel of the speaker panel assembly.

The speaker device may be one wherein the actuators are mounted on the panel.

The speaker device may be one wherein the speaker panel assembly includes a plurality of speaker panels.

The speaker device may be one wherein the speaker panel assembly includes two speaker panels, e.g. to create left and right audio channels.

The speaker device may be one wherein the two speaker panels are articulatable along a length of the speaker device.

The speaker device may be one wherein the two speaker panels are articulatable along a width of the speaker device.

The speaker device may be one wherein the two speaker panels are foldable out from edges of the speaker device.

The speaker device may be one wherein the two speaker panels are foldable out from longer edges of the speaker device.

The speaker device may be one wherein the two speaker panels are overlaid one on top of the other in the closed configuration, eg. so as to create left and right audio channels in the open configuration.

The speaker device may be one wherein the two speaker panels are of different sizes. An advantage is improved performance over a single panel.

The speaker device may be one wherein the plurality of speaker panels provide stereo performance.

The speaker device may be one wherein the plurality of speaker panels open from a centre outwards.

The speaker device may be one wherein the plurality of speaker panels open from edges inwards towards a centre.

The speaker device may be one wherein the plurality of speaker panels can be various shapes eg. Rectangles, Squares, Circular, Triangular.

The speaker device may be one wherein a release mechanism is provided, and when released, the plurality of panels pop up.

The speaker device may be one wherein the speaker device includes one or a plurality of detachable pieces.

The speaker device may be one in which pushing or articulating of the speaker panel assembly activates the playing of music and/or the connection of a wireless connection.

The speaker device may be one wherein the detachable pieces are detachable end pieces.

The speaker device may be one wherein the speaker device includes one or a plurality of detachable end pieces, wherein a detachable end piece is attachable to, and detachable from, the base of a mobile device (eg. smartphone) housed in the speaker device.

The speaker device may be a mobile phone.

The speaker device may be a non-mobile television set. The speaker device may be one wherein the speaker assembly is openable from a side of the non-mobile television set.

The speaker device may be a sound bar. The speaker device may be a portable navigation device. The speaker device may be a navigation device built into a vehicle. The speaker device may be an in-vehicle audio device. The speaker device may be a wristwatch device eg. an Apple iWatch. The speaker device may be a MP3 player, a camera, a stand-alone speaker device eg. a smartphone sized stand-alone speaker device, or a handheld gaming console a tablet computer a notebook computer According to a second aspect of the invention, there is provided a speaker panel, insertable into a speaker device of any aspect of the first aspect of the invention, as a replacement speaker panel.

According to a third aspect of the invention, there is provided a use of a first device of any aspect of the first aspect of the invention, and of a second device of any aspect of the first aspect of the invention, in connection with a third device, the first and second devices outputting sound based on signals or data sent from the third device.

According to a fourth aspect of the invention, there is provided a computer program product, executable on a processor of a speaker device of any aspect of the first aspect of the invention, the computer program product arranged to move the speaker panel assembly between the open configuration and the closed configuration.

According to a fifth aspect of the invention, there is provided a computer program product, executable on a processor of a mobile device storable in a speaker device of any of claims 46 to 133, the computer program product arranged to move the speaker panel assembly between the open configuration and the closed configuration when the mobile device is stored in the speaker device.

According to a sixth aspect of the invention, there is provided a method of operating a speaker device of any aspect of the first aspect of the invention, the method of including the step of moving the speaker panel assembly from the closed configuration to the open configuration.

The method may include the step of moving the speaker panel assembly from the open configuration to the closed configuration.

According to a seventh aspect of the invention, there is provided a speaker device, the speaker device including a case, a speaker panel and a speaker panel suspension system, wherein the speaker panel is surrounded by the case, wherein the speaker panel is arranged to vibrate, and wherein the speaker panel suspension system is configured to decouple speaker panel vibration from the case.

The speaker device may be one wherein the speaker panel suspension system is configured to enhance a frequency response of the panel.

The speaker device may be one wherein the speaker panel is contiguous with the case, but the speaker panel is not touching the case.

The speaker device may be one wherein the speaker panel suspension system includes a membrane.

The speaker device may be one wherein the speaker panel is not movable between an open configuration and a closed configuration.

The speaker device may be one wherein the speaker device is portable.

The speaker device may be one wherein the speaker device is operable to receive power from a connected device.

The speaker device may be one wherein the speaker device is configurable to communicate wirelessly.

The speaker device may be one wherein the speaker device includes Bluetooth.

The speaker device may be one wherein the speaker device accommodates one connected device at a time.

The speaker device may be one wherein the speaker device can accommodate more than one connected device at a time.

The speaker device may be one wherein the speaker device includes its own electronics.

The speaker device may be one wherein the speaker device includes a detachable piece.

The speaker device may be one wherein the speaker device includes a battery.

The speaker device may be one operable to provide power to an external device via a power connection on the speaker device.

The speaker device may be one wherein the speaker device includes a microphone, to enable voice control of the device or connected devices and or conference calling via the speaker device whilst connected to a smart device.

The speaker device may be one wherein the speaker device is operable as a hands free speaker.

The speaker device may be one wherein the speaker device is arranged to receive voice prompts.

The speaker device may be one wherein the speaker device includes a processor, wherein the speaker device is arranged to post process digital and or audio signals it receives from a connected device, using the processor.

The speaker device may be one wherein the speaker device does not include a battery.

The speaker device may be one wherein the speaker device is a smart device.

The speaker device may be one wherein the speaker device is a smart device case.

The speaker device may be one wherein the speaker device is configured to receive and to store a mobile device.

The speaker device may be one wherein the mobile device is removable from the speaker device.

The speaker device may be one wherein the speaker device is attachable to the mobile device.

The speaker device may be one wherein the mobile device is a smartphone, a laptop, a tablet or a phablet, a mobile gaming device, a camera, a Personal Navigation Device, an E-Book reader, an MP3 player or a technology enabled wearable device.

The speaker device may be one wherein the speaker device includes an aperture through which a camera of a stored mobile device may view outside the speaker device.

The speaker device may be one wherein the speaker device comprises a multiple part assembly which is assemble-able into the speaker device.

The speaker device may be one wherein the speaker device is assemble-able using a snap fit or other attachment method.

The speaker device may be one wherein a top part and a bottom part of the speaker device may clip together using an interference fit set of latches.

The speaker device may be one wherein a top part and a bottom part are configured to release the mobile device only when the top part and the bottom part are separated.

The speaker device may be one wherein the mobile device fits into the speaker device without requiring a top part of the speaker device.

The speaker device may be one that's generic and is not designed to fit a specific configuration of smart device but can be used on a number of different smart devices and is attached by clips or other means.

The speaker device may be one wherein the speaker device is wirelessly connectable to the mobile device.

The speaker device may be one wherein the speaker device is connectable to the mobile device by wires.

The speaker device may be one wherein the speaker device includes a charger.

The speaker device may be one wherein the charger is a battery and/or associated electronics.

The speaker device may be one wherein the charger is operable to charge a connected device.

The speaker device may be one wherein the speaker device includes a power supply to power itself, and/or connected devices.

The speaker device may be one wherein the speaker panel has a mechanically free edge.

The speaker device may be one wherein the speaker panel has a plurality of mechanically free edges.

The speaker device may be one wherein the speaker panel includes a single actuator arranged to actuate the speaker panel.

The speaker device may be one wherein the speaker panel includes a plurality of actuators arranged to actuate the speaker panel.

The speaker device may be one including a single speaker panel.

The speaker device may be one wherein the single speaker panel includes two pieces of different material to create one assembly that has two speakers.

The speaker device may be one wherein the two pieces of different material are connected by a flexible or semi rigid material.

The speaker device may be one wherein the speaker panel assembly includes a plurality of actuators.

The speaker device may be one wherein the actuators include dual mode actuators (DMA).

The speaker device may be one wherein the speaker device is a mobile phone.

The speaker device may be one wherein the speaker device is a non-mobile television set.

The speaker device may be one wherein the speaker assembly is openable from a side of the non-mobile television set.

The speaker device may be one wherein the speaker device is a sound bar.

The speaker device may be one wherein the speaker device is a portable navigation device.

The speaker device may be one wherein the speaker device is a navigation device built into a vehicle.

The speaker device may be one wherein the speaker device is an in-vehicle audio device.

The speaker device may be one wherein the speaker device is a technology enabled wearable device eg wristwatch device eg. an Apple iWatch.

The speaker device may be one wherein the speaker device is a MP3 player, a camera, a stand-alone speaker device eg. a smartphone sized stand-alone speaker device, or smaller, or a handheld gaming console, or a tablet computer, or a notebook computer.

According to an eighth aspect of the invention, there is provided a speaker device which is standalone speaker that includes in one assembly two or more speaker panels that are attachable together to form a single portable device that can be split into separate speakers.

The speaker device may be one including a splittable case housing the speakers, the casing splittable to separate the speakers.

The speaker device may be one wherein one speaker is a high frequency speaker and another speaker is a low frequency speaker.

The speaker device may be one wherein a split between two speakers is proportionally different, in which one speaker and its housing is a different size to another speaker and its housing.

The speaker device may be one wherein separate speakers can be wired or wirelessly connected to a device that can provide audio signals to the separate speakers.

The speaker device may be one wherein separate speakers can be wired or wirelessly connected to a device that can provide audio signals to the separate speakers and used to create stereo sound.

The speaker device may be one wherein each of two speakers operates to split the frequency components of a signal between them such that one speaker handles the higher frequency components of a signal and the other speaker handles the lower frequency components of a signal.

BRIEF DESCRIPTION OF THE DRAWINGS

The above and other aspects of the invention will now be described, by way of example only, with reference to the following Figures, in which.

DETAILED DESCRIPTION

A speaker device (eg. a speaker boost device, by way of example) may utilize various concepts, alone or in combination. Here we describe some concepts which may relate to a speaker device (eg. a speaker boost device, by way of example).

Concept 1—Actuated (eg. DMA) Speaker Boost

There is provided a single panel that can be designed as rectangles or other shapes with one or two or more actuators. Actuators may be dual mode actuators (DMA), but other actuators may be used. An actuated speaker case may be clipped to a mobile device, such as a smartphone or a tablet, or a laptop.

There is provided one, two or more actuators (eg. DMA's) mounted in a frame with articulating hinges. This may allow the frame and the speaker panel to be positioned in different orientations on the back of the device.

The case may include its own electronics and can be connected either wirelessly or by a wire to the device. The hinges can slide and articulate at either end allowing multiple configurations to be made.

Figure 4:
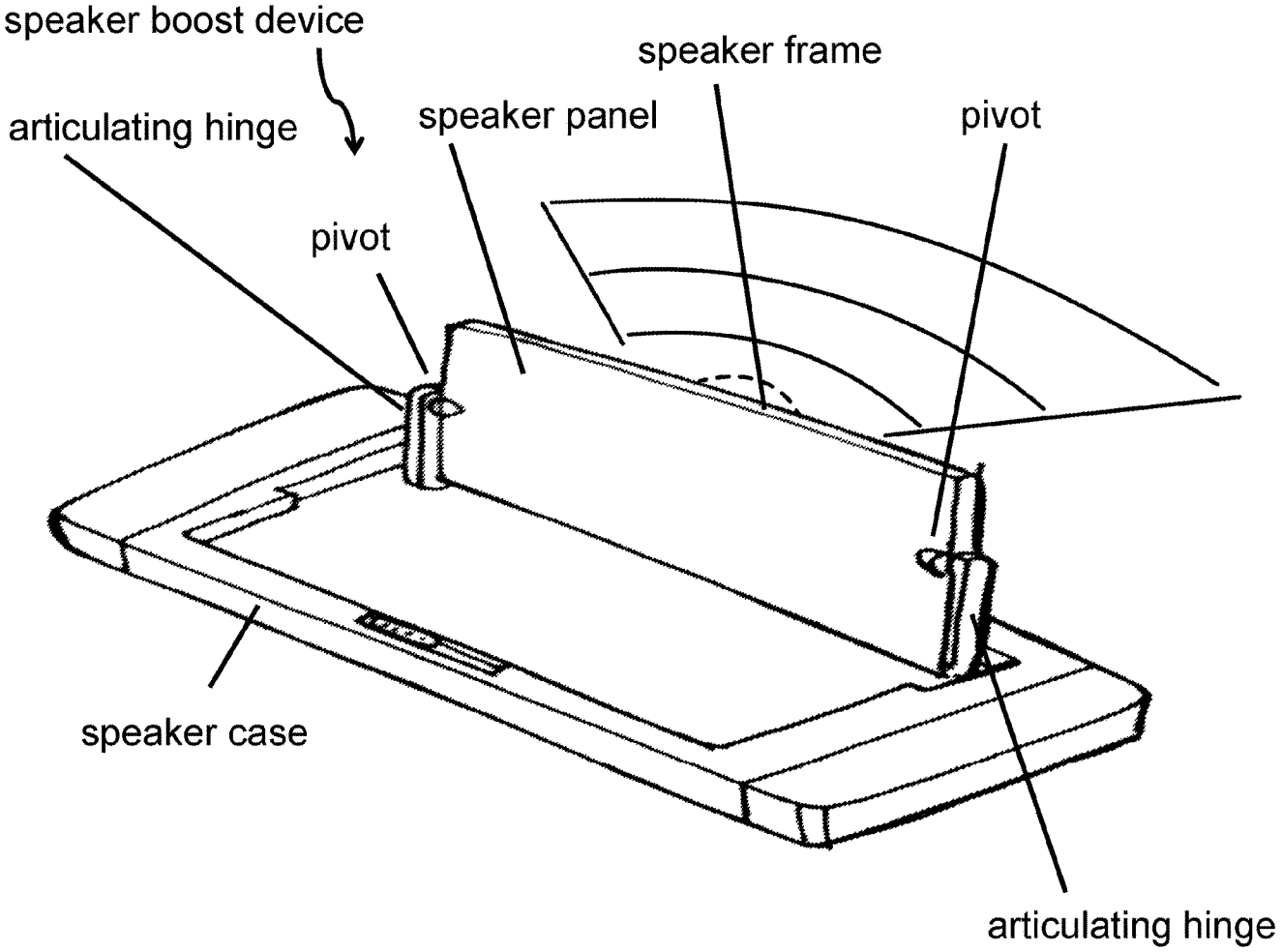
FIG. 4 shows an example of a speaker boost device in an open configuration.
Figure 5:
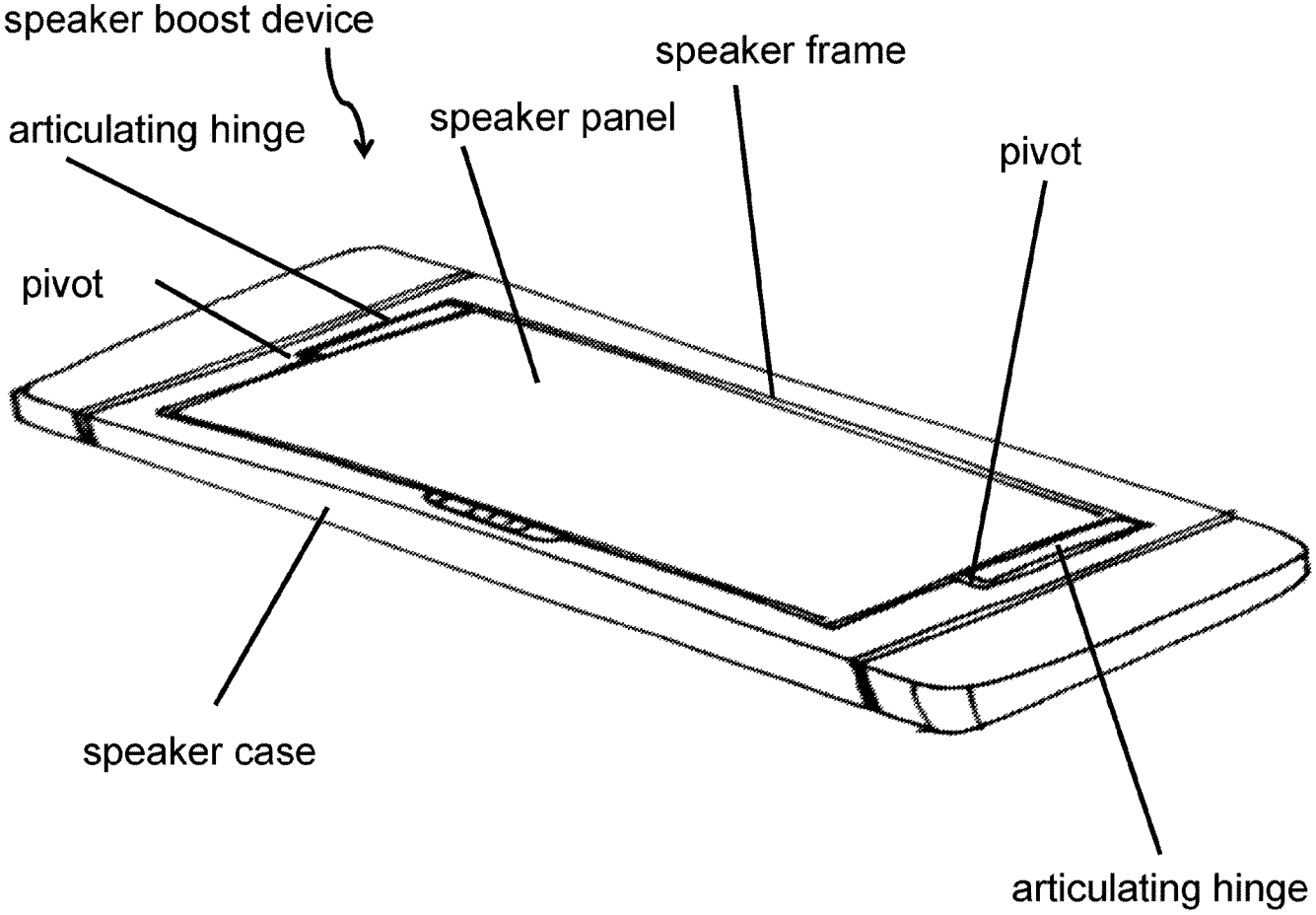
FIG. 5 shows an example of a speaker boost device in a closed configuration.

There is provided a speaker boost device including a speaker case, a speaker panel housed in a speaker frame, and a pair of articulating hinges, wherein the speaker frame is pivotable with respect to the pair of articulating hinges. The speaker panel may be in an open configuration. The speaker panel may be in a closed configuration. An example of a speaker boost device including a speaker case, a speaker panel housed in a speaker frame, and a pair of articulating hinges, wherein the speaker frame is pivotable with respect to the pair of articulating hinges, is shown in an open configuration in FIG. 4. An example of a speaker boost device including a speaker case, a speaker panel housed in a speaker frame, and a pair of articulating hinges, wherein the speaker frame is pivotable with respect to the pair of articulating hinges, is shown in a closed configuration in FIG. 5.

Figure 6:
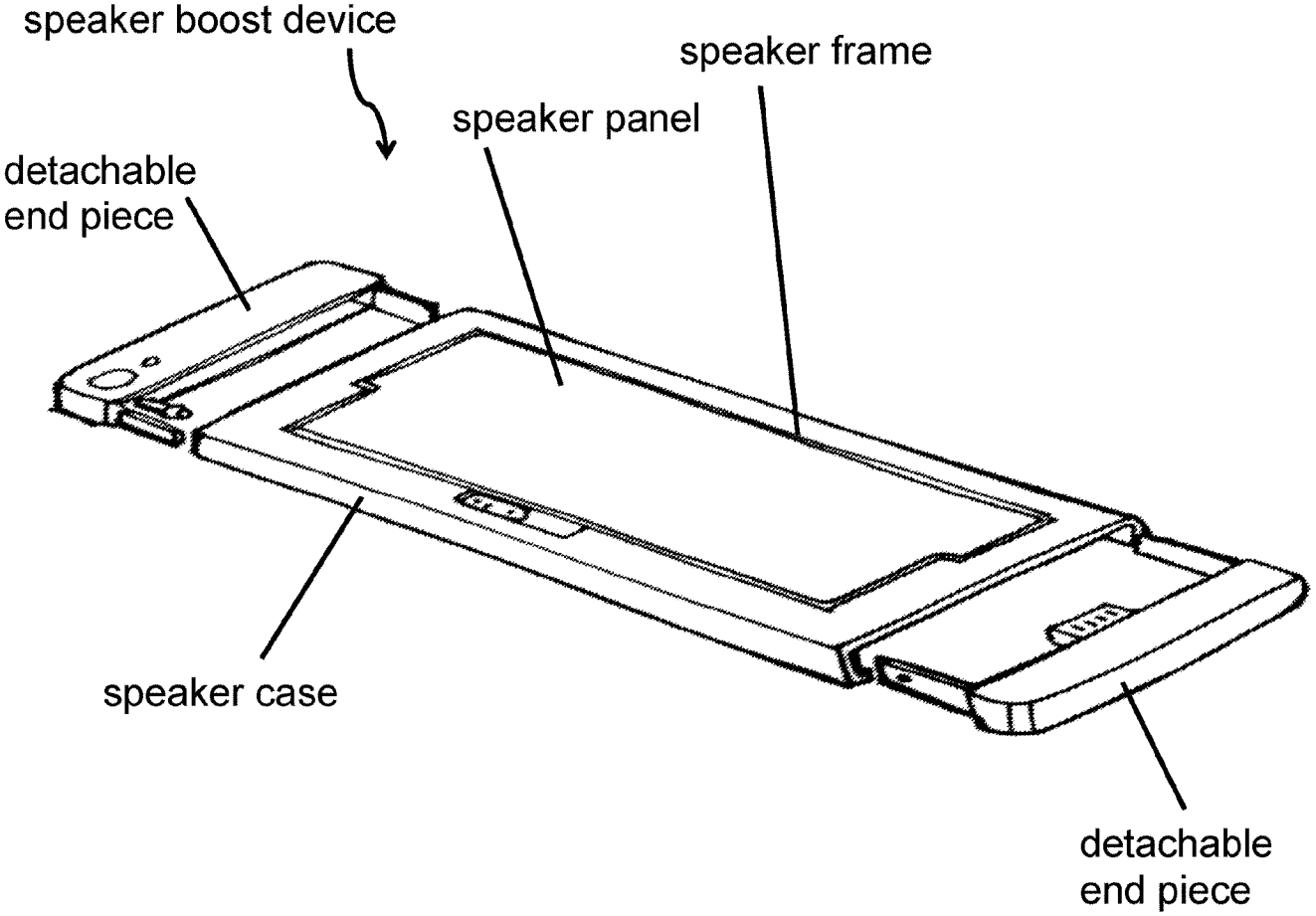
FIG. 6 shows an example of a speaker boost device in a configuration with the detachable end pieces detached.

A speaker boost device may include a speaker case, a speaker panel housed in a speaker frame, and one, two or more detachable pieces. An example of a speaker boost device including a speaker case, a speaker panel housed in a speaker frame, and two detachable end pieces, is shown in a configuration with the detachable end pieces detached, in FIG. 6.

Cases or connectors can be modular and made to fit some or all popular phones or devices. The case's design can be broken into a series of blocks/modules to allow a flexible design architecture or the case design may be fixed to a particular design of phone or device.

Figure 7A:
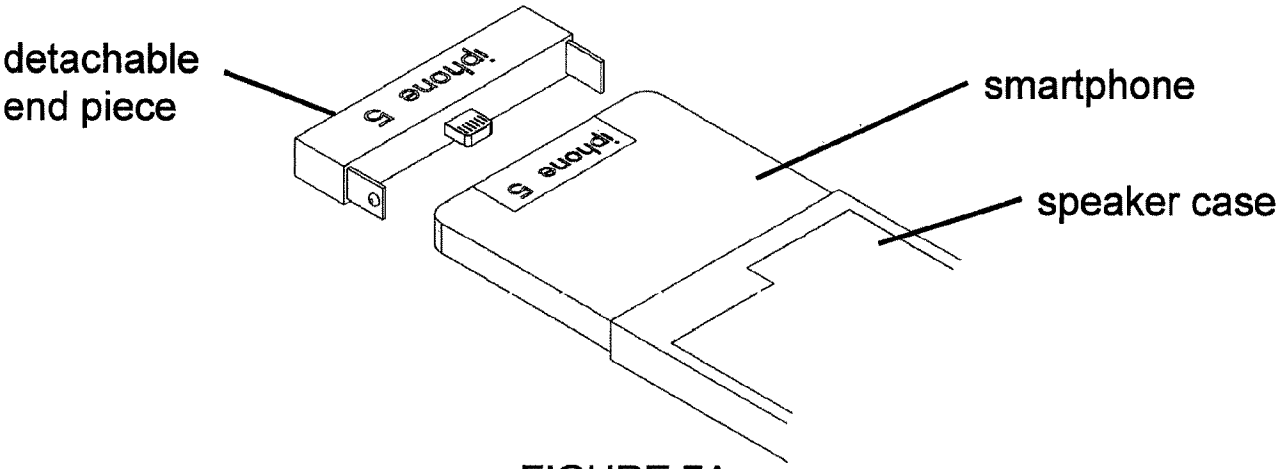
FIG. 7A shows an example of a detachable end piece, which has been detached from a smartphone base, in which the smartphone is partially inserted into a speaker case of a speaker boost device.
Figure 7B:
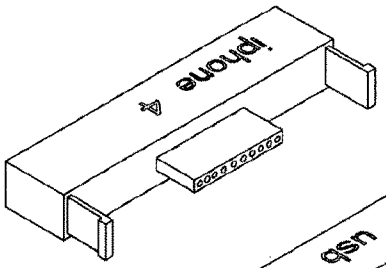
FIGS. 7B, 7C and 7D show examples of detachable end pieces.
Figure 7C:
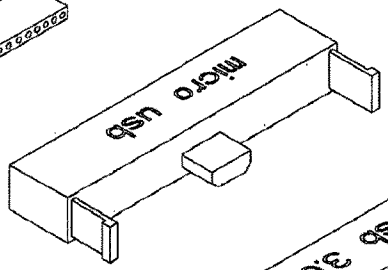
Figure 7D:
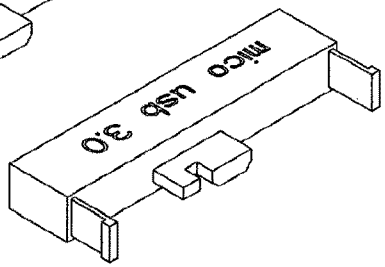

A detachable end piece may be attachable to, and detachable from, the base of a smartphone. A smartphone may be removably housed inside a speaker case of a speaker boost device. An example of a detachable end piece, which has been detached from a smartphone base, in which the smartphone is partially inserted into a speaker case of a speaker boost device, is shown in FIG. 7A. FIGS. 7B, 7C and 7D show further examples of detachable end pieces.

An actuator/panel frame may be provided in a speaker boost device example. The frame is optional but if used it may:

- Provide support to the panel and attachment points for the hinges.
- Provide mounting for the actuators—and mechanical grounding to the actuators.
- Provide baffle to the panel, enhancing the frequency response of the panel.
- Provide porting and this porting can be mechanically adjusted to allow for different positions of the panel and to adjust frequency response of the panel.
- be a frame with rubber or other materials around frame edge and/or in other positions that can interact with the panel to alter the frequency response of the panel and/or provide mechanical support and stabilization.
- provide grounding points to the hinges and/or to the body to adjust the panel frequency response.

A speaker boost device may be provided which is configurable to provide a stand for a smartphone, when the smartphone is housed within the speaker boost device. A speaker booster may provide a stand for a device (eg. a smartphone device, or other device), to allow a great media experience. The stand can be the panel, the hinges or frame. Actuators (eg. DMA's) may be mounted in the speaker frame. The panel can be permanently attached to the frame/hinges or can be mounted on a magnetic/clip mechanism allowing the panel to be removed and changed by the user. The actuators (eg. DMA's) may be mounted on the frame, the hinges, or on the panel. The case can include its own electronics and can be connected either wirelessly or in a wired way (eg. by a wire) to the device (eg. smartphone).

Figure 8:
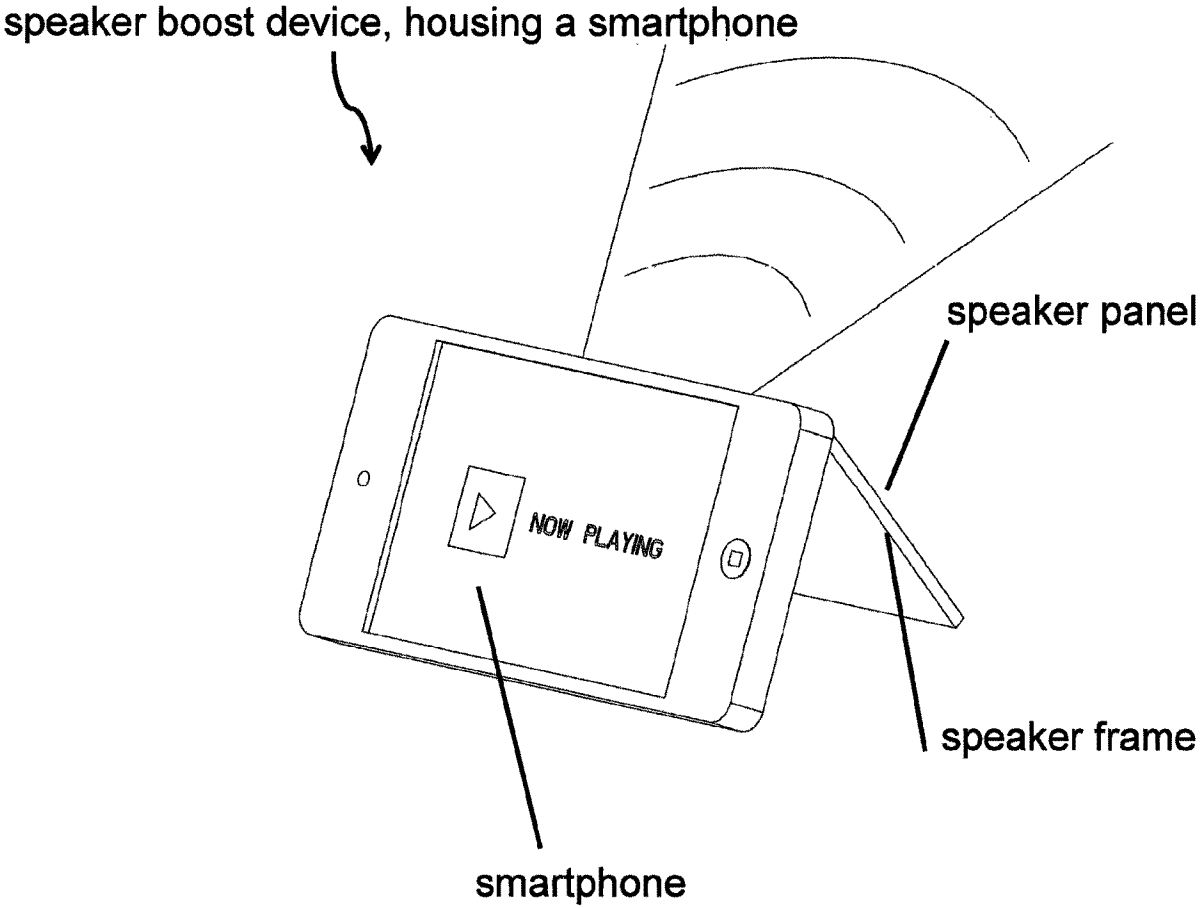
FIG. 8 shows an example of a speaker boost device housing a smartphone so as to act as a stand.

A speaker boost device may house a smartphone. A speaker frame housing a speaker panel may extend from an opposite major face of the speaker boost device to the major face on which a screen of the smartphone is displayed, such that the speaker frame may act as a stand for the speaker boost device. An example of a speaker boost device housing a smartphone, in which a speaker frame housing a speaker panel extends from an opposite major face of the speaker boost device to the major face on which a screen of the smartphone is displayed, so as to act as a stand, is shown in FIG. 8.

There is provided a speaker boost device including a speaker case, a speaker panel housed in a speaker frame, and a pair of articulating hinges, wherein the speaker frame is pivotable with respect to the pair of articulating hinges. In an example, a speaker frame may include a rear cover. Actuators (eg. DMA's) may be housed in a speaker frame. A vibrating front panel may be housed in a speaker frame. Power can be supplied by a device connected to the speaker booster, or a cover of the speaker booster can also have its own internal power supply to power itself, and that may also be used to charge a device or devices the speaker booster may be connected to.

Figure 9:
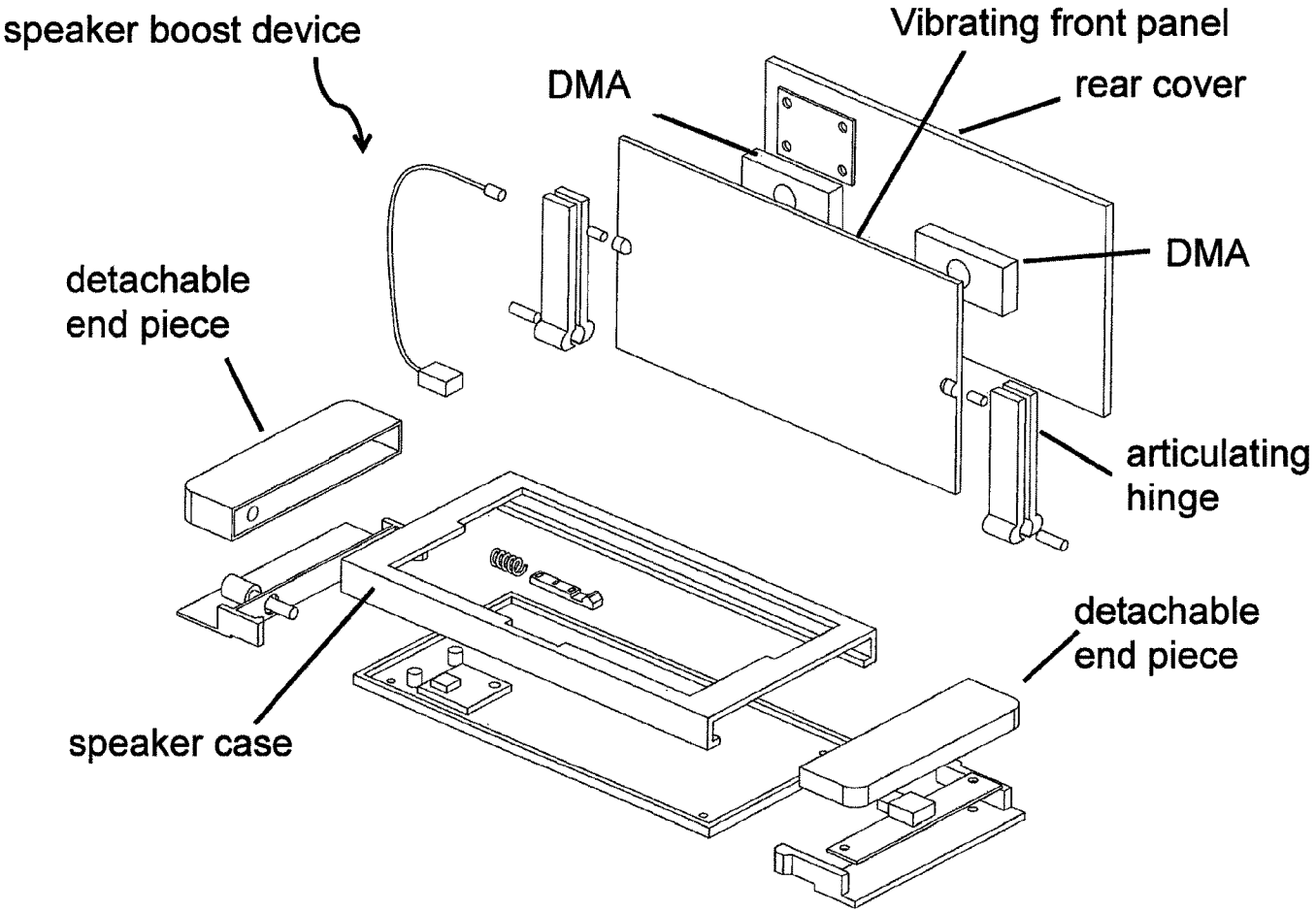
FIG. 9 shows an exploded view of an example speaker booster device.

FIG. 9 shows an exploded view of an example speaker booster device. A speaker frame is omitted from FIG. 9. FIG. 9 shows a speaker boost device including a speaker case, a speaker vibrating front panel housed in a speaker frame, and a pair of articulating hinges, wherein the speaker frame is pivotable with respect to the pair of articulating hinges, the speaker further including a rear cover, two DMA's, the speaker booster device further including two detachable end pieces.

There is provided a speaker boost including a speaker panel housed in a frame, but with no back cover on the frame. Actuators (eg. DMA's) may be mounted on hinges in a support frame; actuators (eg DMAs) may be located in the frame and/or and mounted directly to the panel. Single or dual actuators (eg. DMA's)/or multiple actuators (eg. DMA's) may be used. One actuator (eg. DMA) may be mounted on one side of a panel and one actuator (eg. DMA) may be mounted on the other side of the panel, to create a stereo like effect. Note that hinges may be sliding hinges, which may also be fixed at one end of a sliding range of a hinge arm. In an example, a single panel actuator (eg. DMA) is mounted on a speaker panel at the speaker panel end, and to a hinge arm.

A speaker device may be provided including a housing with a speaker panel frame assembly mounted to it, the assembly including speaker panel hinges, in which the hinges are telescopic hinges. The telescopic hinges may be extendable hinges.

Figure 41:
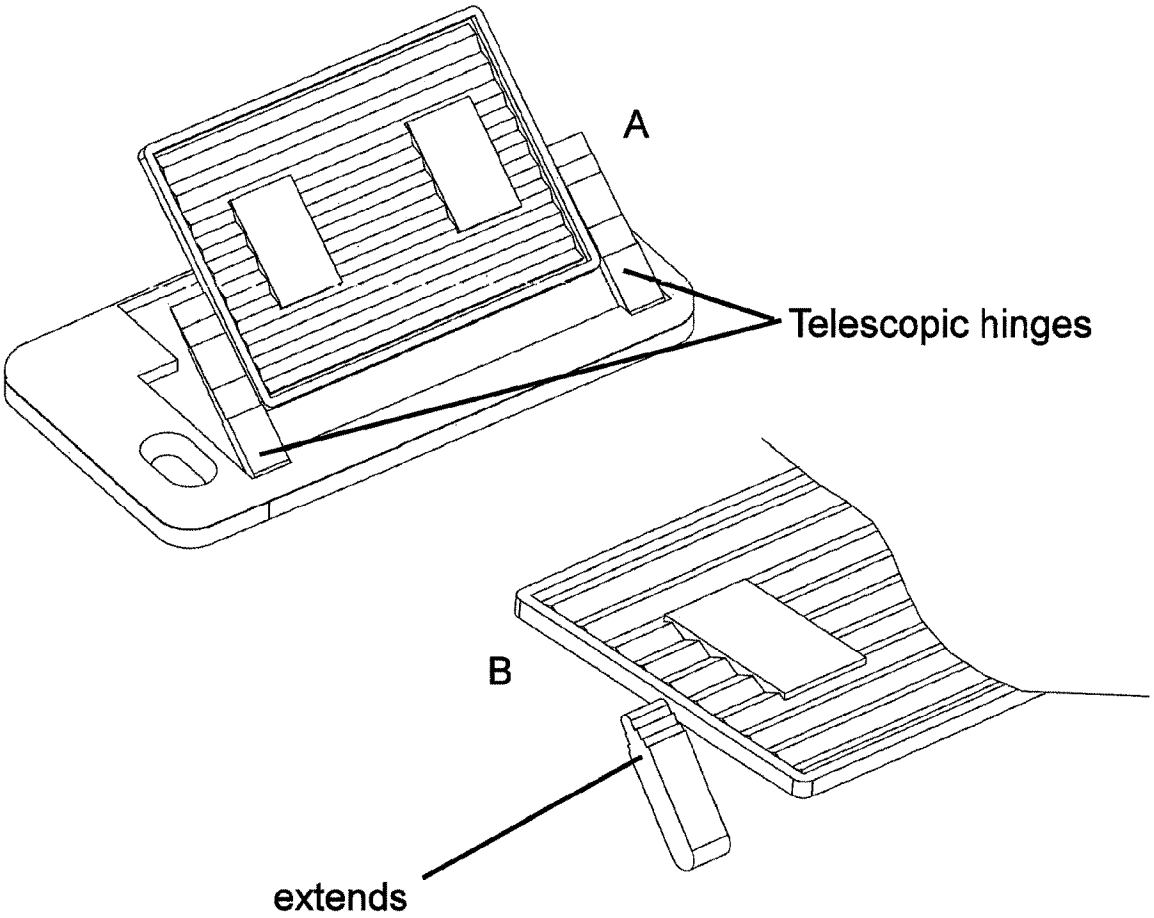
FIG. 41 shows (A) an example of a housing with a speaker panel frame assembly mounted to it, in which the hinges are telescopic hinges, and (B) detail emphasizing an extendable hinge.

FIG. 41 shows (A) an example of a speaker device housing with a speaker panel frame assembly mounted to it, in which the hinges are telescopic hinges, and (B) detail emphasizing an extendable hinge.

A speaker device may be provided including a speaker panel frame assembly which has hinges which are not connected to each other on a torsion bar and use the speaker panel frame assembly to provide a mechanical connection (e.g. a torsion bar connection) to the other hinge.

Figure 42:
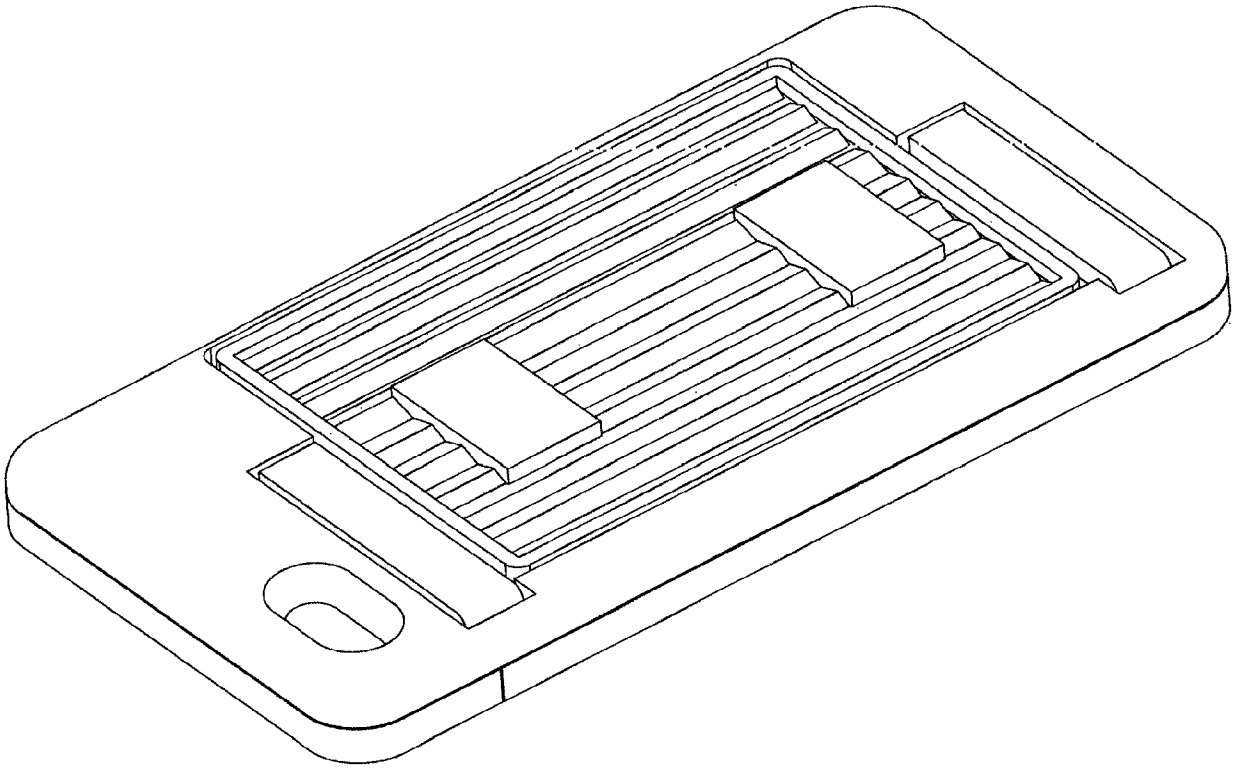
FIGS. 42 and 43 show an example of a speaker panel frame assembly which has hinges which are not connected to each other on a torsion bar and use the speaker panel frame assembly to provide a mechanical connection (e.g. a torsion bar connection) to the other hinge.
Figure 43:
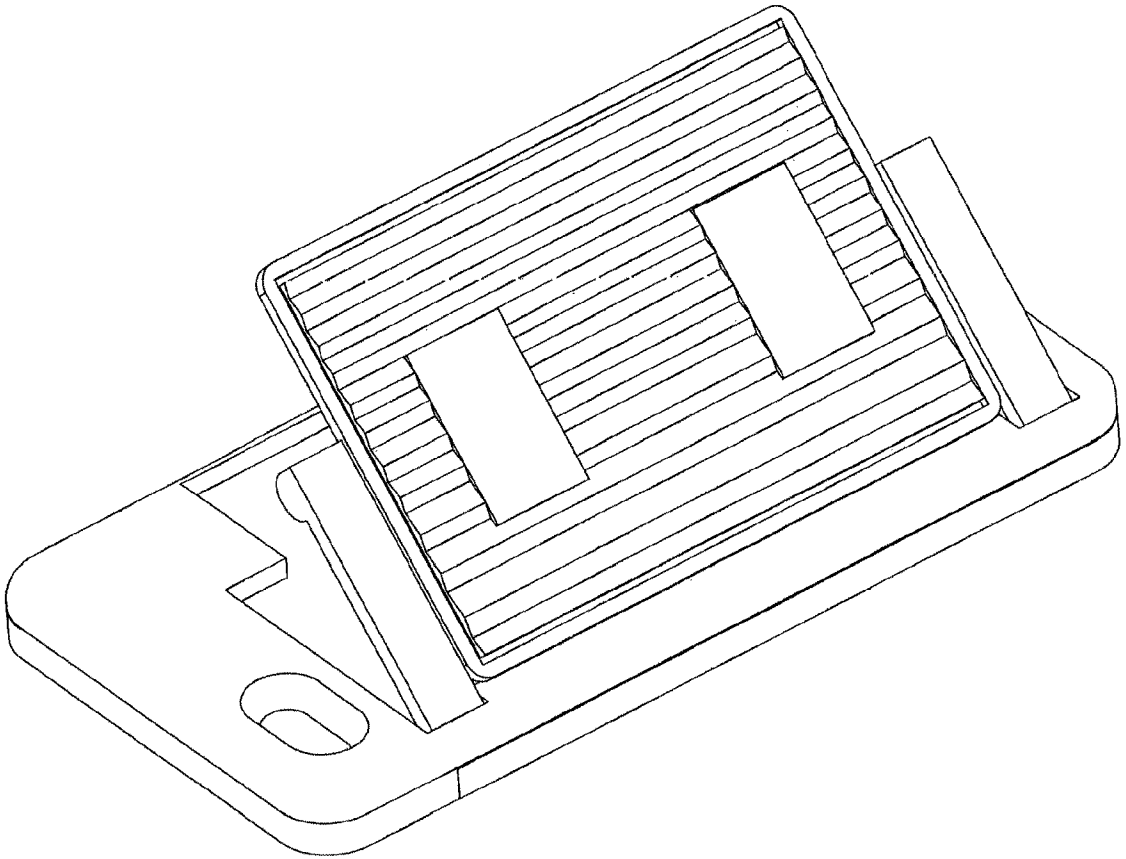

FIGS. 42 and 43 show an example of a speaker panel frame assembly which has hinges which are not connected to each other on a torsion bar and use the speaker panel frame assembly to provide a mechanical connection (e.g. a torsion bar connection) to the other hinge.

Figure 10:
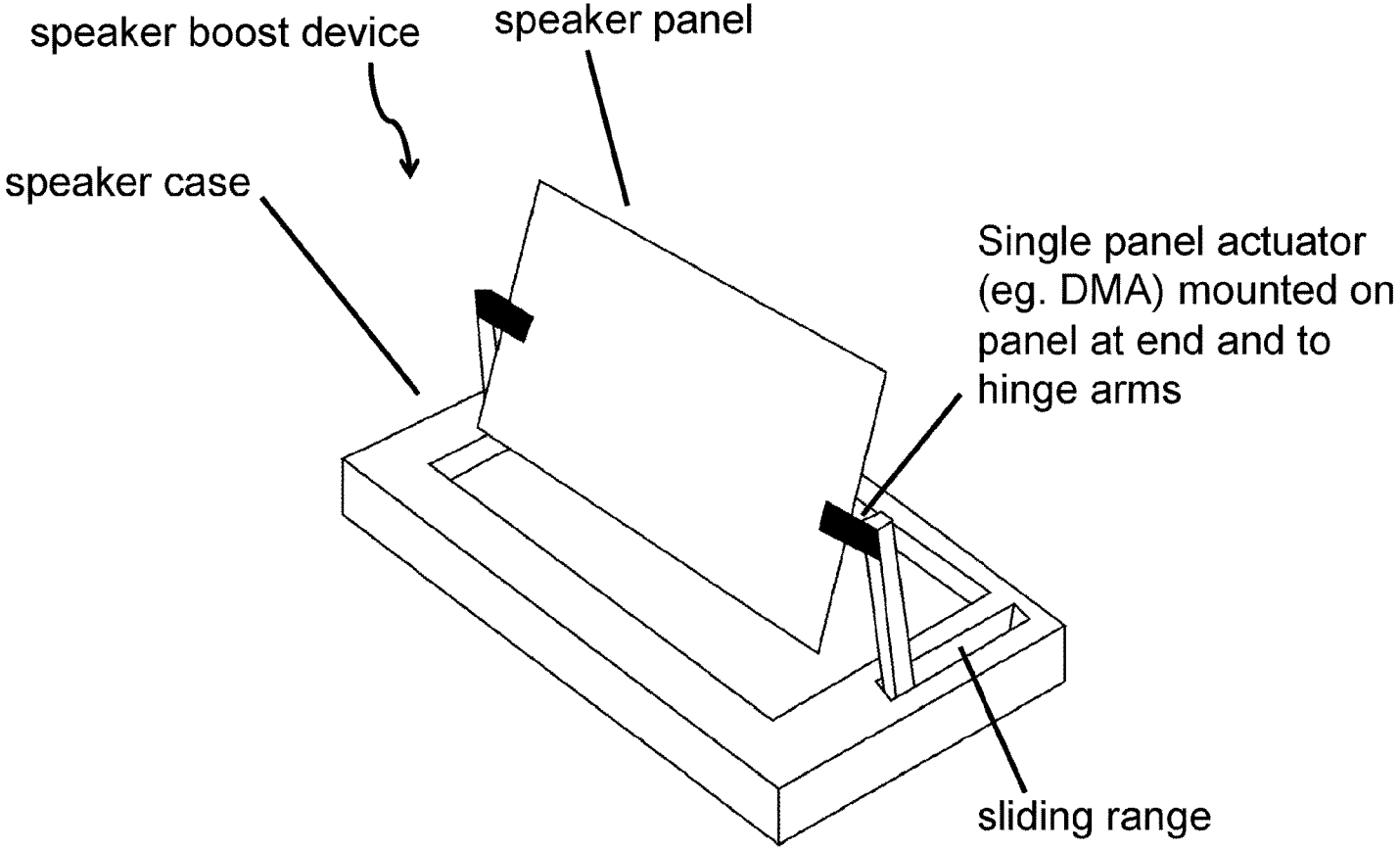
FIG. 10 shows an example of a speaker boost including a speaker panel housed in a frame, but with no back cover on the frame.

An example of a speaker boost including a speaker panel housed in a frame, but with no back cover on the frame, is shown in FIG. 10.

Figure 37:
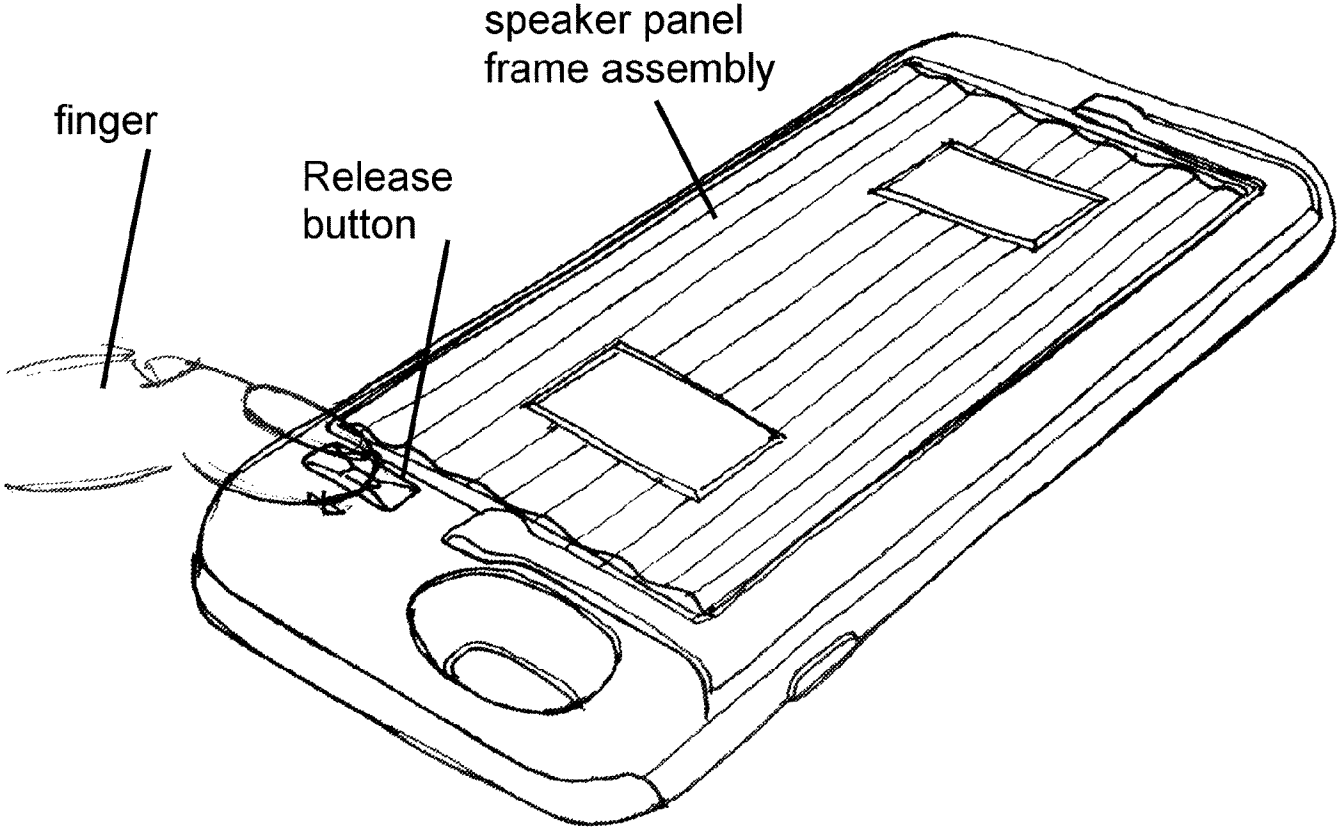
FIGS. 37 and 38 show an example of a speaker panel frame assembly which may be finger released by a mechanism.
Figure 38:
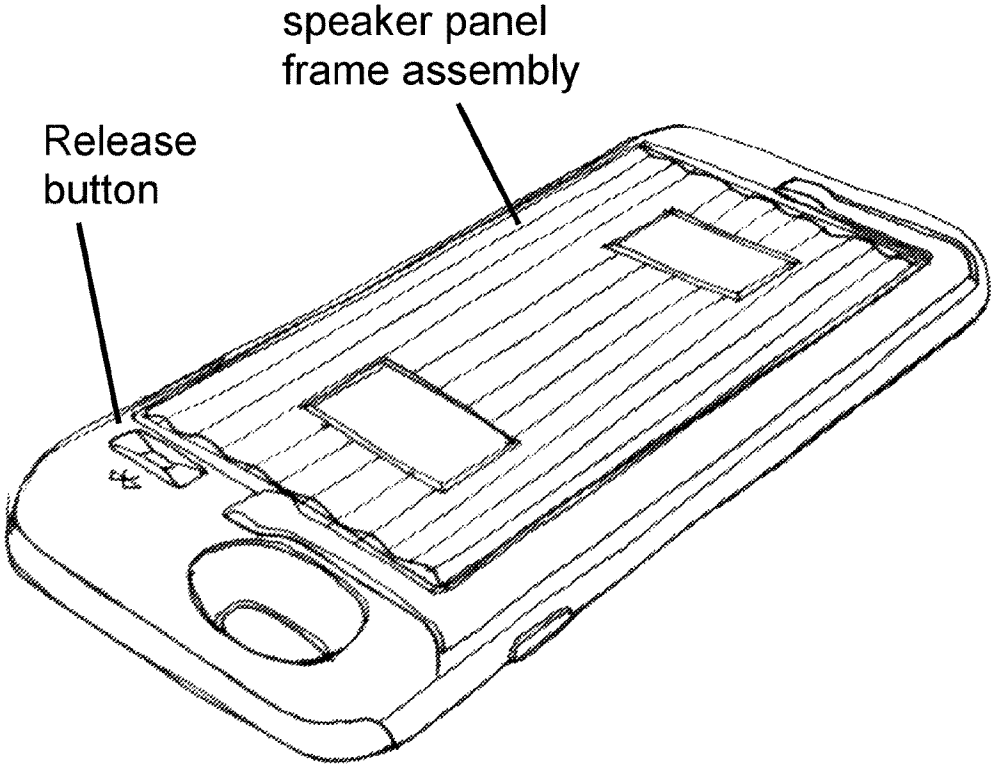

A speaker device may be provided in which a speaker panel frame assembly is releasable by a mechanism, using a finger, such as by pressing a release button. FIGS. 37 and 38 show an example of a speaker panel frame assembly which may be finger released by a mechanism.

The speaker device may be one wherein the speaker panel faces inwards, such that when the speaker device is in a closed position the panel assembly is retracted into the body of the device so the panel cannot be seen on the outside surface and when the panel assembly is in an open position the panel is articulated into free space. The back of the speaker device may be such that it appears as the back of a portable device it is attached onto, or may be a plastic, metal or other material. The speaker device may be a portable device.

A speaker device may be provided in which a speaker panel frame assembly is releasable by being pressed; the speaker panel frame assembly then rises vertically into an open position, and the speaker panel frame assembly can be returned to the closed position by pressing the speaker panel vertically down into the housing.

Figure 39:
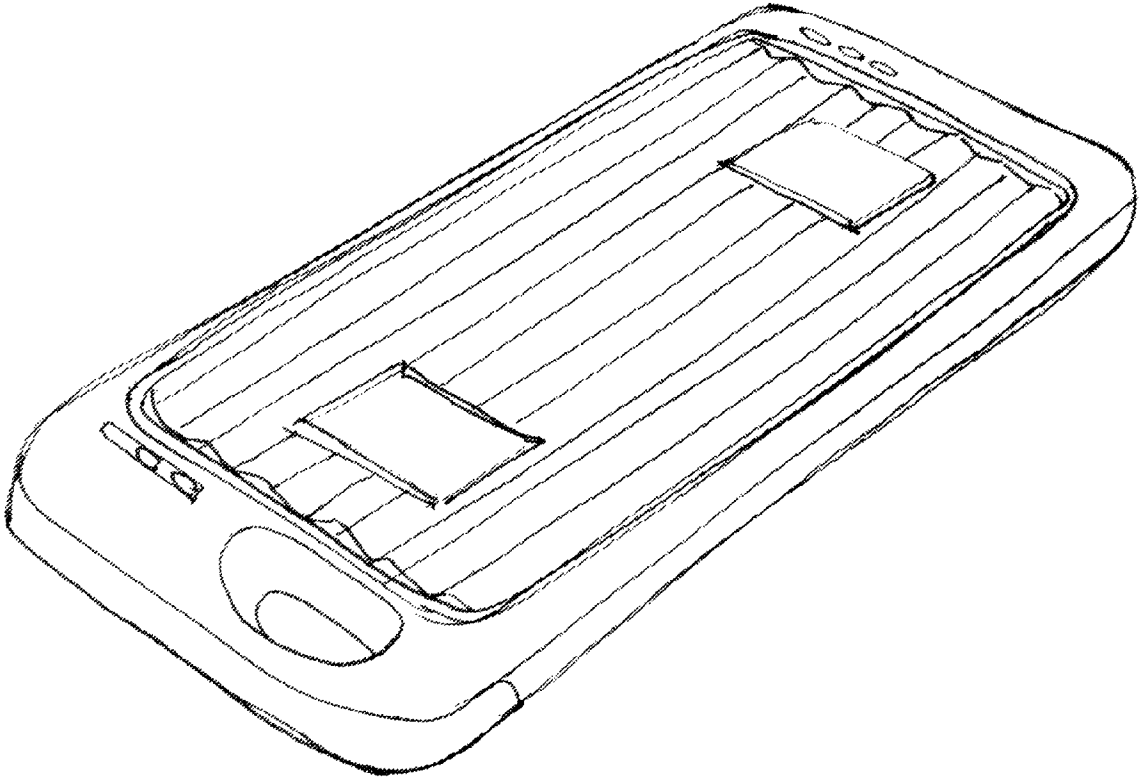
FIGS. 39 and 40 show an example of a speaker panel frame assembly in the closed position (see FIG. 39) which is then pressed and rises vertically into the open position (see FIG. 40) on a mechanism and can be returned to the closed position (see FIG. 39) by pressing the speaker panel vertically down into the housing.
Figure 40:
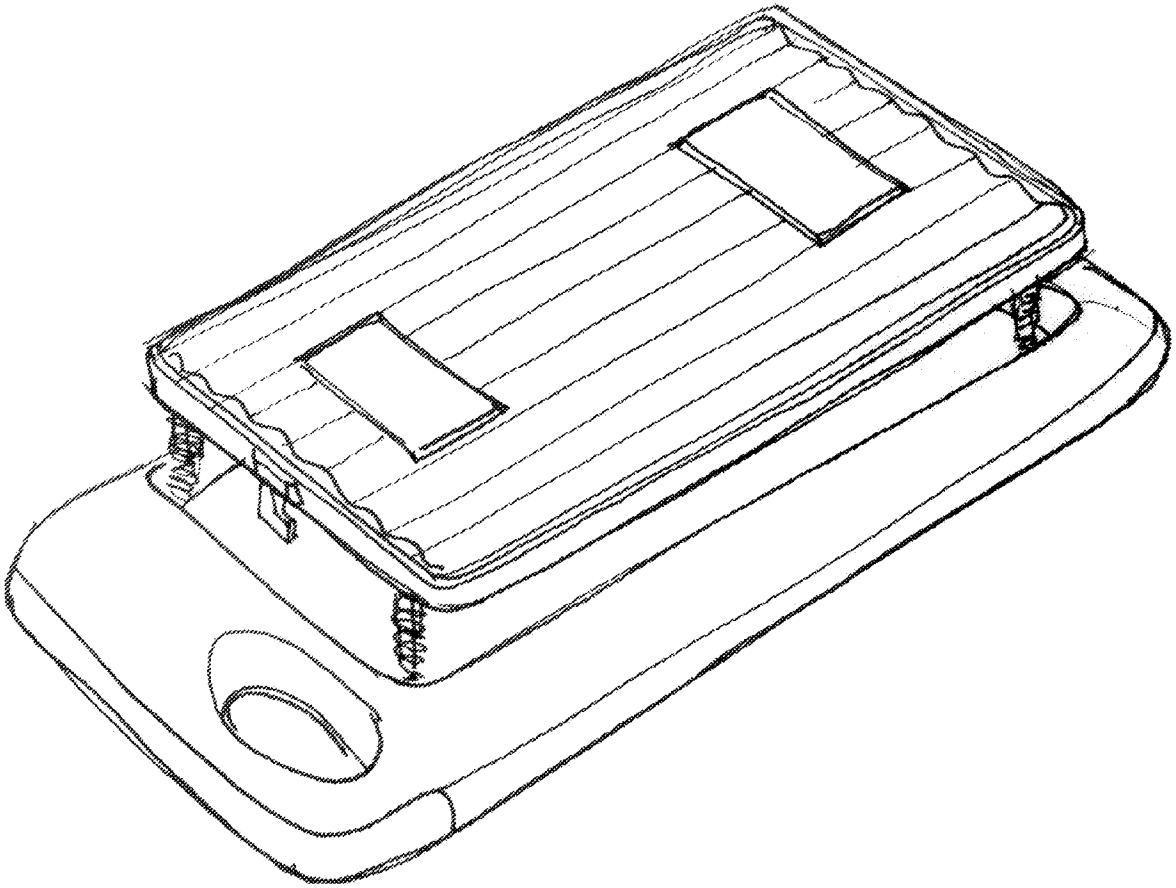

FIGS. 39 and 40 show an example of a speaker panel frame assembly in the closed position (see FIG. 39) which is then pressed and rises vertically into the open position (see FIG. 40) on a mechanism and can be returned to the closed position (see FIG. 39) by pressing the speaker panel vertically down into the housing.

A speaker device may be provided including a speaker panel frame assembly in which a baffle configuration is attached to the speaker panel frame assembly. A speaker device may be provided including a speaker panel in which a baffle configuration is attached to a speaker panel. The baffle configurations provide acoustic baffling to the speaker panel in the open position and are collapsible when the speaker panel and or speaker panel frame assembly is in the closed position.

Figure 44:
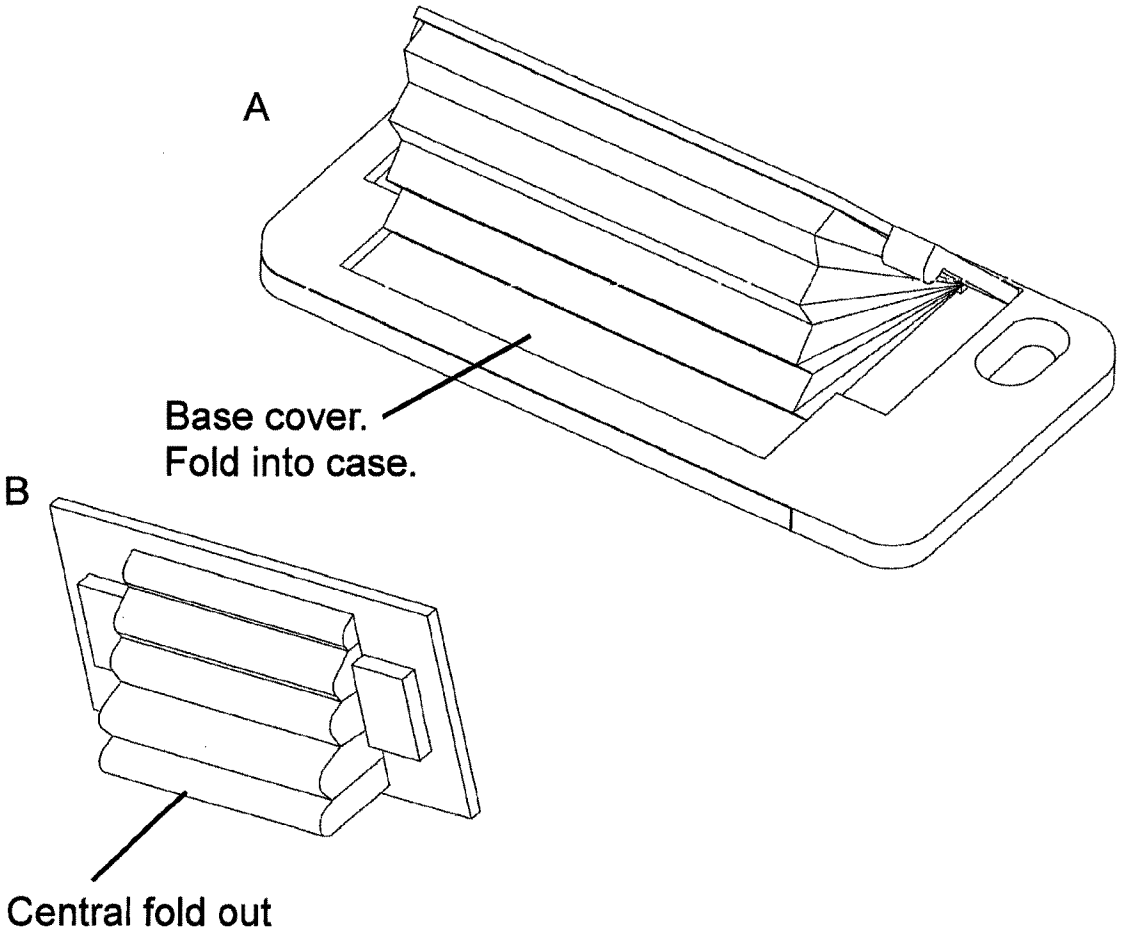
FIG. 44 shows (A) an example of a baffle configuration that is attached to a speaker panel frame assembly, and (B) an example of a baffle configuration that is attached to a speaker panel. The baffle configurations provide acoustic baffling to the speaker panel in the open position and are collapsible when the speaker panel and or speaker panel frame assembly is in the closed position.

FIG. 44 shows (A) an example of a baffle configuration that is attached to a speaker panel frame assembly, and (B) an example of a baffle configuration that is attached to a speaker panel. The baffle configurations provide acoustic baffling to the speaker panel in the open position and are collapsible when the speaker panel and or speaker panel frame assembly is in the closed position.

Concept 2—Left/Right Actuated (eg. DMA) Speaker Boost

In an example, a speaker boost may be split into two parts which creates left and right audio channels providing stereo effect/performance. Panels can open from a centre outward or from edges inwards towards the centre, for example. Panels can be various shapes eg. Rectangles, Squares, Circular, Triangular etc.

Panels may be mounted on hinges. A release mechanism may be provided. When released, two panels may pop up. When released, the two panels may move from a closed configuration to an open configuration. The case may clip around a mobile device.

Figure 11:
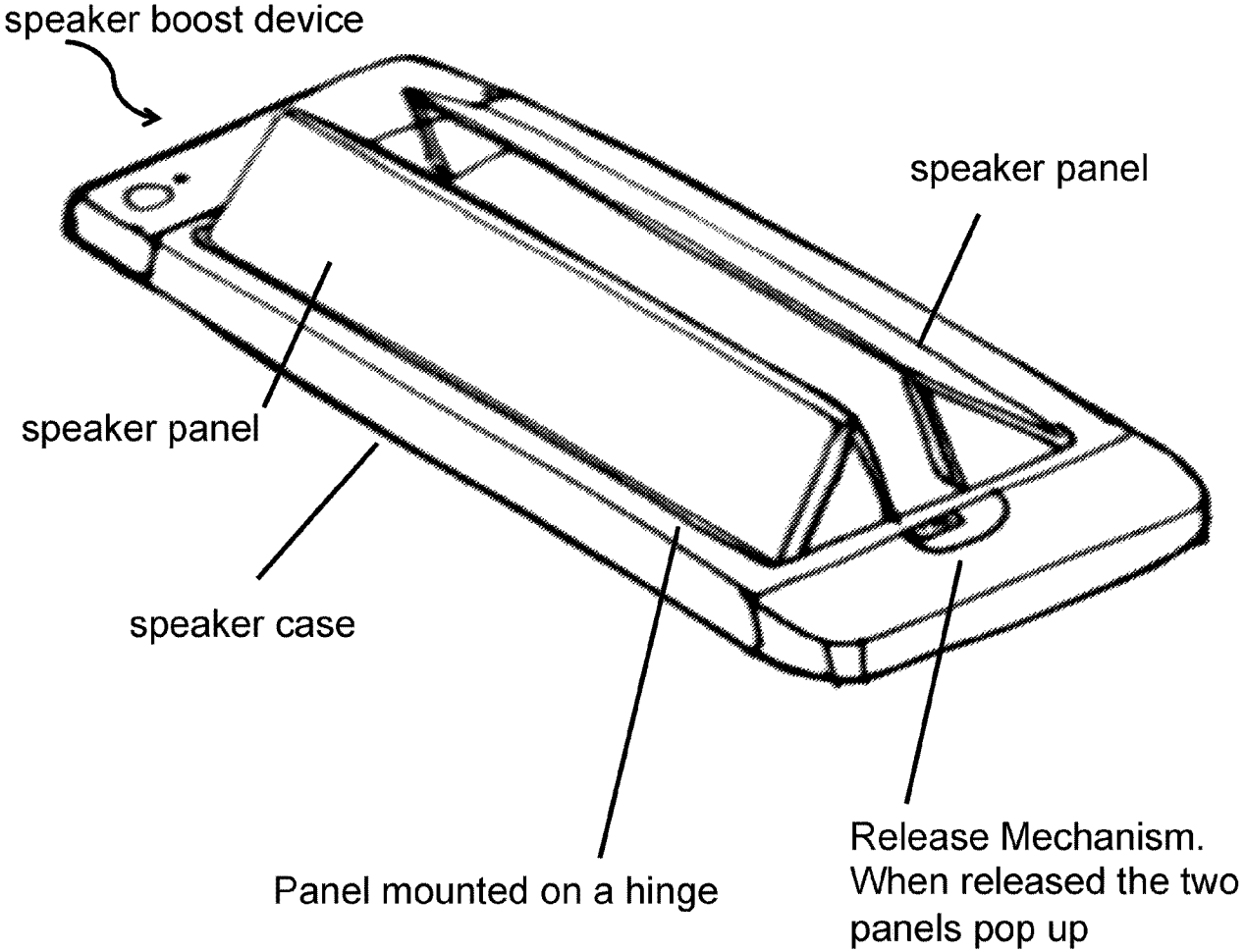
FIG. 11 shows an example of a speaker boost which is split into two parts.

FIG. 11 shows an example of a speaker boost which is split into two parts. A release mechanism is provided. When released, the two panels pop up. The two speaker panels are shown in an open configuration.

Figure 12:
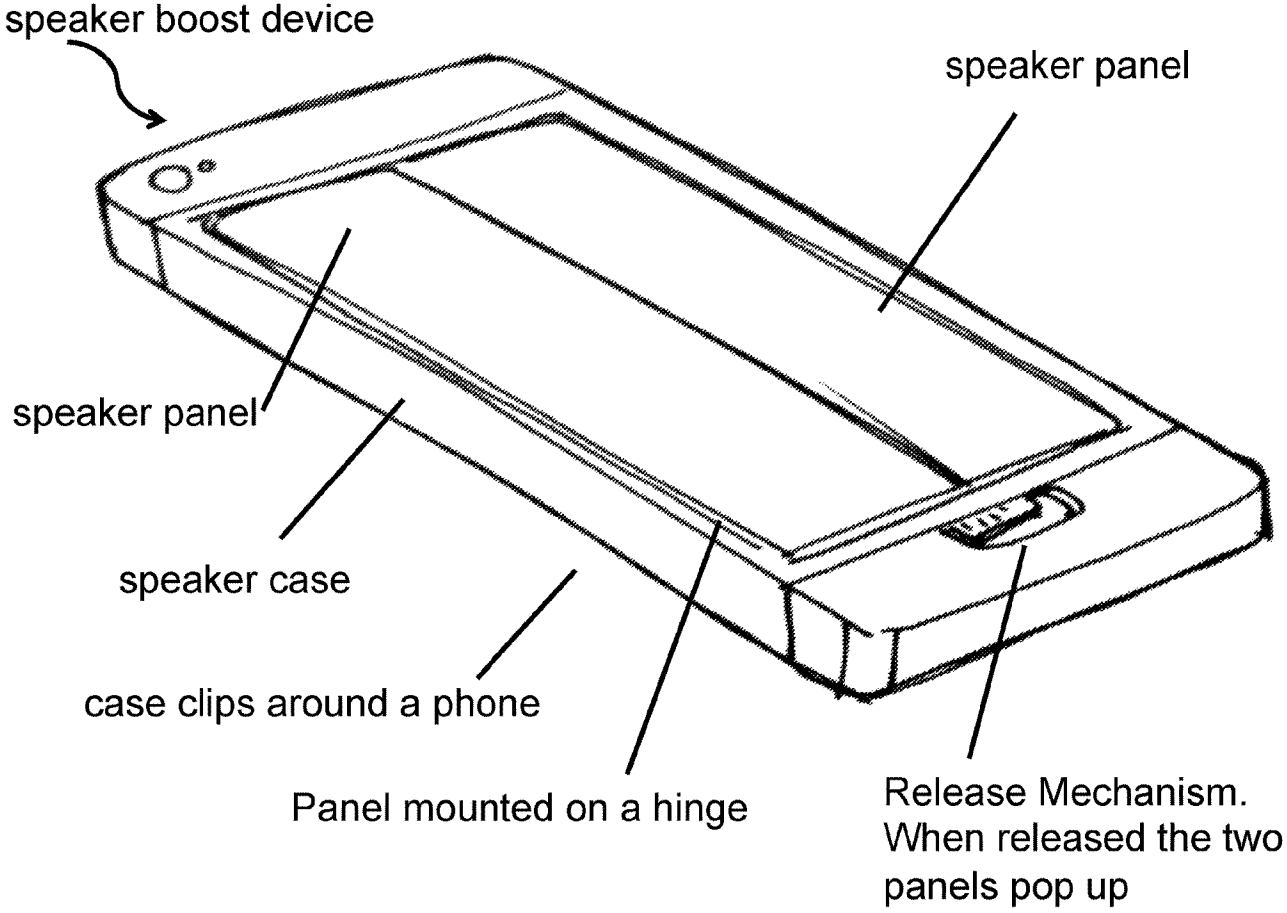
FIG. 12 shows an example of a speaker boost which is split into two parts.

FIG. 12 shows an example of a speaker boost which is split into two parts. A release mechanism is provided. When released, the two panels pop up. The two speaker panels are shown in a closed configuration.

Panels and actuators (eg. DMA's) can be mounted as described above, in concept 1.

In a further example, a speaker boost may be split into two parts which creates left and right audio channels providing stereo effect/performance. The panels may be overlaid on top of one another which creates left and right audio channels, providing stereo performance. Panels can be various shapes eg. circular or triangular or other shapes. Panels and actuators (eg. DMA's) can be mounted as described above, in concept 1.

In a further example, a speaker boost may be split into two parts which creates left and right audio channels providing stereo effect/performance. The panels may articulate north to south (instead of east-west, as shown for example in FIG. 11 and FIG. 12) either as a split design with half the space per panel, or as an overlaid design. Panels can be various shapes eg. Rectangle, Square, Circular, Triangular etc. Panels and actuators (eg. DMA's) can be mounted as described above, in concept 1.

Concept 3—Ruggedized Actuated (Eg. DMA) Speaker Boost

Figure 13:
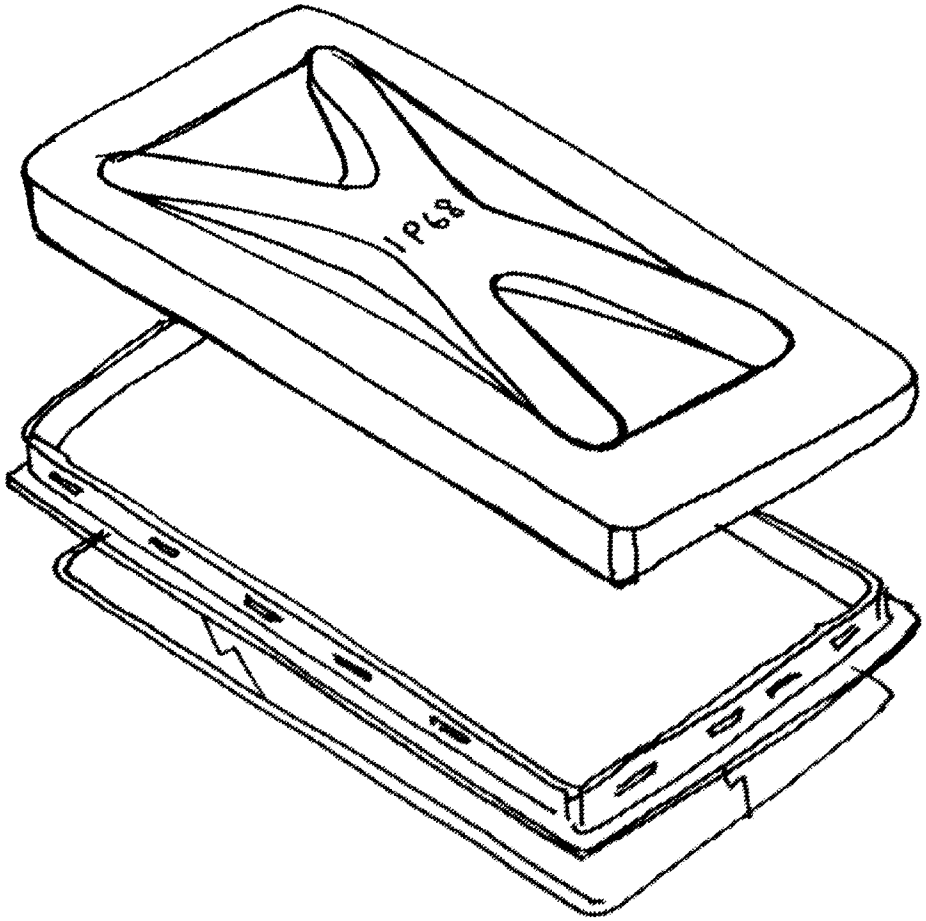
FIG. 13 shows an example of a ruggedized, rubber sealed case in a speaker boost example.

The concept architecture of concepts 1 or 2 may be made into a ruggedized variant that will provide good speaker device (eg. phone) performance. The speaker boost may allow the product to stand up allowing loud conference call modes, and use in loud/industrial environments. In a speaker boost example, a ruggedized, rubber sealed case may be provided. An example is shown in FIG. 13, which shows a ruggedized, rubber sealed case.

Concept 4—Wired Speaker Booster Plugs Directly into the Audio Jack of a Device

In an example, a wired speaker booster plugs directly into the audio jack of a device. The booster may be powered through the audio jack to enable the speaker booster to be ultra slim or the speaker booster may include its own electronics and may be connected either wirelessly or by a wire to the device. In an example, two speaker booster devices are daisy chained or connected via a wireless connection.

The speaker panel of a wired speaker booster which plugs directly into the audio jack of a device can be suspended in a frame and mounted eg. as per concept 1. The two speaker panels of a wired speaker booster which plugs directly into the audio jack of a device can be provided eg. as per concept 2.

Figure 14:
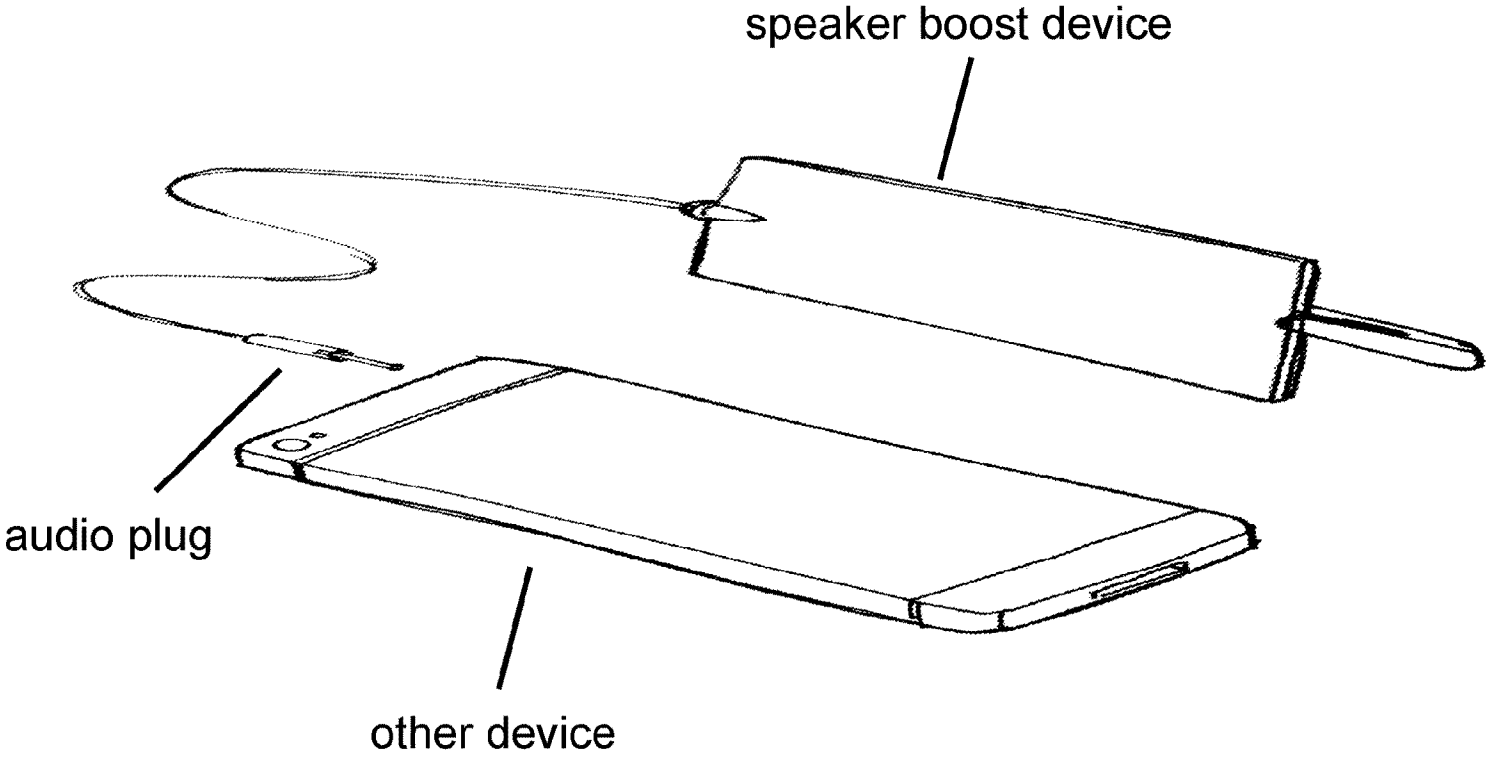
FIG. 14 shows an example of a wired speaker booster which plugs directly into the audio jack of another device.

An example of a wired speaker booster device which plugs directly into the audio jack of another device is shown in FIG. 14.

Concept 5—Wireless Speaker Booster

In an example, a wireless speaker booster may connect to a device via Bluetooth and/or WiFi, or other current or future wireless method. The wireless speaker booster may be ultra slim and it may include a battery to satisfy power requirements. In an example, a wireless speaker booster may provide a speaker and power booster for phones. In an example, a hinged version may allow the speaker panel(s) to be directed; the speaker panel(s) may be mounted as per concepts 1 or 2.

Figure 15:
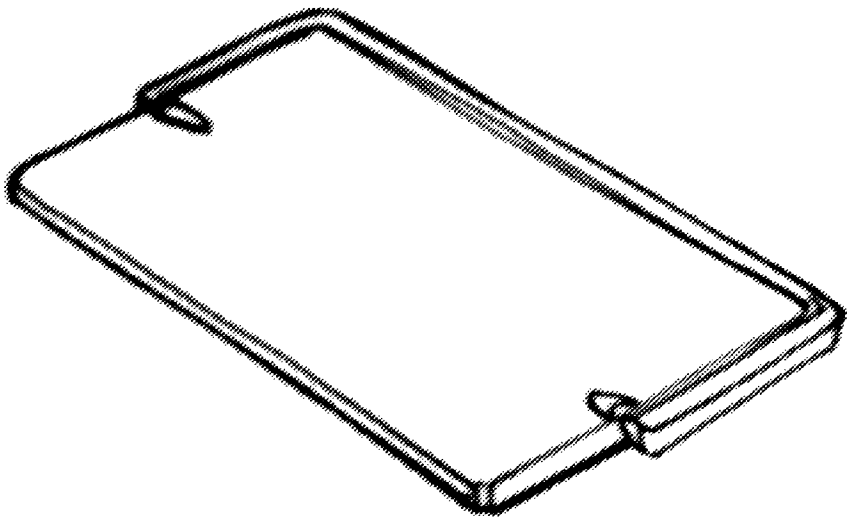
FIG. 15 shows an example of a wireless speaker booster, in a flat configuration.

FIG. 15 shows an example of a wireless speaker booster, in a flat configuration.

Figure 16:
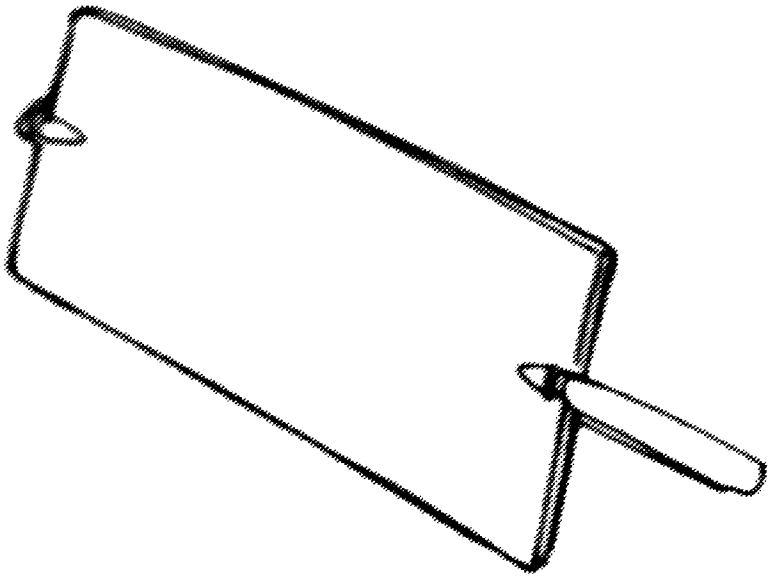
FIG. 16 shows an example of a wireless speaker booster, in an upright configuration.

FIG. 16 shows an example of a wireless speaker booster, in an upright configuration.

Figure 17:
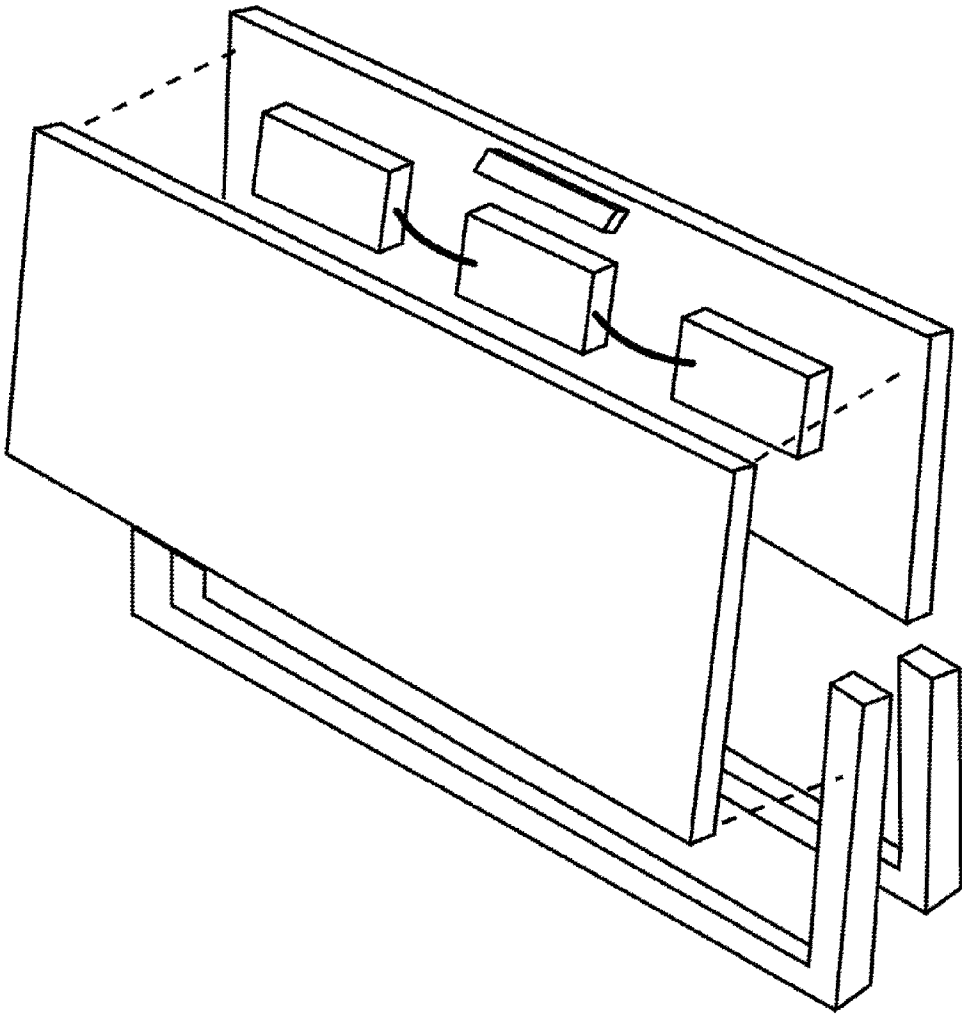
FIG. 17 shows an exploded view of an example of a wireless speaker booster.

FIG. 17 shows an exploded view of an example of a wireless speaker booster.

Concept 6—Actuated (Eg. DMA) Activated Back Cover

The actuators (eg. DMA's) may be mounted to a back cover of a portable device, enabling a rear case of a portable device to become the speaker where the panel does not articulate—reducing cost, allowing thinner products and increasing the sound output. This may be applied for a device, or for a speaker boost device. The concept can also be provided as an accessory.

The actuators (eg. DMA's) may be mounted to a back cover of a portable device, enabling the rear case of a portable device to become the speaker where the panel has an articulating hinge design added to allow the panel to move in free space (eg. as in concept 1 or in concept 2)—reducing cost, allowing thinner products and increasing the sound output. This may be applied for a device, or for a speaker boost device. The concept can also be provided as an accessory.

Figure 18:
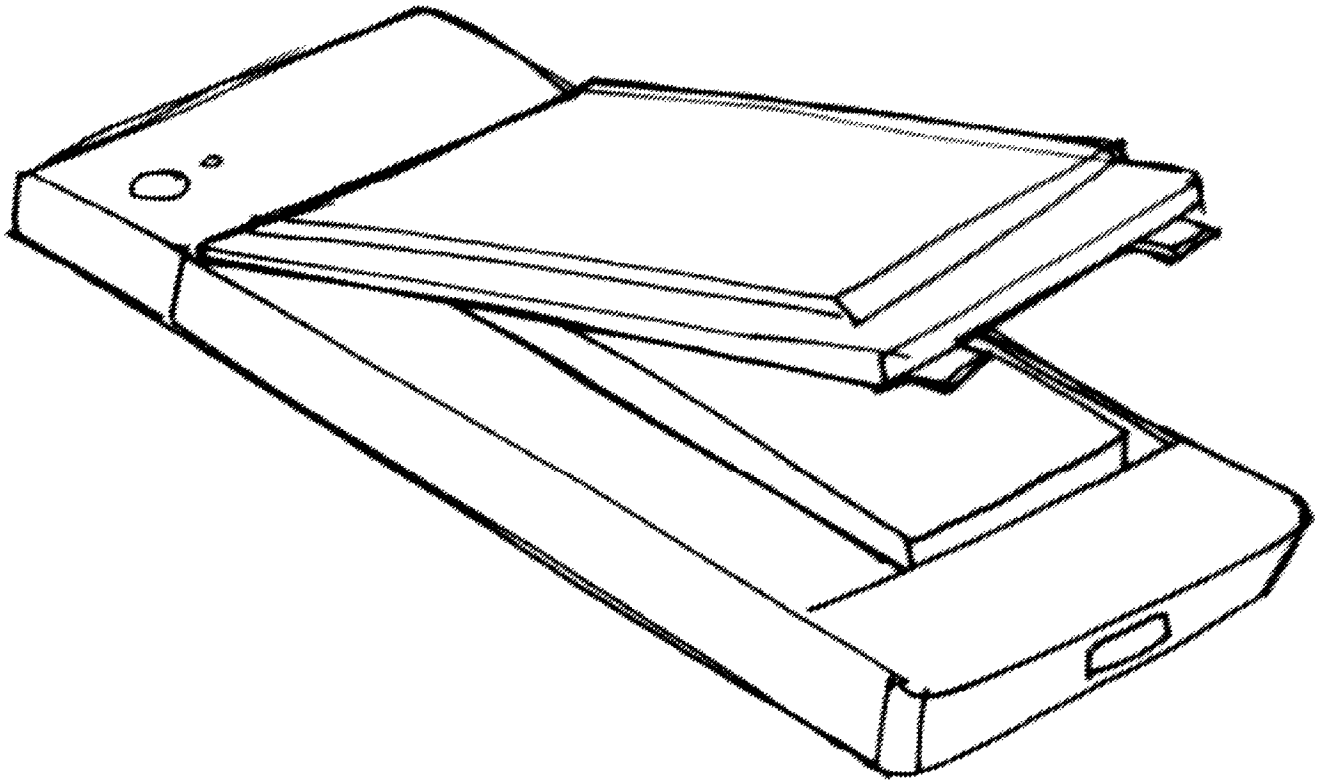
FIG. 18 shows an example in which actuators (eg. DMA's) are mounted to a back cover of a portable device.

FIG. 18 shows an example in which actuators (eg. DMA's) are mounted to the back cover of a portable device, enabling the back cover to become the speaker where the panel has an articulating hinge design added to allow the panel to move in free space.

Figure 19:
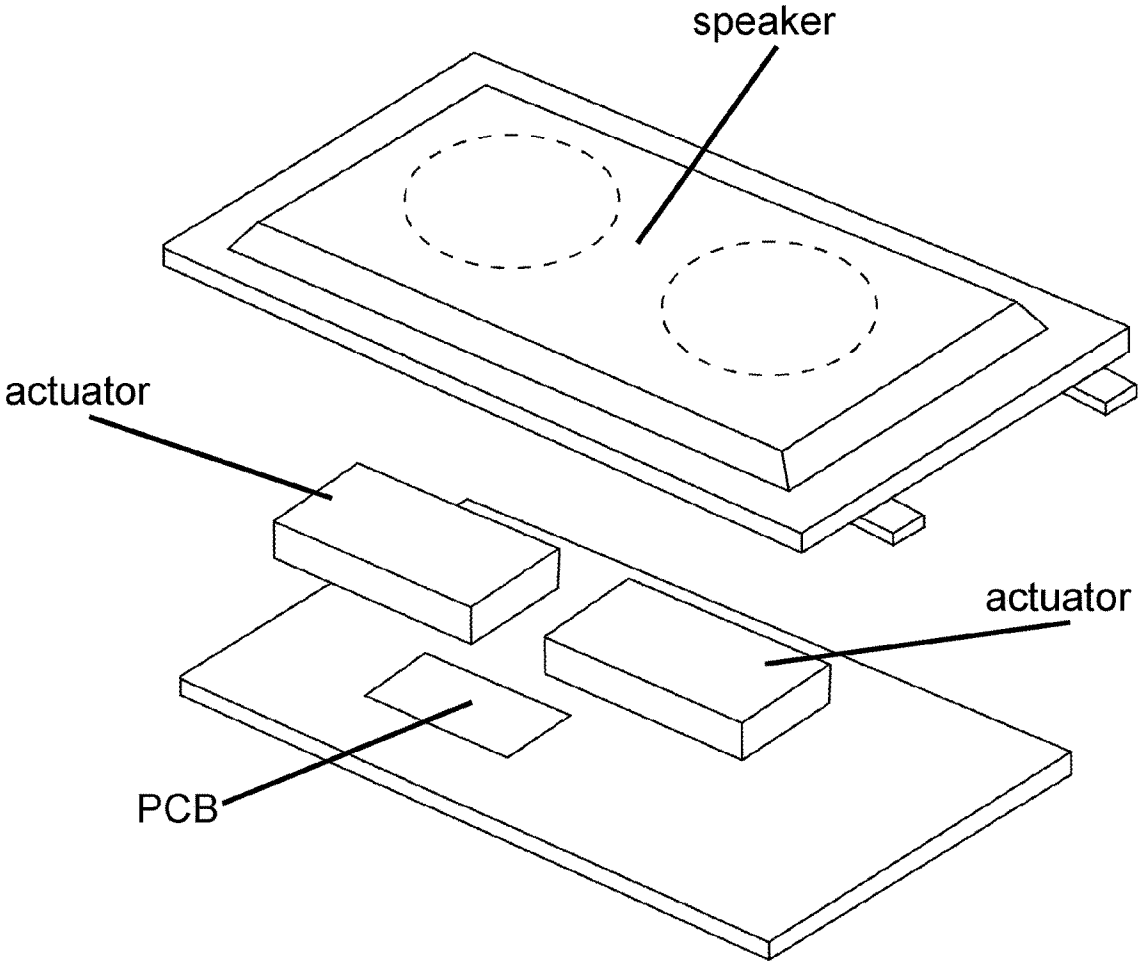
FIG. 19 shows an exploded diagram of an example in which actuators (eg. DMA's) are mounted to the back cover of a portable device, enabling the rear case to become the speaker.

FIG. 19 shows an exploded diagram of an example in which actuators (eg. DMA's) are mounted to the back cover of a portable device, enabling the rear case to become the speaker.

Figure 54:
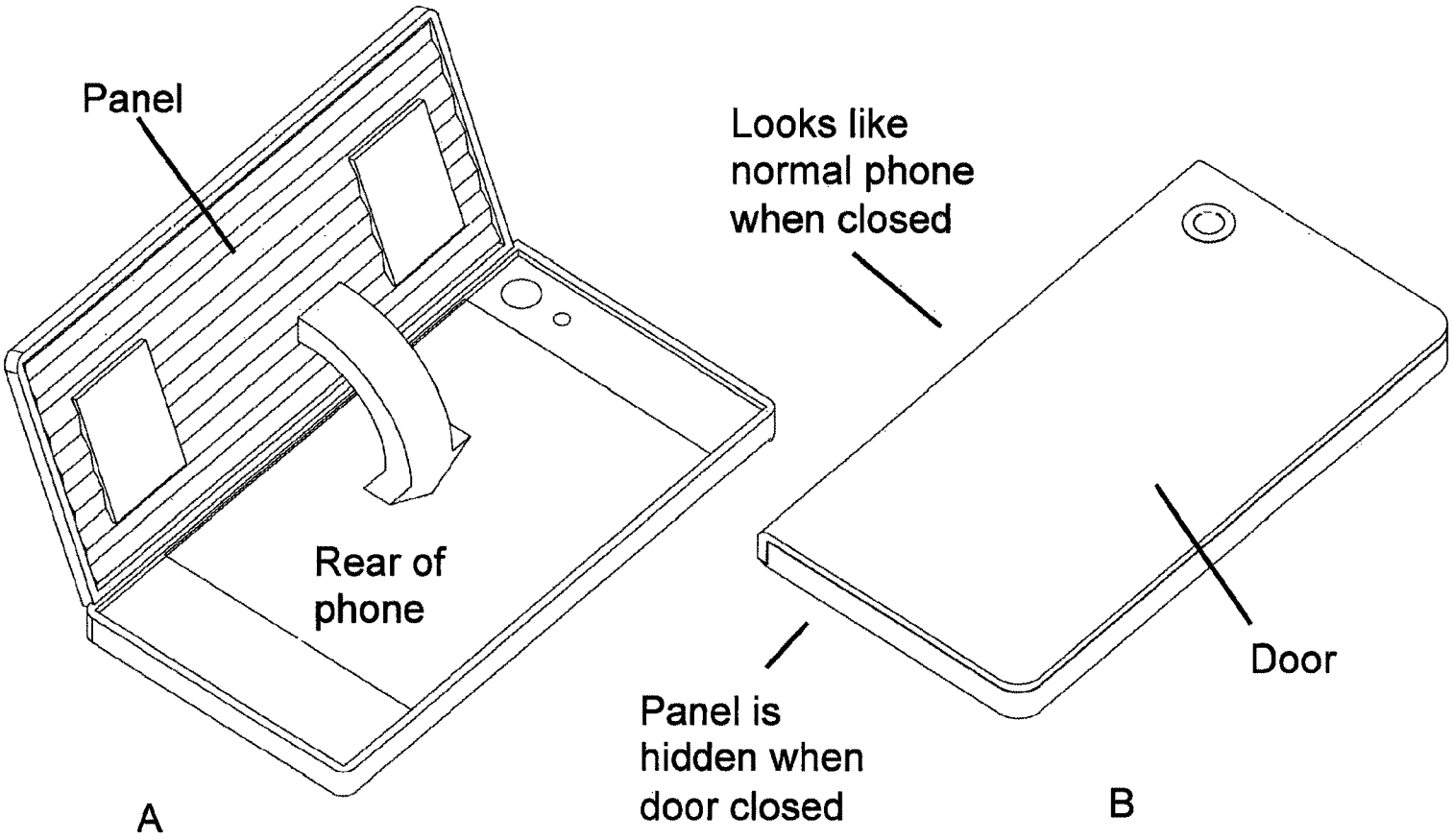
FIG. 54 shows examples of a speaker device with a speaker panel integrated into a rear case door of the speaker device, enabling the speaker device rear case door to become a speaker.

In a closed configuration of a speaker device, a back cover of the speaker device may cover a back face of a device, or of a device received within the speaker device, with a speaker panel not being visible in the closed configuration. An example is shown in FIG. 54(B). In an open configuration of a speaker device, a case (eg. a door) may open to reveal a back face of a device, or of a device received within the speaker device, and also to reveal a speaker panel in the case (eg. the door). An example is shown in FIG. 54(A).

The speaker device cover may be one wherein the speaker panel assembly includes a Push Push or other release mechanism attached to a frame wherein the panel is mounted in the frame and frame is suspended on springs or other mounting method into the cover, and an advantage of this system is that the panel size can be made larger as it requires no hinges and therefore the panel size can be increased relative to the device size. A "push push" mechanism is one in which a user can push the speaker panel to release the assembly, and a user can provide a further push to the speaker panel to return the assembly. The speaker panel and or speaker panel frame assembly may also be released and retained by a latch.

Concept 7—Integrated into Device Rear Case

Actuators (eg. DMA's), and or actuator frame or hinges, and a panel may be mounted or integrated into a rear case of a device enabling the device rear case to become the speaker—reducing cost, allowing thinner products and increasing the sound output/quality of sound of the device. Designs may be as per concepts 1, 2, 3, 6, 8, 9, 10, 11, or concepts as shown in any of FIG. 37, 38, 39, 40, 41, 42, 43, 44, 52 or 54.

The speaker device case may be one wherein the speaker panel assembly includes a Push Push or other release mechanism attached to a frame wherein the panel is mounted in the frame and frame is suspended on springs or other mounting method into the case or into the device, and an advantage of this system is that the panel size can be made larger as it requires no hinges and therefore the panel size can be increased relative to the device size. A "push push" mechanism is one in which a user can push the speaker panel to release the assembly, and a user can provide a further push to the speaker panel to return the assembly. The speaker panel and or speaker panel frame assembly may also be released and retained by a latch.

Figure 1:
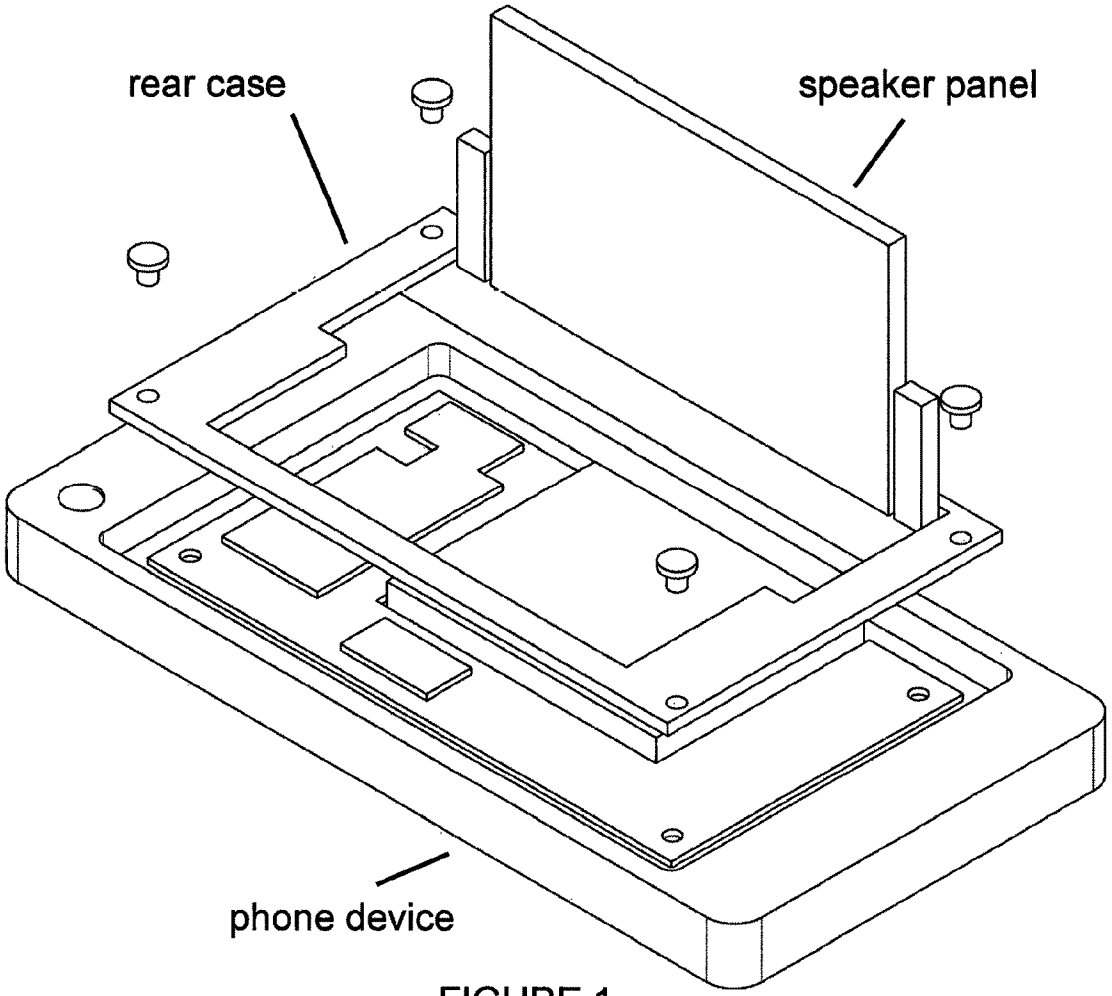
FIG. 1 shows an exploded diagram of an example in which actuators are integrated into a rear case of a device, enabling the device rear case to become a speaker.

FIG. 1 shows an exploded diagram of an example in which actuators are integrated into a rear case of a device, enabling the device rear case to become a speaker.

A speaker device may be one in which the speaker device rear case includes a speaker panel assembly movable between an open configuration and a closed configuration. The speaker device may include a battery, which may be removable or non-removable. The speaker panel of the speaker panel assembly may include an aperture. The aperture size may be approximately the same size as the battery, so that the speaker panel fits around the battery in the closed configuration in a compact arrangement.

In an alternative arrangement, a speaker device is one in which the speaker device rear case includes a speaker panel assembly movable between an open configuration and a closed configuration, and the speaker panel assembly houses the speaker device battery.

In an example of a speaker device in which the speaker device rear case includes a speaker panel assembly movable between an open configuration and a closed configuration, the speaker device includes a removable battery, and the speaker panel of the speaker panel assembly includes an aperture, and the aperture size is approximately the same size as the removable battery, so that the speaker panel fits around the battery in the closed configuration in a compact arrangement. An example of a closed configuration is shown in FIG. 52(A). An example of an open configuration is shown in FIG. 52(B).

Concept 8-360 Degree Rotatable Speaker Boost Panel

In an example, a speaker boost is configured such that a speaker boost panel is rotatable through 360 degrees when the speaker boost is in an open configuration. This arrangement may be utilized in conjunction with concepts such as concepts 1, 2, 4, 7, 9, 10, 11, or concepts as shown in any of FIG. 37, 38, 41, 42, 43, 44(A) or 52. Such a configuration allows for branding or customisation opportunities on both the back and front side of the speaker panel. When the speaker boost is in a closed configuration, either side of the speaker panel may be displayed.

Figure 20:
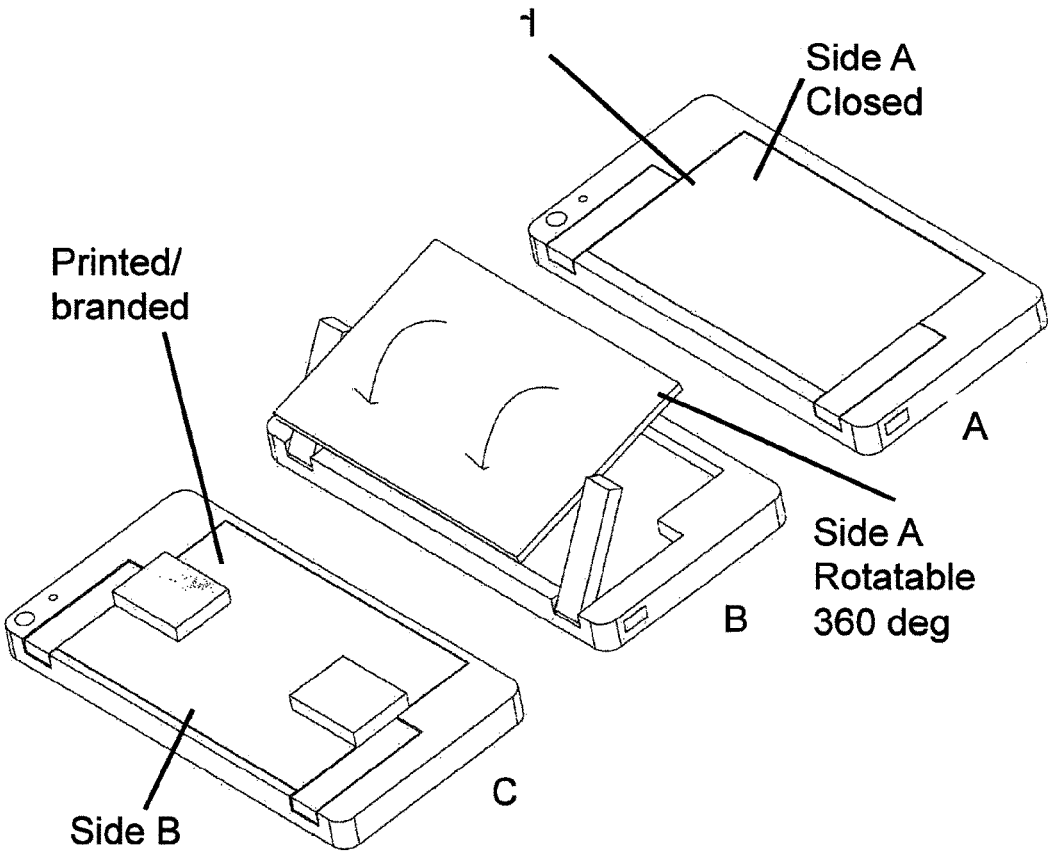
FIG. 20 shows example configurations of a speaker boost example.

In FIG. 20, in A, an example of a speaker boost is shown in a closed configuration, with side A of the speaker panel being exposed to the outside. In FIG. 20, in B, the speaker boost is shown in an open configuration, with side A of the speaker panel being visible from above. In the open configuration, the speaker panel is rotatable through 360 degrees, as shown. In FIG. 20, in C, the speaker boost is shown in a closed configuration, with side B of the speaker panel being exposed to the outside.

Concept 9—Dual Panels

In an example, a speaker boost is provided in which dual panels are foldable one on top of the other, or each on top of the other, to create larger panels and enhance the sound. This concept may be used together with concepts such as concepts 1, 2, 4, 7, 10, 11 or concepts shown in any of FIGS. 37, 38, 39, 40, 41, 42, 43, 44. In an example, the panels fold neatly away on top of each other and can be various shapes eg. Rectangular, Square, Circular, Triangular etc.

Figure 21:
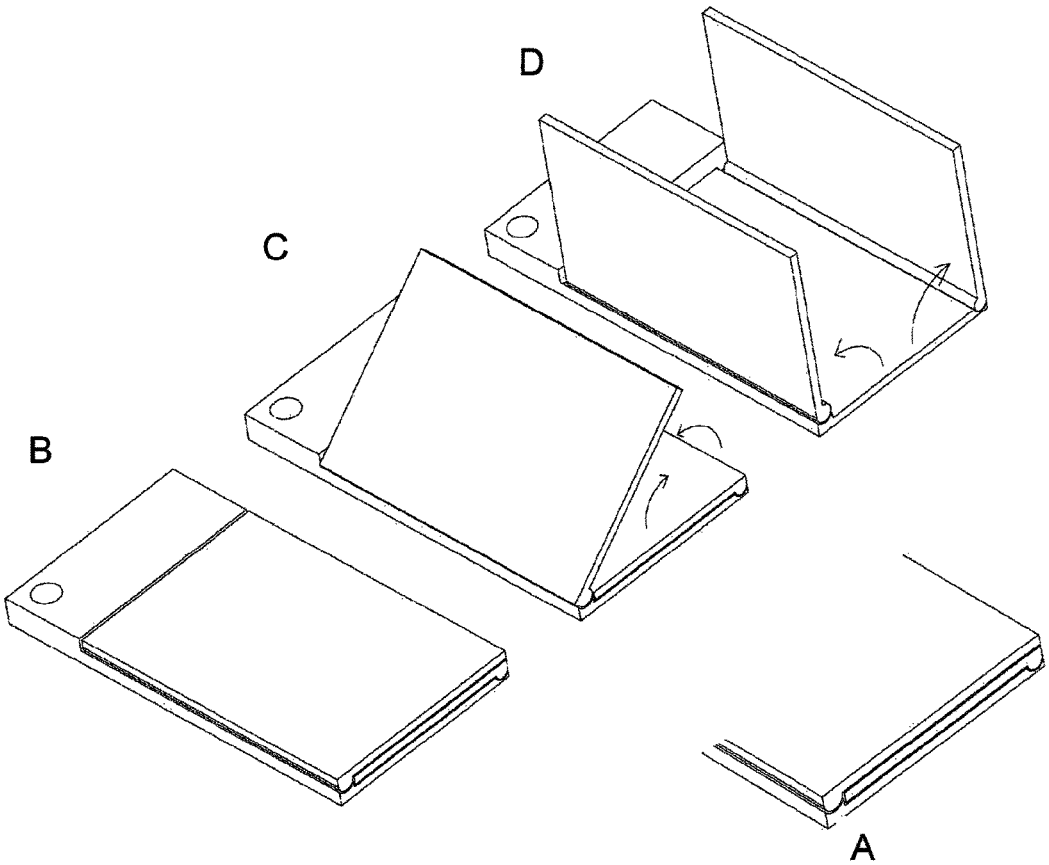
FIG. 21 shows example configurations of a speaker boost example.

In FIG. 21, in A, an example of part of a speaker boost is shown in a side perspective view, in a closed configuration, with both of the dual panels folded closed. In FIG. 21, in B, an example of a speaker boost is shown in an above, perspective view, in a closed configuration, with both of the dual panels folded closed. In FIG. 21, in C, an example of a speaker boost is shown in a perspective view, in a partly open configuration, with one of the dual panels open, and the other of the panels closed. In FIG. 21, in D, an example of a speaker boost is shown in a perspective view, in an open configuration, with both of the dual panels open.

Concept 10—Two Panels of Different Sizes

In an example, a speaker device is provided in which two speaker actuated (eg. DMA) panels are used, in which one is larger than the other such that each creates a different sound form to the other eg a bass panel and a tweeter panel. The two panels may also create a stereo effect. Each panel can be mounted eg. as per previous concepts. Panels can be different shapes. This concept may be used together with any of concepts 1, 2, 4, 7, 9, 11, or concepts shown in any of FIGS. 33, 34, 35, 36, 37, 38, 39, 40, 41, 42, 43, 44.

Figure 22:
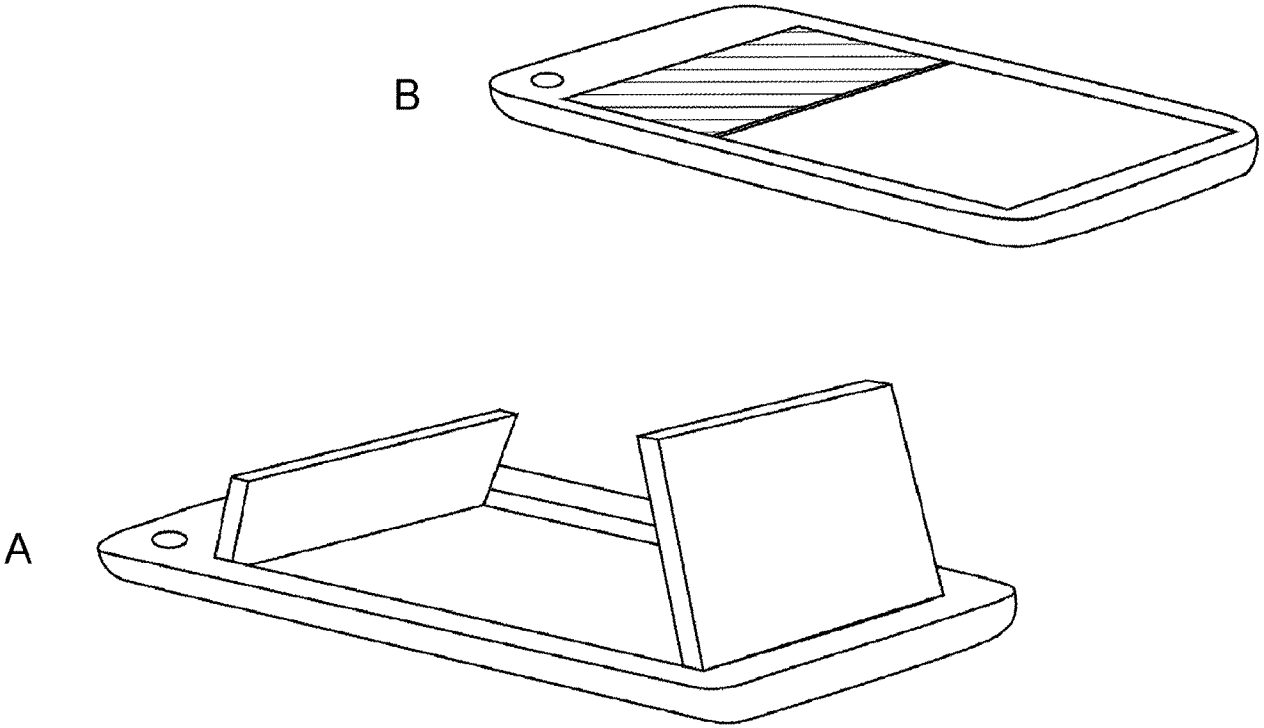
FIG. 22 shows example configurations of a speaker boost example.

In FIG. 22, in A, an example of a speaker boost is shown in a perspective view, in an open configuration, with both of the differently sized panels open. In FIG. 22, in B, an example of a speaker boost is shown in a perspective view, in a closed configuration, with both of the differently sized panels closed.

Concept 11—Two Panels Fold Out from the Edges

In an example, a speaker boost is provided in which two actuated (eg. DMA) speaker panels are foldable out from the edges (eg. the longer edges) of the product. This may create a stereo sound. The panels can be mounted eg. as per previous concepts. The panels can be various shapes. The panels may be mounted on a frame or on hinges eg. as per concept 1.

Figure 23:
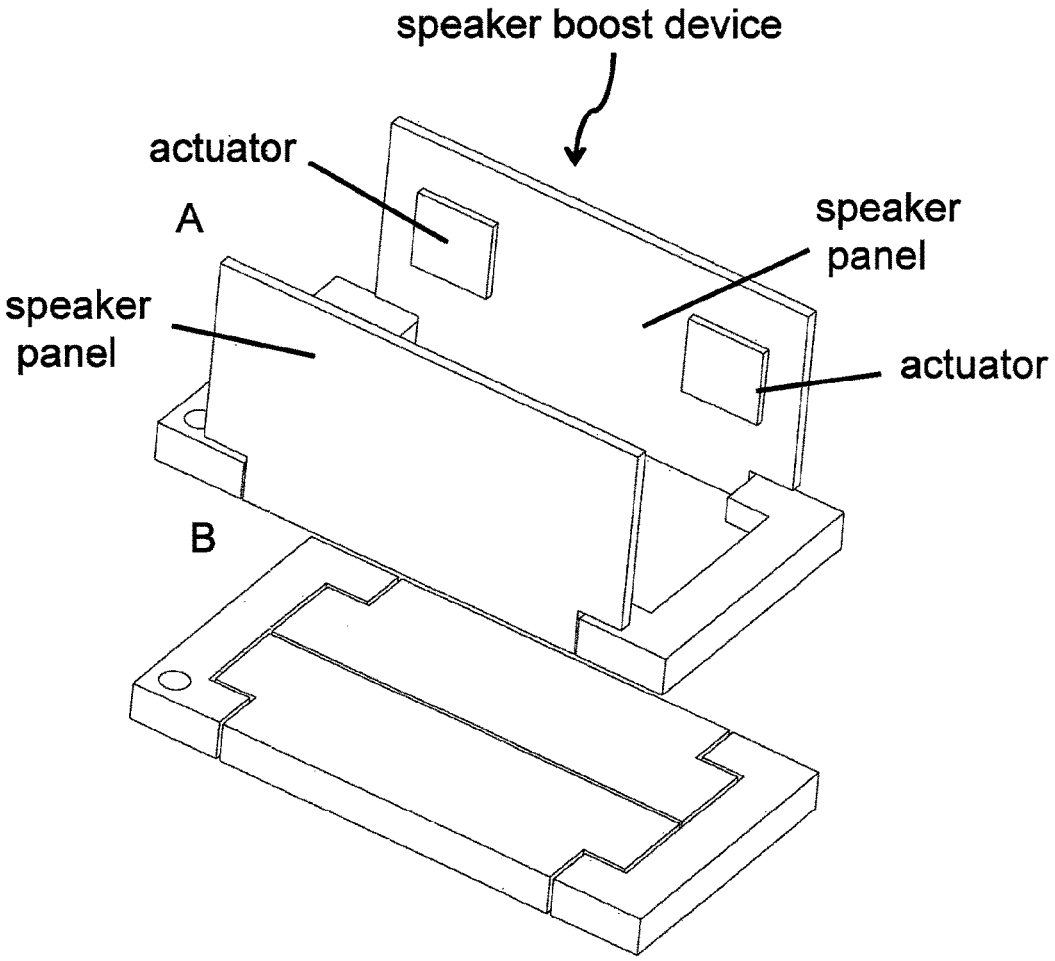
FIG. 23 shows example configurations of a speaker boost example.

In FIG. 23, in A, an example of a speaker boost is shown in a perspective view, in an open configuration, with both of the panels open, in which the panels open from the longer edges of the product. In FIG. 23, in B, an example of a speaker boost is shown in a perspective view, in a closed configuration, with both of the panels closed, in which the panels close from the longer edges of the product.

Concept 12—Removable Speaker Panel

In an example, a speaker boost is provided in which the central speaker panel is removable eg. from the hinges. The panel may have two spring loaded pins that are located in a hinge arm and which create a connection to the base cover. This may enable a user to change the speaker panel, such as if they want to change the color or design of the panel. A hinge pin may create a connection to the base cover. Note: a connection to the base cover may also be achieved with "C" clips or with other retention systems such as Magnets.

Figure 24:
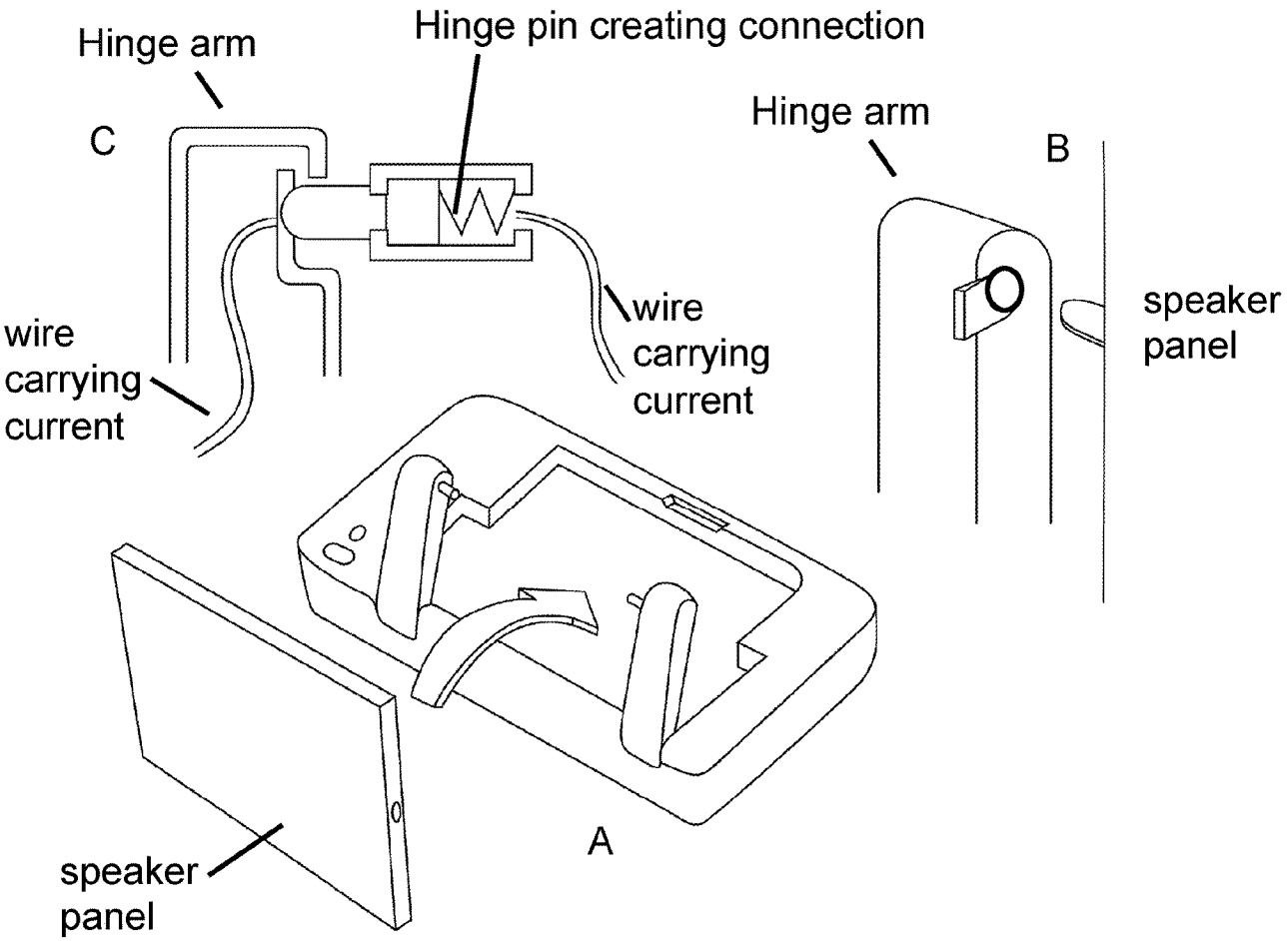
FIG. 24 shows in A, an example of a speaker boost in a perspective view, in a configuration in which the hinge arms of the speaker boost are operable to receive a speaker panel; in B, an example of part of a hinge arm of a speaker boost in a perspective view, in a configuration in which the hinge arm of the speaker boost is operable to receive a speaker panel; in C, an example of part of a hinge arm of a speaker boost in a cross sectional view, in a configuration in which the hinge arm of the speaker boost has received a speaker panel such as to create an electrical connection.

In FIG. 24, in A, an example of a speaker boost is shown in a perspective view, in a configuration in which the hinge arms of the speaker boost are operable to receive a speaker panel. In FIG. 24, in B, an example of part of a hinge arm of a speaker boost is shown in a perspective view, in a configuration in which the hinge arm of the speaker boost is operable to receive a speaker panel. In FIG. 24, in C, an example of part of a hinge arm of a speaker boost is shown in a cross sectional view, in a configuration in which the hinge arm of the speaker boost has received a speaker panel such as to create an electrical connection.

In an example, a speaker boost is provided in which the speaker panel is removable from an actuator frame. The speaker panel may be attached to actuators and the actuators may be attached by a fixing system (eg. by clips or by magnets) to the frame. The speaker panel may be removed by the user to allow the panel to be replaced or changed eg. for a panel incorporating another colour/design, or for an upgraded panel with improved acoustic properties. This can be used with most of the other concepts.

Concept 13—Panel Hinges from the Base of the Device

In an example, a speaker boost device is provided in which the actuated (eg. DMA) panel hinges from the base (eg. a shorter edge) of the device. This may allow the product to stand up vertically. The panel may be mounted directly on hinges or in an actuator frame eg. as per concept 1.

Figure 26:
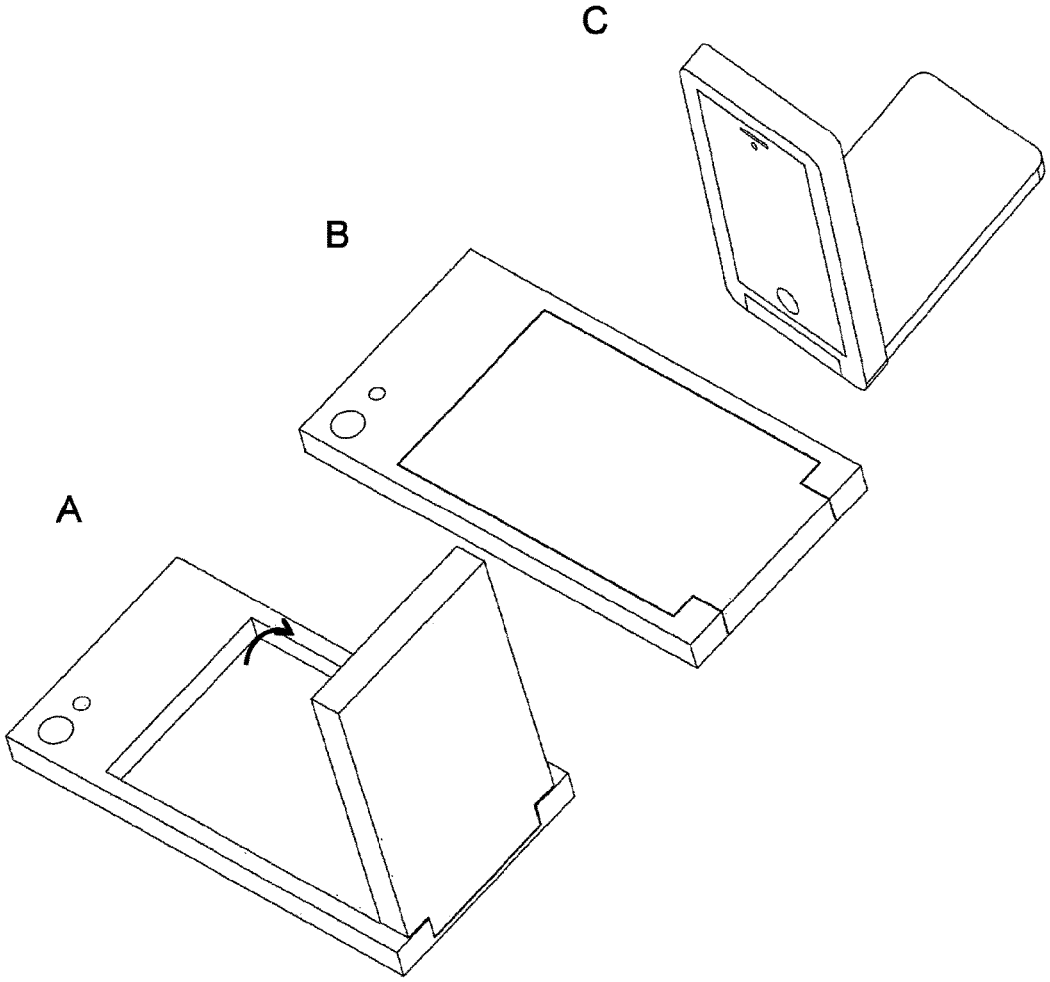
FIG. 26 shows example configurations of a speaker boost example.

In FIG. 26, in A, an example of a speaker boost is shown in a perspective view, in an open configuration, with the speaker panel open, in which the panel hinges from a base (eg. a shorter edge) of the product. In FIG. 26, in B, an example of a speaker boost is shown in a perspective view, in a closed configuration, with the speaker panel closed, in which the panel hinges from a base (eg. a shorter edge) of the product. In FIG. 26, in C, an example of a speaker boost is shown in a perspective view, in an open configuration, with the speaker panel open, in which the panel hinges from a base (eg. a shorter edge) of the product, and in which the open speaker panel is used as a stand for the speaker boost device. This can be used with most of the other concepts.

Concept 14—One Panel but Two Different Pieces

In an example, a speaker boost device is provided with one speaker panel which includes two different pieces of material (eg. plastic overmold with flexible rubber/material along a connecting line) to create one assembly that has two speakers: one for high frequency and the other of low frequency, for example. The speaker panel may be used together with any of concepts 1, 2, 4, 7, 9, 10 or 11 can be used with other concepts.

In an example, a speaker boost device is provided with one speaker panel which includes two pieces of different material which are connected by a flexible material (eg. plastic overmold with flexible rubber/material along a connecting line) to create one assembly that has, in effect, two speakers: one for high frequency and the other of low frequency, for example, based on different acoustic characteristics of the two different materials. The speaker panel may be used together with any of concepts 1, 2, 4, 7, 9, 10 or 11, or concepts shown in any of FIG. 33, 34, 35, 36, 37, 38, 39, 40, 41, 42, 43, 44, 52 or 54.

Figure 27:
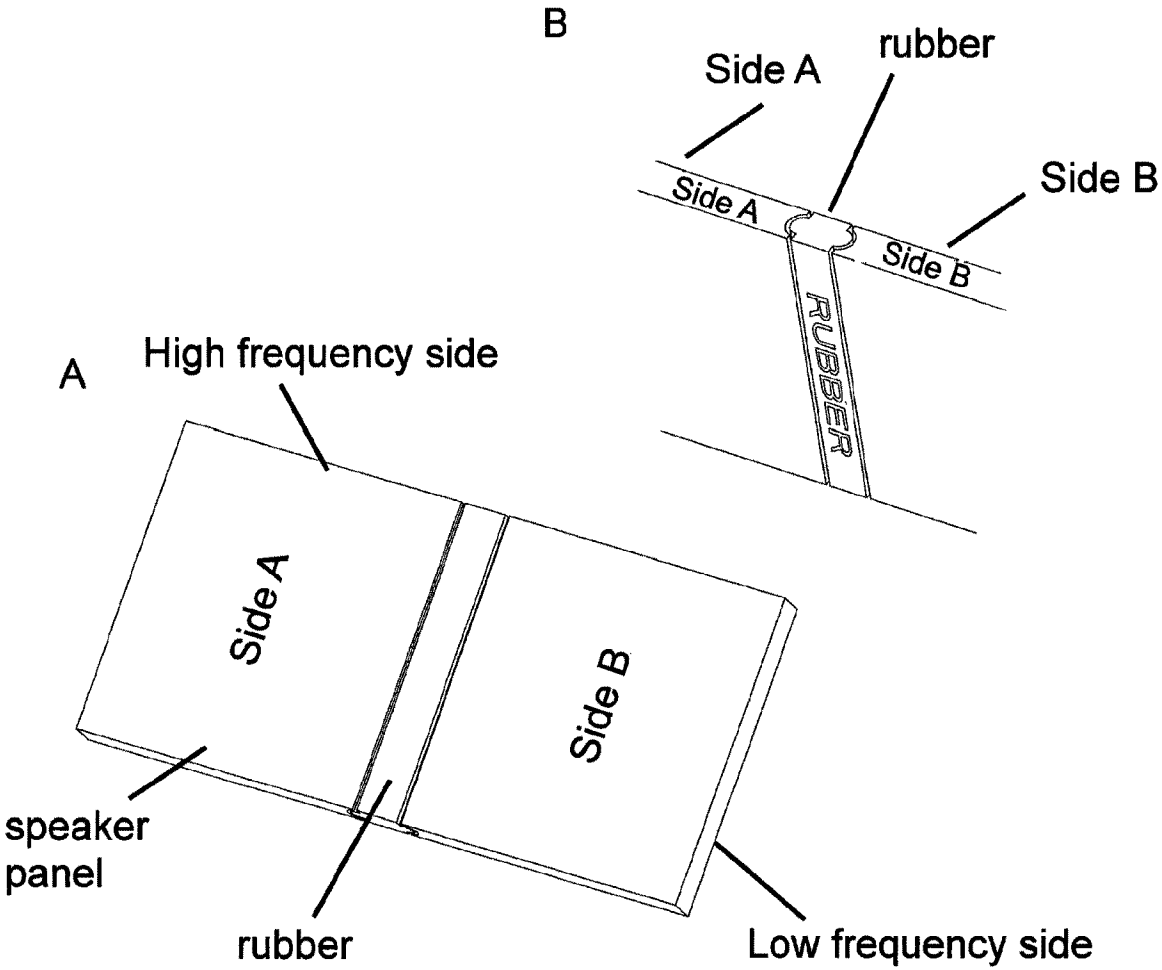
FIG. 27 shows examples of speaker panels.

In FIG. 27, in A, an example of a speaker panel is shown in plan view, in which the speaker panel includes a side A (a high frequency side) comprising a first piece of material, and a side B (a low frequency side) comprising a second piece of material, different from the first piece of material, in which sides A and B are connected by a rubber material. In FIG. 27, in B, an example of part of a speaker panel is shown in perspective view, in which the speaker panel includes a side A comprising a first piece of material, and a side B comprising a second piece of material, different from the first piece of material, in which sides A and B are connected by a rubber material.

There is provided a split design standalone speaker panel mounted in a case, that contains two speakers which can be separated and placed in different positions from one another. One speaker may be a high frequency speaker and the other speaker may be a low frequency speaker. The split design may include a design where the split between the speakers is proportionally different, in which one speaker and its housing is a different size to the other speaker and its housing.

FIGS. 33 to 36 show an example of a split speaker system in which one speaker is a high frequency speaker and the other speaker is a low frequency speaker. The split design may include a design where the split between the speakers is proportionally different, in which one speaker and its housing is a different size to the other speaker and its housing.

Concept 15—Speaker Boost with Tuned Ports in the Case

Figure 28:
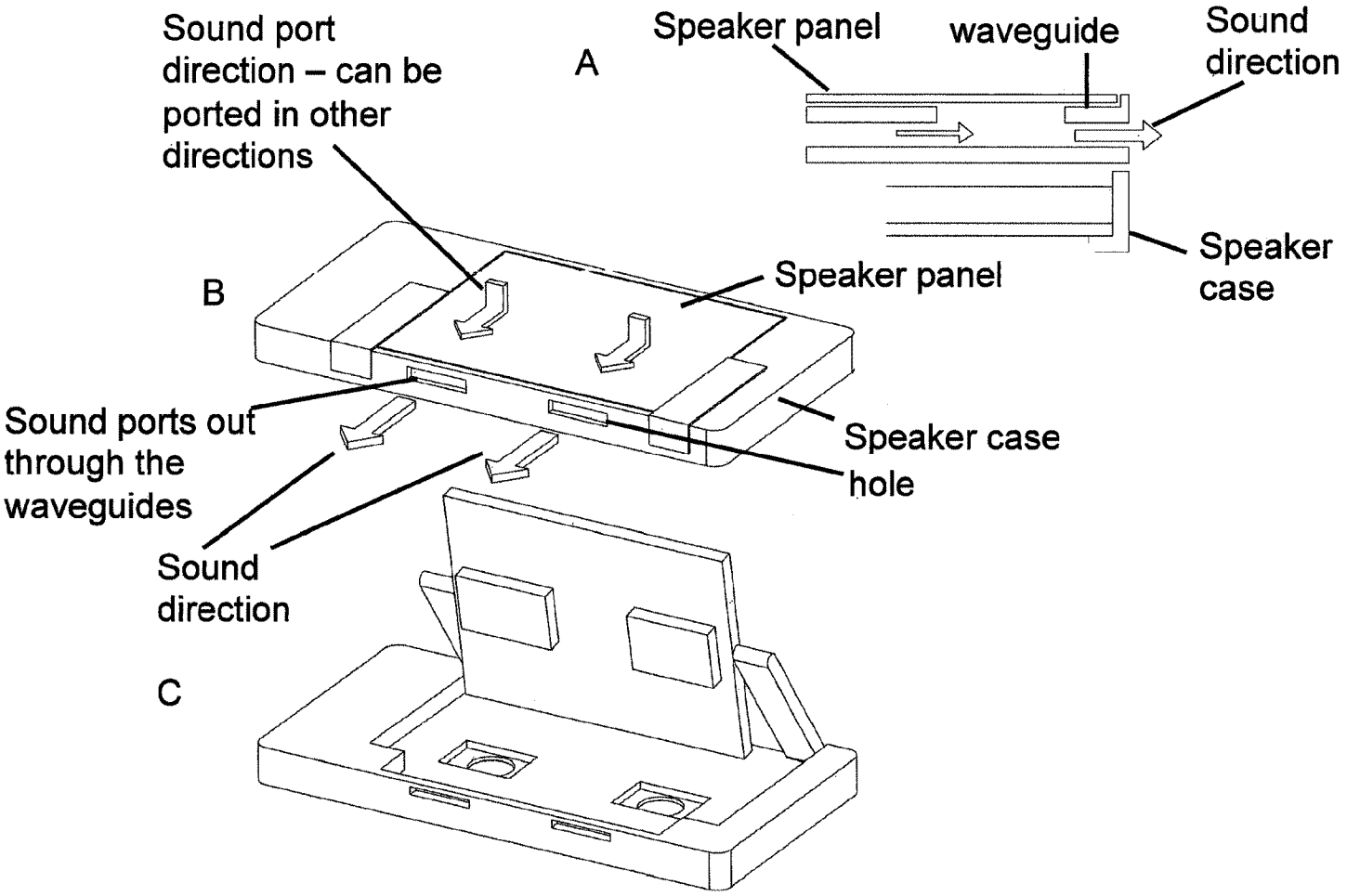
FIG. 28 shows examples of speaker panels which may port out sound through waveguides.

In an example, a speaker boost device is provided with tuned ports in the case with waveguides to optimise frequency response. Tuned ports may be under the speaker panel when it is closed, so that when the speaker panel is closed, sound ports out through waveguides in the housing to holes on the outside of the case. This concept may also be applied to an actuator frame which can be provided with tuned ports to improve panel performance, This can be used with most of the other concepts In FIG. 28, in A, part of an example of a speaker boost is shown in a cross section, in a closed configuration, with the speaker panel closed. Sound is being ported out through a waveguide in the speaker case. In FIG. 28, in B, an example of a speaker boost is shown in a perspective view, in a closed configuration, with the speaker panel closed. Sound is being output through holes in the speaker case. In FIG. 28, in C, an example of a speaker boost is shown in a perspective view, in an open configuration, with the speaker panel open. This can be used with most of the other concepts Notes Any and all the above concepts may be applied to speaker booster devices which are configured to receive devices such as phones (eg. smartphones), tablets (eg. iPad), MP3 players, or Phablets, or laptops, or Portable gaming devices, or portable navigation devices (PNDs), or technology enabled wearable devices. The speaker booster devices may source power to another device to allow another device to be charged from a speaker booster internal battery; such may devices have a connector on them that a cable may be plugged into in order to recharge another device.

Figure 25:
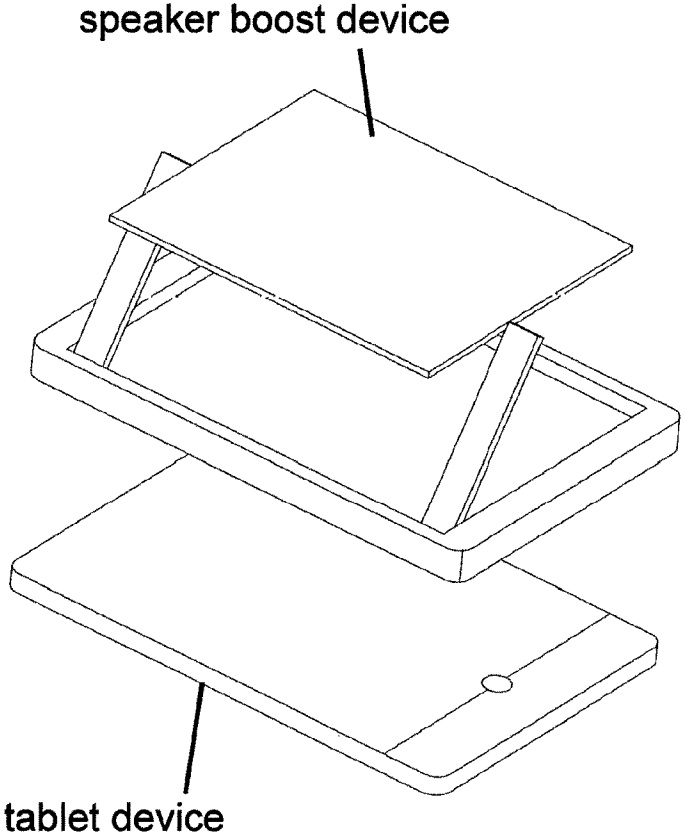
FIG. 25 shows an example of a speaker boost device configured (eg. scaled) to receive a tablet device.

FIG. 25 shows an example of a speaker boost device configured (eg. scaled) to receive a tablet device.

All design concepts are scalable and may be used as integrated designs (eg. as per concept 7) or on the back of phones, or on Tablets, MP3 players, Phablets, laptops and on other smart devices and from different manufacturers such as Motorola, Apple, Samsung, HTC, Nokia, LG so on.

Speaker Boost Examples

We describe aspects of features, functions, performance and attributes of examples of speaker boost products. Product physical design and hardware and software platform requirements may be understood.

Figure 29:
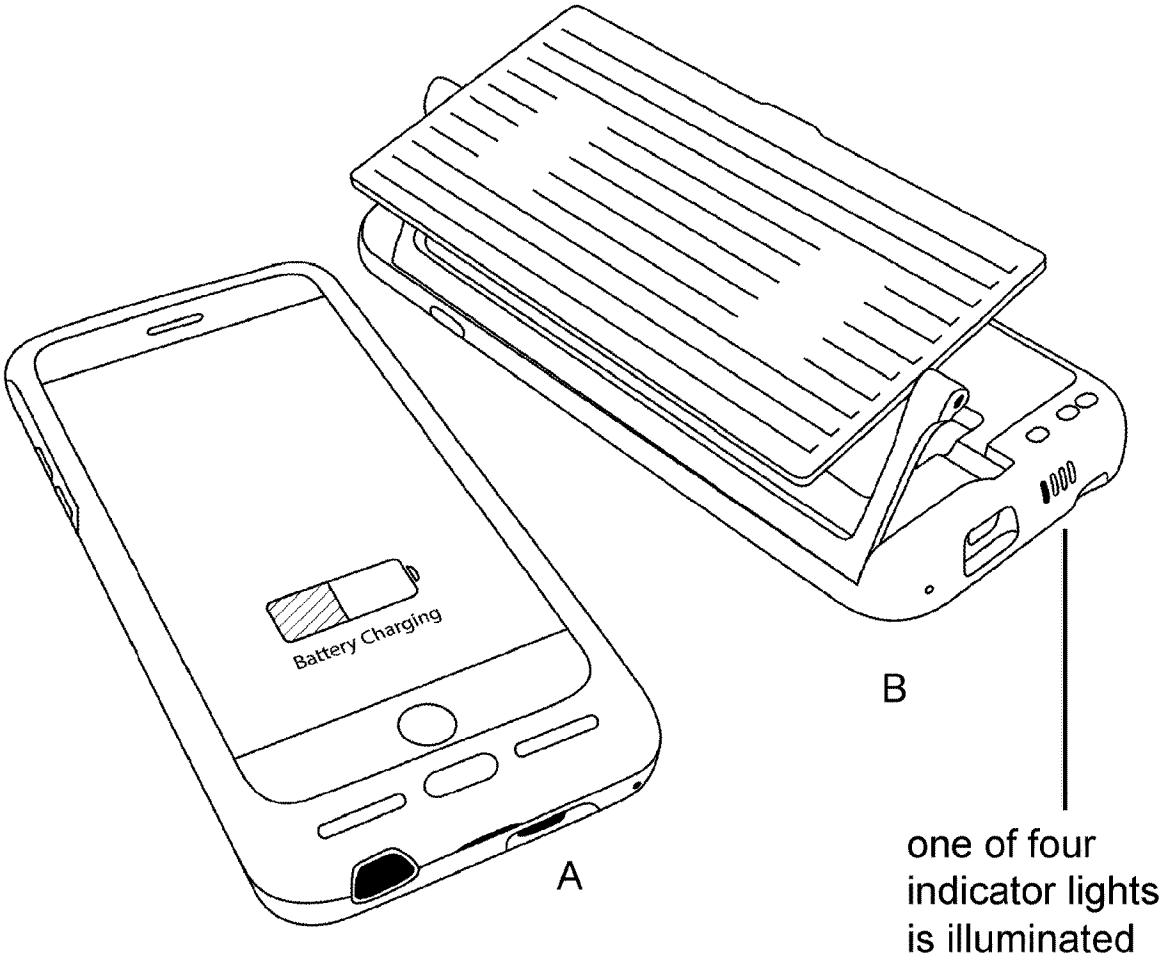
FIG. 29 shows example configurations of speaker boost examples.

A speaker boost product may be configured to receive a smartphone. A speaker boost may include indicator lights. In FIG. 29, in A, an example of a speaker boost is shown in a perspective view from a front side, in which the speaker boost has received a smartphone. In FIG. 29, in B, an example of a speaker boost is shown in a perspective view from a back side, in which the speaker boost has not received a smartphone; one of four indicator lights is illuminated.

Figure 30:
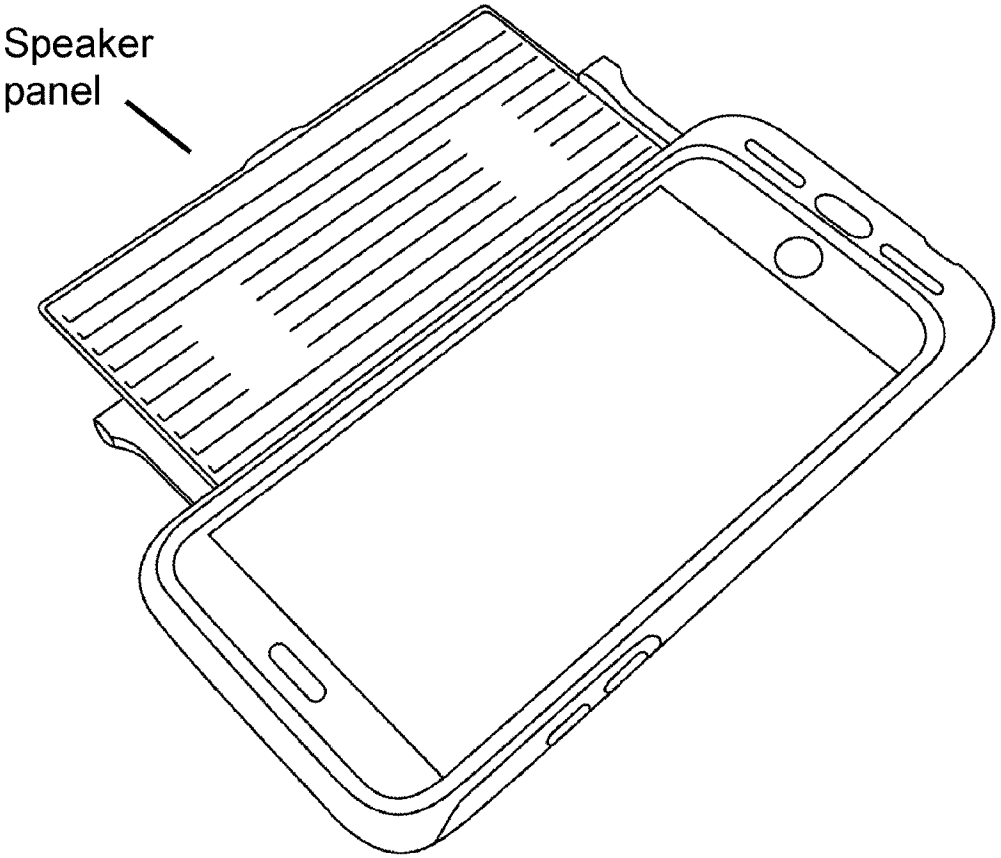
FIG. 30 shows an example of a speaker boost in a perspective view from a front side.

A speaker boost product may be configured to position a speaker panel in a plane parallel to the general plane of a smartphone which has been received in the speaker boost product, such that the speaker panel and the speaker boost product may lie together flat on a flat surface, such as on a desk surface. In FIG. 30, an example of a speaker boost is shown in a perspective view from a front side, in which the speaker boost has received a smartphone, and in which a speaker panel is positioned in a plane parallel to the general plane of a smartphone which has been received in the speaker boost product, such that the speaker panel and the speaker boost product may lie together flat on a flat surface.

A speaker boost product may comprise a top part and a bottom part. The top part and bottom part may be assemble-able into a speaker boost product. The top part and bottom part may be assemble-able into a speaker boost product using a snap-fit. The bottom part may be configured to receive a device eg. a smartphone. The bottom part may be configured to receive a device (eg. a smartphone) slidably. A speaker boost product comprising a top part and a bottom part may be configured to receive a device (eg. a smartphone) only when the top part and the bottom part are separated. A speaker boost product comprising a top part and a bottom part may be configured to release a device (eg. a smartphone) only when the top part and the bottom part are separated.

Figure 31:
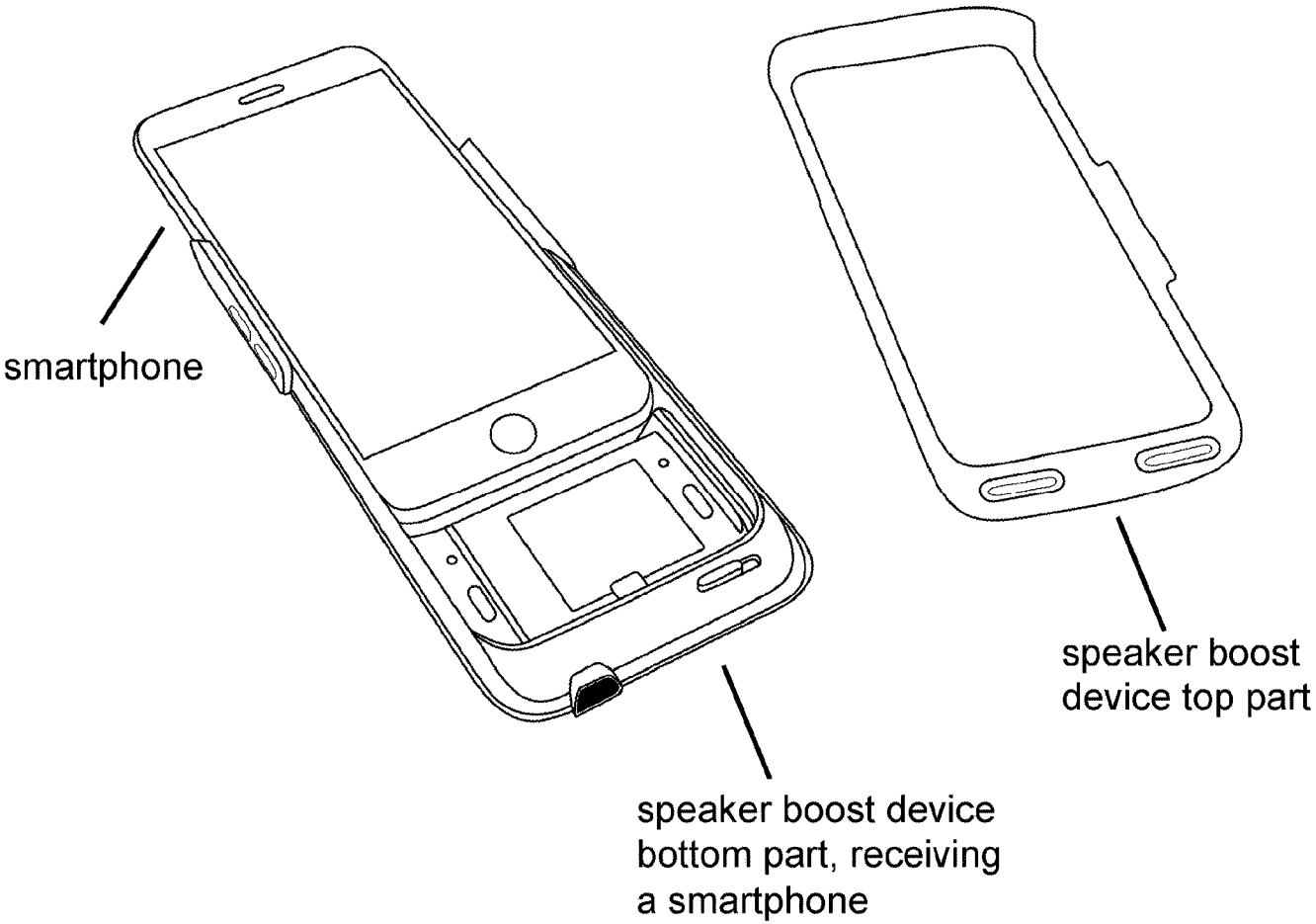
FIG. 31 shows an example of a speaker boost device, which has been separated into its top part and into its bottom part.

In FIG. 31, an example of a speaker boost device is shown, which has been separated into its top part and into its bottom part. The speaker boost device bottom part is shown receiving a smartphone.

There is provided a speaker device, the speaker device comprising a main piece and a detachable piece, wherein the detachable piece is detachable from the main piece so that the speaker device is configured to receive a mobile device. The speaker device main piece may receive the mobile device. The detachable piece may be an upper end piece of the speaker device.

Figure 45:
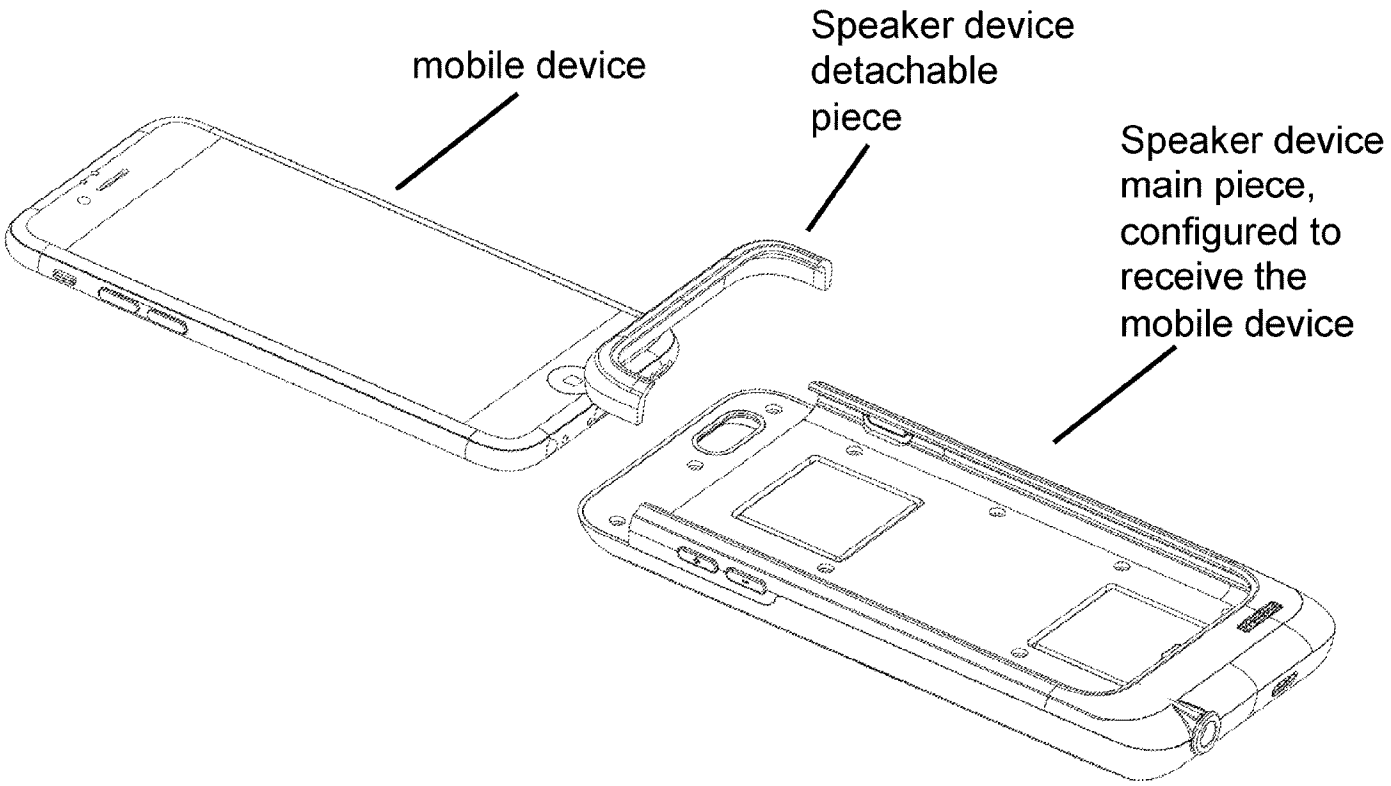
FIG. 45 shows an example of a mobile device and a speaker device, the speaker device comprising a main piece and a detachable piece, wherein the detachable piece is detachable from the main piece so that the speaker device is configured to receive the mobile device.

FIG. 45 shows an example of a mobile device and a speaker device, the speaker device comprising a main piece and a detachable piece, wherein the detachable piece is detachable from the main piece so that the speaker device is configured to receive the mobile device; the detachable piece is an upper end piece of the speaker device.

Figure 46:
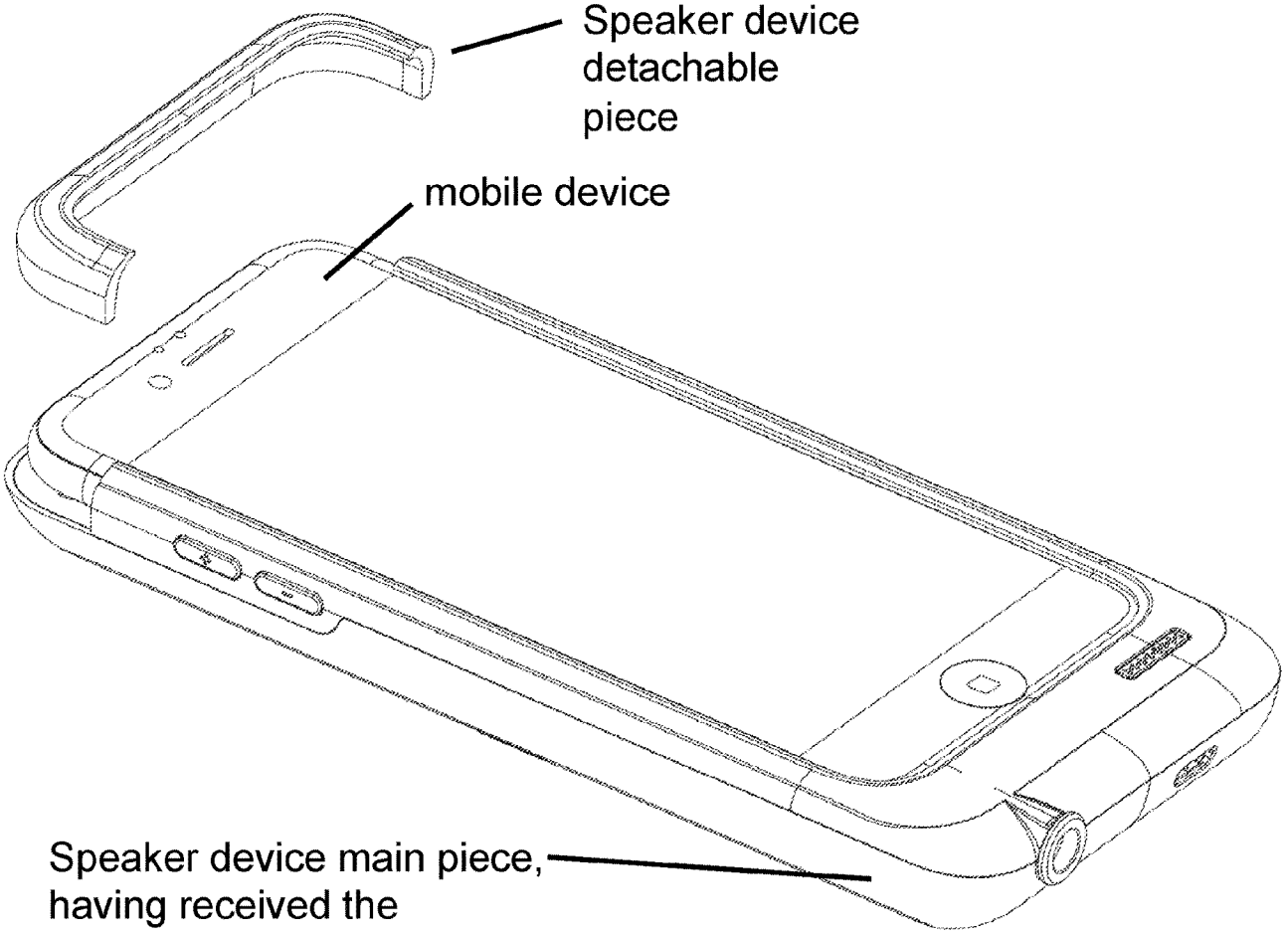
FIG. 46 shows an example of a mobile device and a speaker device, the speaker device comprising a main piece and a detachable piece, wherein the detachable piece is detachable from the main piece so that the speaker device is configurable to receive the mobile device, in which the speaker device main piece has received the mobile device.

FIG. 46 shows an example of a mobile device and a speaker device, the speaker device comprising a main piece and a detachable piece, wherein the detachable piece is detachable from the main piece so that the speaker device is configurable to receive the mobile device, in which the speaker device main piece has received the mobile device; the detachable piece is an upper end piece of the speaker device.

Figure 32:
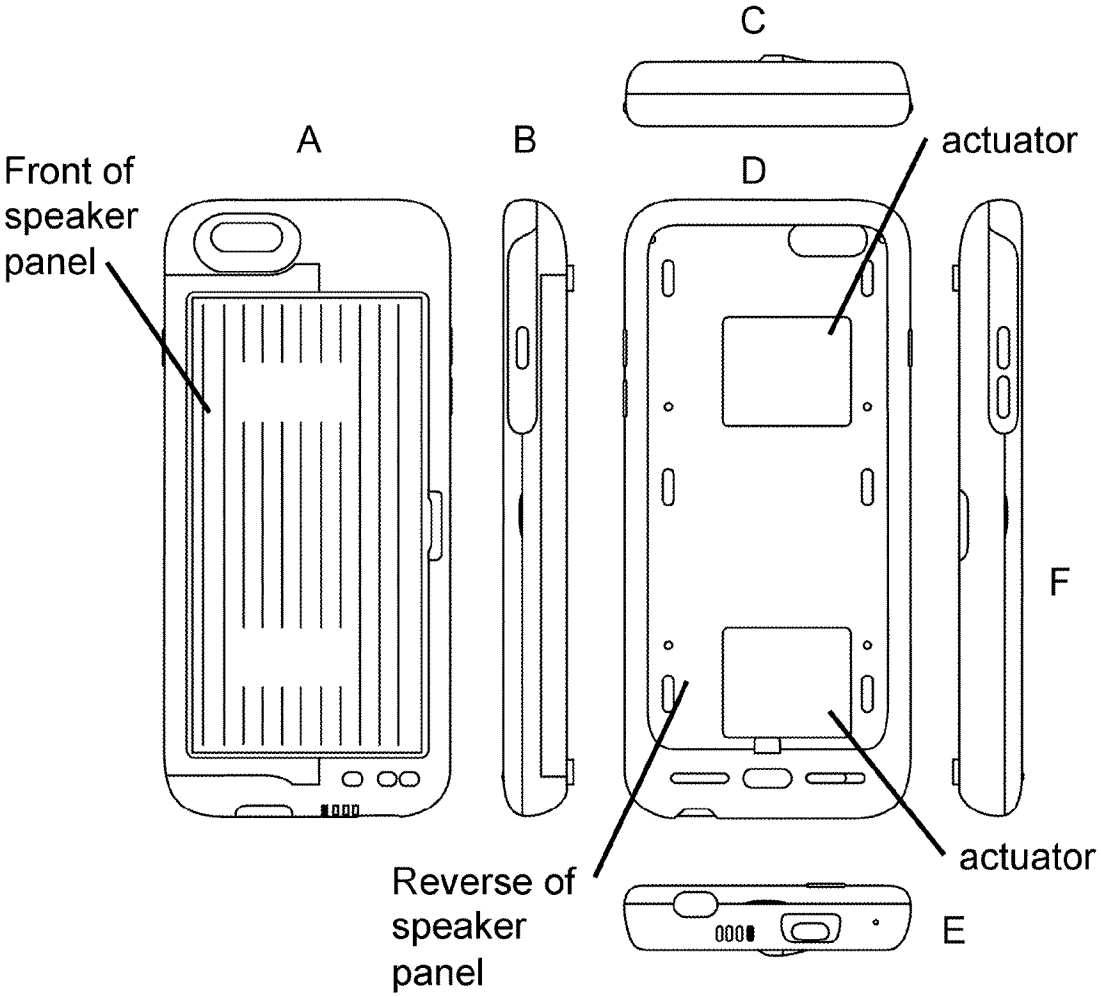
FIG. 32 shows six different views of an example of a speaker boost device.
Figure 33:
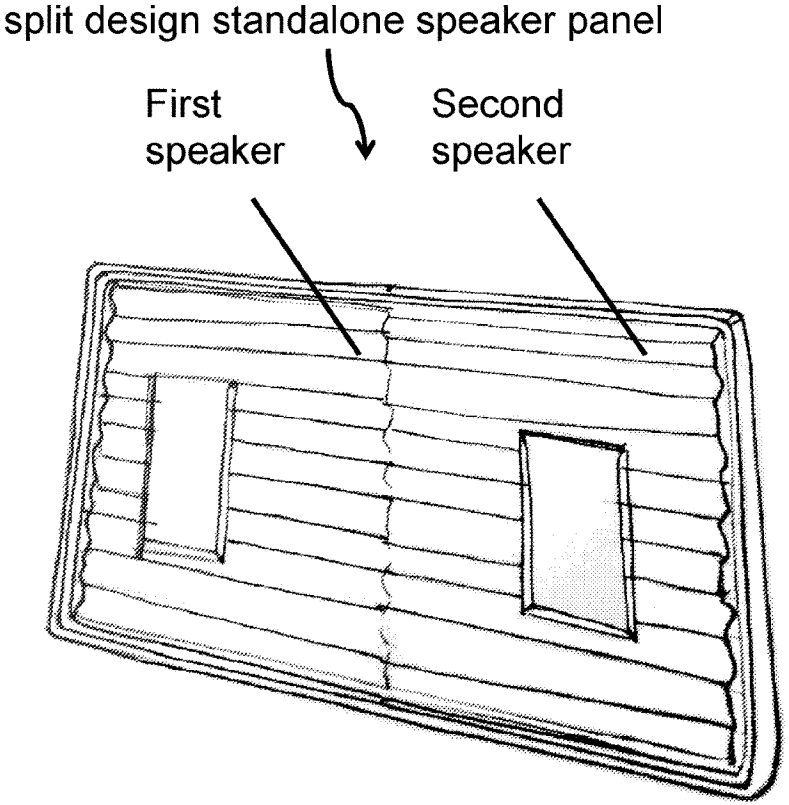
FIGS. 33, 34, 35 and 36 show an example of a split design standalone speaker panel mounted in a case, that contains two speakers which can be separated and placed in different positions from one another.
Figure 34:
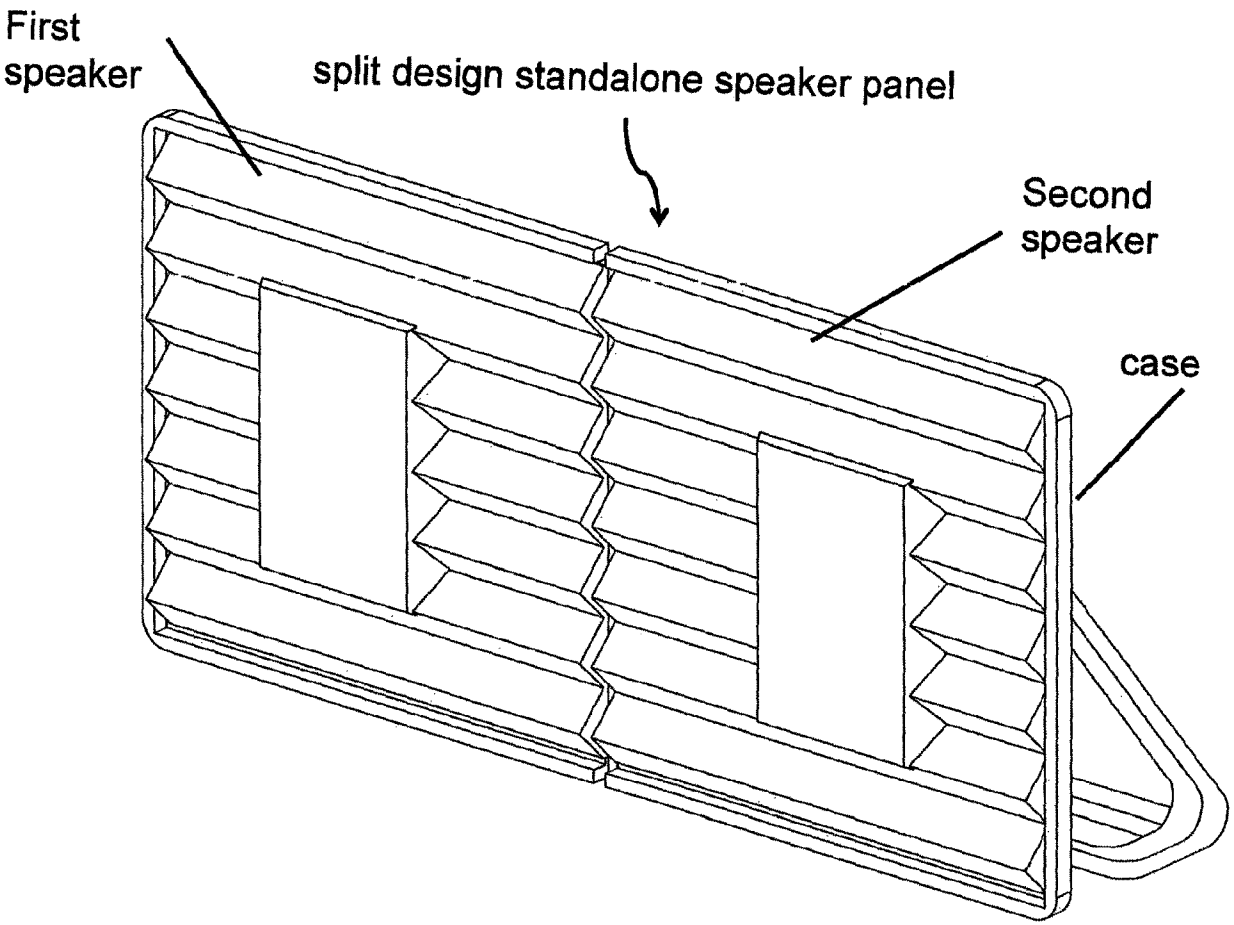
Figure 35:
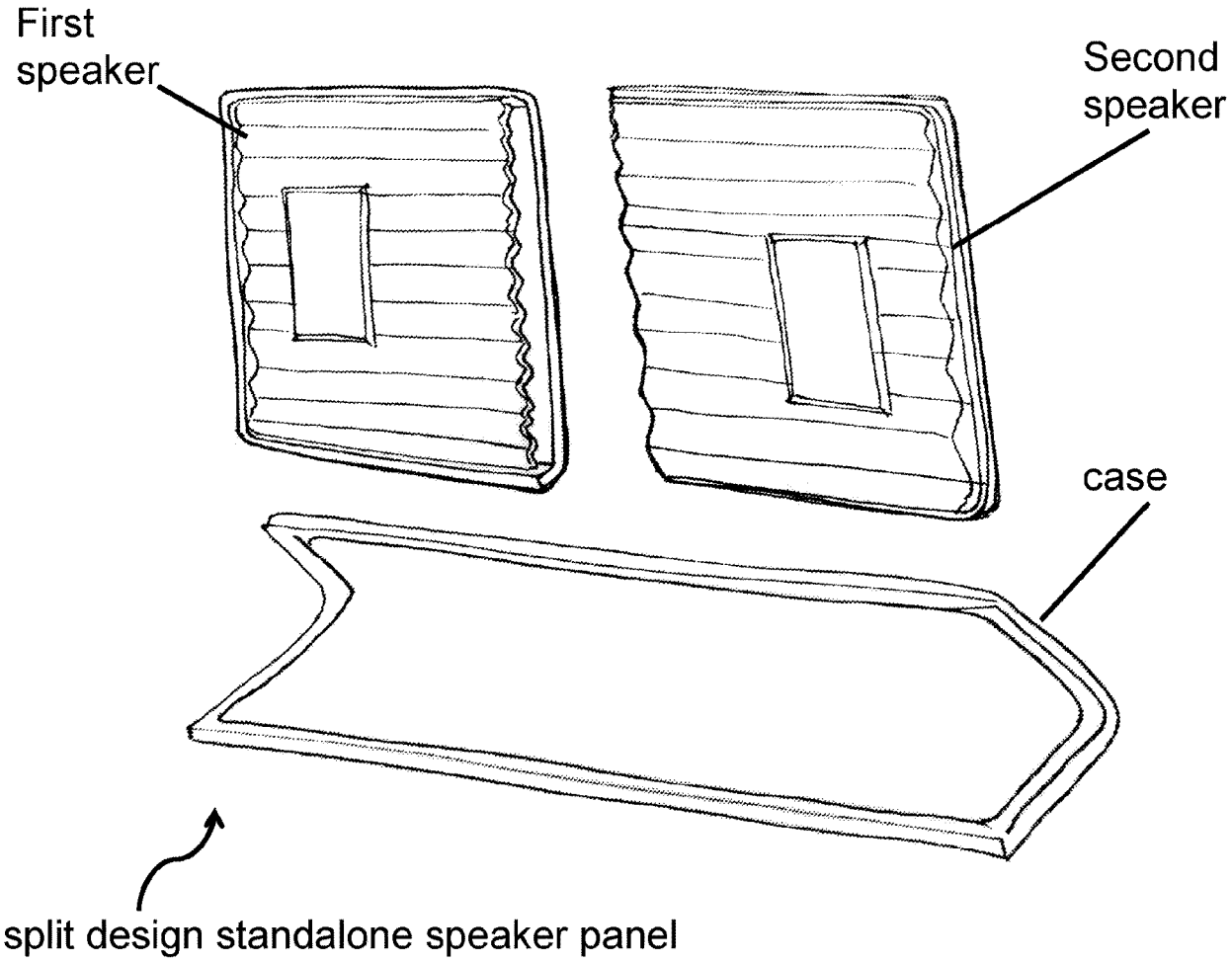
Figure 36:
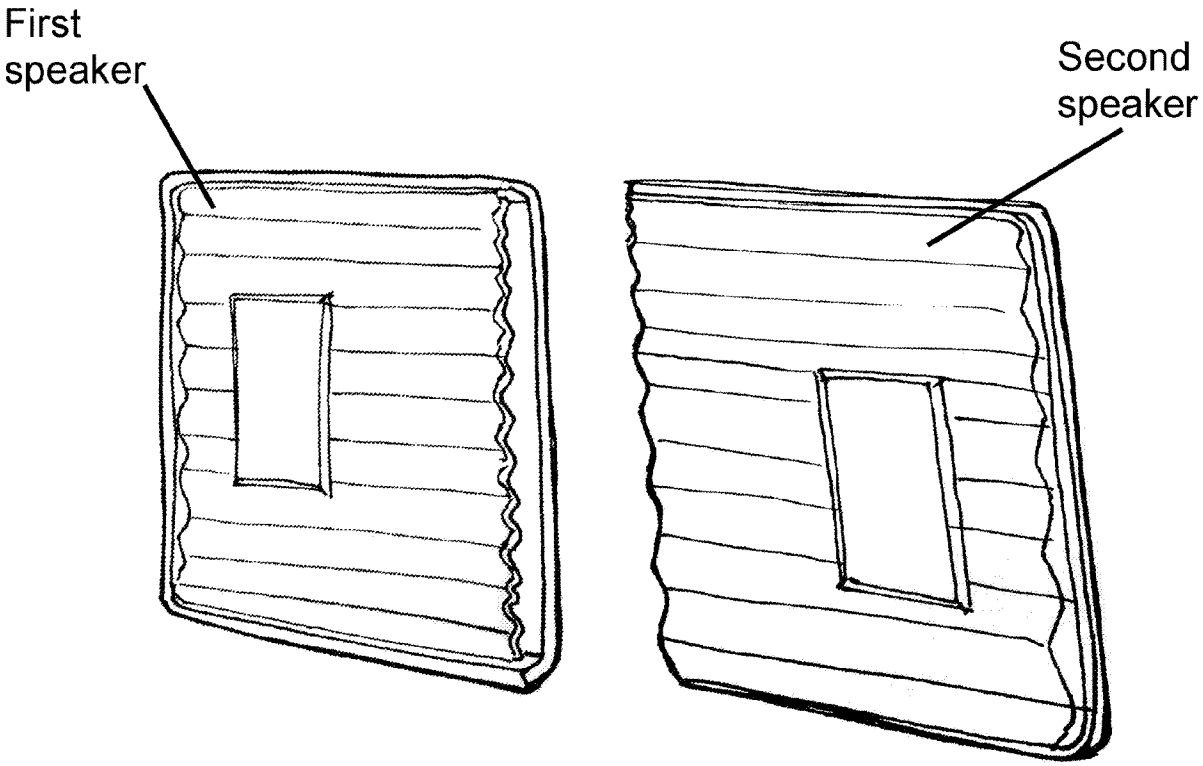

FIG. 32 shows six different views of an example of a speaker boost device. 'A' shows a back view, in which a front of a speaker panel can be seen. 'B' shows a right side view. 'C' shows a top view. 'D' shows a front view, in which the speaker boost device is not housing another device, hence actuators mounted on the reverse of the speaker panel can be seen. 'E' shows a bottom view. 'F' shows a left side view.

In an example, the speaker boost device provides the capability to remove the speaker panel from the speaker boost case and place the speaker panel remotely to the device and to control speaker panel by the device, for example as you would with any bluetooth speaker.

In an example, the speaker boost device can source power to another (eg. third party) device—so in addition to recharging the device the speaker boost device is physically attached/connected to, the speaker boost device includes another connector and a user can plug a (eg. if its rechargeable battery has no charge) device into it and recharge the device (eg. a third party device).

In an example, a speaker boost device is provided with no integral battery, wherein the speaker boost device includes a speaker case, and a speaker panel, the speaker panel having actuators attached and/or associated electronics.

In an example, a speaker boost device is provided with speaker panel mounting which may have optimised mechanical impedance tuned to the speaker panel impedance and rigidity.

Articulated speaker panels may be provided on non-mobile television sets. Such television sets may have screen diagonals of at least 20 inches. Such television sets may have screen diagonals in the range of 20 inches to 152 inches or larger. Articulated speaker panels may be provided on the sides of non-mobile television sets. Larger articulated speaker panels may be used to generate lower frequencies. Smaller articulated speaker panels may be used to generate higher frequencies. Articulated speaker panels may be provided on sound bars, eg. for sound provision at concerts. An articulated speaker panel may be provided on a portable navigation device. An articulated speaker panel may be provided on a navigation device built into a vehicle. An articulated speaker panel may be provided on an in-vehicle audio device. An articulated speaker panel may be provided on a wristwatch device eg. an Apple iWatch. An articulated speaker panel may be provided on a MP3 player. An articulated speaker panel may be provided on a camera. An articulated speaker panel may be provided on a digital camera. An articulated speaker panel may be provided as a stand-alone speaker device eg. a smartphone sized or different size stand-alone speaker device. An articulated speaker panel may be provided on a handheld gaming console.

Product Strategy

A speaker boost product example is a unique product offering bringing together consumers' needs for additional battery power whilst solving the problem of how to provide convenient and enjoyable mobile audio.

A speaker boost product example has the form factor of a phone cover but it incorporates a high performance audio solution, allowing consumers to have loud and high quality audio wherever they are, in a similar way to that offered by dedicated portable speakers from companies such as BOSE, Beats Audio, Monster and JamBox.

A speaker boost example incorporates an integrated battery boost/charge function similar to stand alone products offered by companies such as Mophie, which may provide up to a full charge for a mobile phone.

A speaker boost example is designed to fit a different phone manufacturer's product and versions are provided for a variety of different phone models such as Apple, Samsung, Nokia and others. The mechanical and electronic design is scalable and is adjusted for different phone designs that have different physical dimensions. A speaker boost example is a generic design sized to fit to a number of smart devices, in which the speaker boost is attachable directly to the back of a smart device using clips or adhesive.

A speaker device may be clippable onto a mobile device using clips of the speaker device, to provide an attached configuration; the speaker device may be unclippable from the mobile device, to provide a detached configuration.

Figure 47:
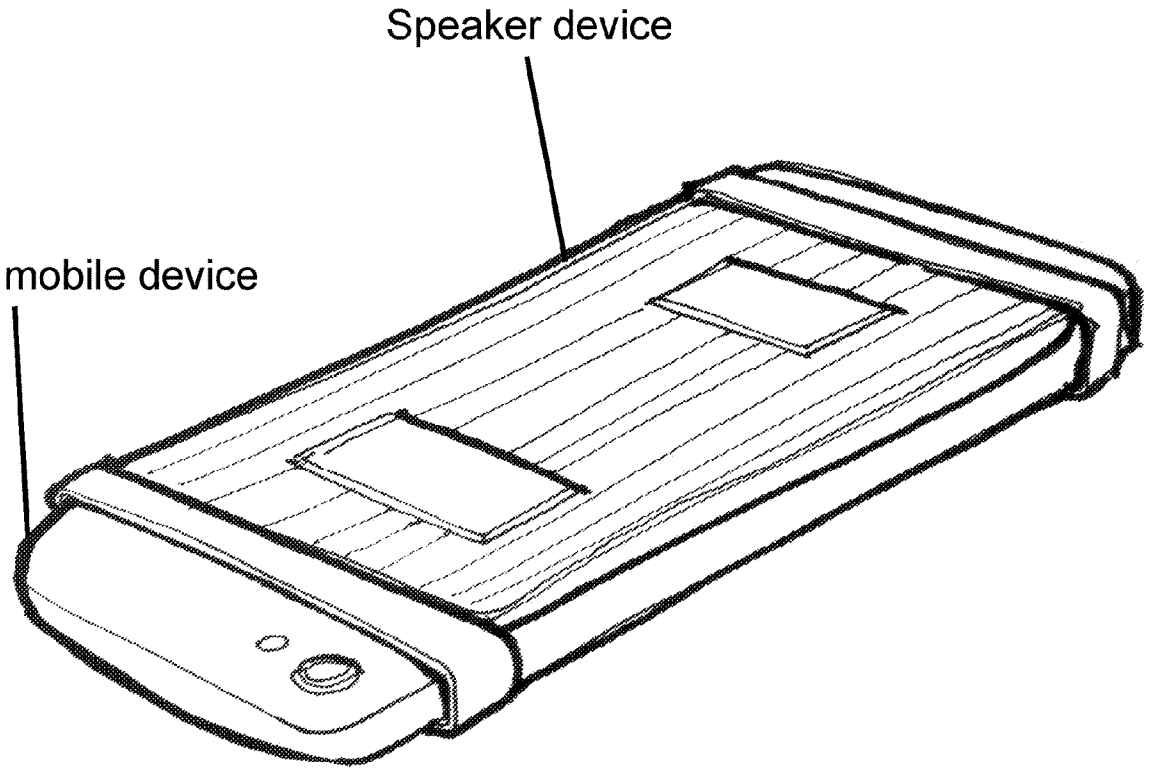
FIG. 47 shows an example of a speaker device which is clippable onto a mobile device using clips of the speaker device, in an attached configuration.

FIG. 47 shows an example of a speaker device which is clippable onto a mobile device using clips of the speaker device, in an attached configuration.

Figure 48:
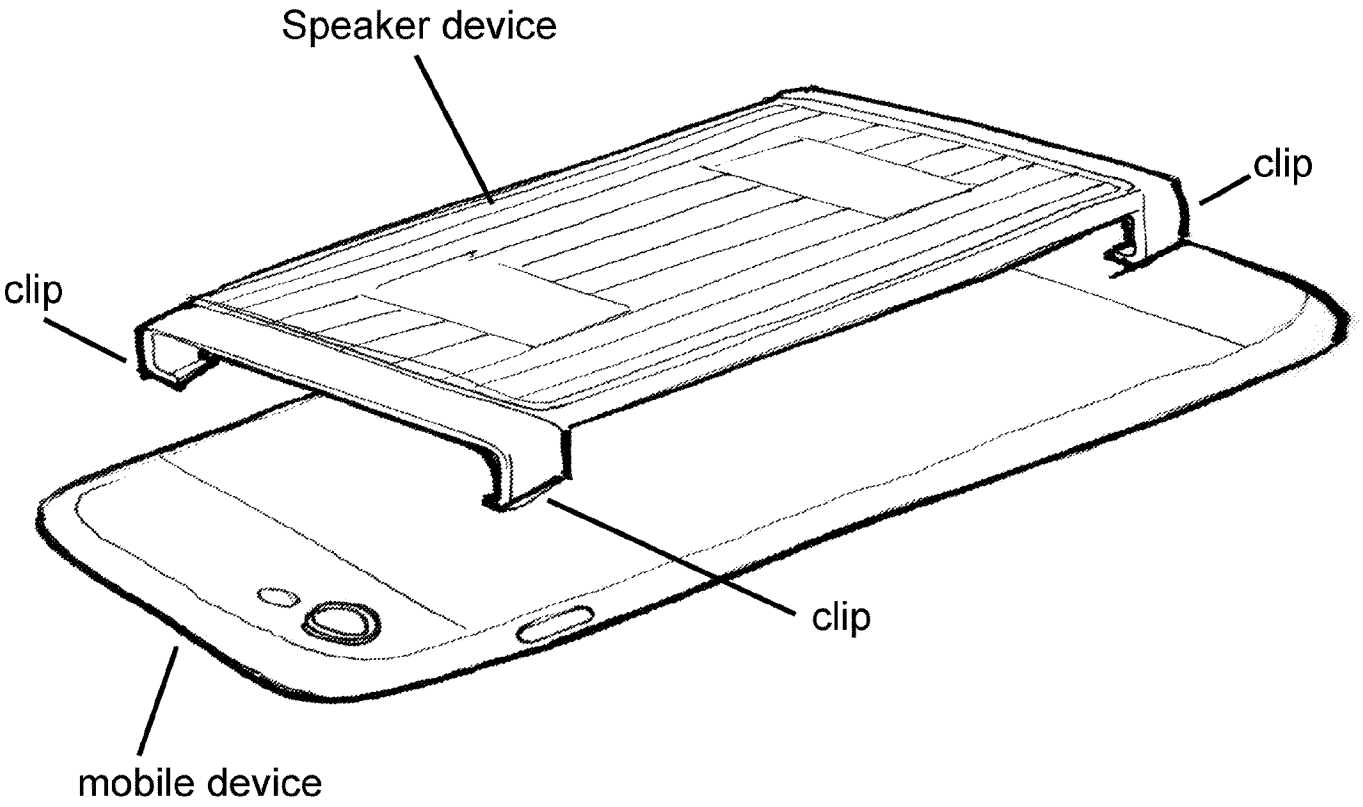
FIG. 48 shows an example of a speaker device which is clippable onto a mobile device using clips of the speaker device, in a detached configuration.

FIG. 48 shows an example of a speaker device which is unclippable from a mobile device using clips of the speaker device, in a detached configuration.

There may be a similarity of form factor between a Speaker Boost example and a traditional phone battery boost cover.

A design concept of a Speaker boost example is one of modularity with a common electronic platform and common mechanical elements such as articulating hinge designs. There are various design implementations of the speaker boost concept that articulate the audio panel in different orientations allowing a number of different physical form factors to be created—the platform may include additional features such as voice prompts, audio processing etc.

A design and functionality of a Speaker boost example is suited to users who are online, and use services such as I-tunes and Spotify. A Speaker boost example customer may be one who uses their phone for listening and playing music or playing games on a regular basis. A Speaker boost example addresses two important needs for mobile consumers: power and audio, and as such will have wide appeal across many different demographics. A speaker boost example is easy to connect and operate and should not have any technology barriers (if the person already owns a smart device) that would discourage consumers.

A concept of a speaker boost example is that it is your phone cover (something which most smartphone users already purchase) which serves a triple purpose: it protects your phone, secondly it is a phone charger (booster) and thirdly a high quality portable speaker. It is important that by incorporating the boost and speaker functionality that the cover does not become bulky or cumbersome for the user which would make it inconvenient for them to have with them at all times. Inclusion of a battery boost functionality in a Speaker boost example provides an independent power source for the speaker electronics and also the ability to charge the consumer's phone, thereby addressing one of the core usage issues that consumers have with their smart devices—battery life. In an example, the Speaker boost can provide up to one full charge to a consumer's phone or up to 8 hours of audio playback at mid power levels.

In an example, a speaker boost connects to the mobile device using Bluetooth eg. ver 2.0/4.0 and may support a number of codec formats and different Bluetooth profiles.

Competitive Benchmarking

An example speaker boost product integrates case protection, battery boosting and audio capability in one device.

An example speaker boost product has 2 different designs available on one phone case. This is achieved through the rotating nature of the speaker panel and that a different image can be placed on each side of the panel giving the user a "Work Case Image" and a "Weekend Case Image" in one product example, for which the user would normally have to buy two cases. See FIG. 20 for example. A panel can also be removed and a new panel bought with different images should the user wish to have multiple images for their device.

A Speaker boost example is competitive in regards size especially thickness when compared to companies such as Mophie the number one Apple battery Booster compatible manufacturer. The speaker boost example offers eg. 20% higher charge capability than the leading Mophie products (Mophie Air) while being thinner and integrating the speaker capability.

A speaker boost example may outperform some of the leading companies in the market, both in amplitude and frequency response. Tests conducted in controlled listening tests and acoustic measurements of the Beats Pill, the Monster Superstar and the Jambox Mini, all categorised as portable Bluetooth speaker systems. The Speaker Boost Apple 3G's version of the Speaker boost panel delivered 87 dB @ 8 ohms with a −3 dB roll off of 200 Hz (non equalised) vs 84 dB for the Jambox and 93 dB for the Monster and 96 dB for the Beats pill. It should be noted that this is unequalised, non optimised panel with no boost and on one of the smallest panel size of product—the design target for a Speaker boost example is set at 87 dB, with a −3 dB roll off of 150 Hz with up to 10 hours of playback time, vs 5 hours for the competition. A speaker boost example is 104 cc's, for an I-Phone 5 speaker boost. The smallest product from the competition is the Monster Superstar which is 1090 cc's: approximately 10 times the size.

Physical Design

In an example, a booster utilizes a split form factor allowing the lower (eg. 15%) of the product to be removed to allow the phone to slide into the Speaker boost housing and then replaced allowing the (eg. lightening or micro USB) connector to mate with the phone. The two pieces of the example booster may clip together using an interference fit set of latches.

A front surface of an example booster may be used to display the brand (could also be used for buttons/LEDs).

An inside surface of an example Speaker Boost may have a Laser marked Box that lists out the various approval and certifications that the products has undergone, CE, FCC. UL, GS, TUV, PS etc and the specifications such as Bluetooth that it complies to. It may include the voltage and the rating of the battery, input and output voltages and charge currents, recycle and do not dispose markings, the brand/model name and the product serial numbers/date codes in Alpha/Numeric form and as a barcode.

A side of an example product may have cut outs to enable the user to activate the buttons on the side of the phone to allow the user to control the phone while the speaker booster is attached, and an aperture (position may be model dependent) on the side of the device to allow the connection of a 3.5 mm stereo jack plug into the product for a user to use headphones with the booster attached.

An example Speaker Boost includes a single (eg. 4 way) switch on the device located on the rear surface of the device close to a bottom left hand edge to switch the Speaker boost off or into Speaker Boost mode or into battery boost mode of a combination mode of battery and speaker boosting. There may be a LED's located close to the switch to indicate the mode the booster is in. There may the same or other LEDS on the booster housings to indicate the state of charge of the battery inside the Speaker Boost. These may be activated by a press button switch which may be located on the surface of the Speaker boost. The LED's may be edge mounted so that they can be seen when the booster is placed down on its front surface. These LEDs may also be used to indicate the charging status of the device when its internal battery is being recharged. There may be 2 volume keys (up/down) located on the rear surface of the booster, centrally placed. On certain models there may be an additional aperture to allow access to switches on the device (Phone lock/silent button on and I-Phone etc.).

An example Speaker Boost includes on a rear of the booster apertures for a device camera so that the camera can be used with the booster attached to the device. The rear of the device may also include the articulating speaker(s)—dependent on the design the hinges will activate north to south or east to west; the hinges may or may not be connected via a torsion bar system between them to avoid putting strain into the acoustic panel.

A key feature of an example speaker boost may be the ability to remove and replace the acoustic panel; this may be done by simply pulling the panel upwards and away from the hinges. The panel may be held in the actuator frame in two mounting cups that may rotate on the hinges and that may fit around the actuators. When the panel is removed from the booster, the transducers may or may not remain attached to the acoustic panel.

In an example, the acoustic panel is made of Carbon fibre Pre-Preg and is 0.1 mm to 1 mm thick. The panel may have the transducers attached with high temperature adhesive. The panel may be made in white or coated in white such that matter can be printed upon it using dye sublimation printing techniques, so that consumers can purchase additional panels with different designs on them.

In an example, Speaker boost hinges may be made of cast/machined aluminum or other materials and may be fixed into the booster on a friction hinge to allow the hinges to be placed in a particular orientation and stay there. The hinge may be highly polished or brush/cast finish, anodized etc. The hinges may be used to route the connections to be made to the actuators and may pass through from the Speaker boost case into the Hinge and in the Actuator cups.

In an example, the hinges and the actuator cups are configured to allow the speaker panel to rotate 180 degrees allowing both sides of the panel to be placed uppermost when the panel is in the closed position, (see mass customization section below for more information on this feature).

In an example, actuator cups are made of PCB ABS or other materials with a metal insert in the base of the cups which may be overmolded. This plate may act as the mechanical "Ground" of the actuator, and may include two contacts for positive and negative signals. The actuator cups may be attached to the hinges by a hollow metal pin which may be screwed, overmolded or otherwise attached into the actuator cup. In the bottom of the actuator cups there may be two spring contacts or other method of connection that may contact/connect with the actuator when it is placed into the cup.

There may be a micro USB connector located on the device (centrally mounted if possible) that may be used to recharge the Speaker Boost's internal battery and/or connected device's battery.

There may be two switches on the back surface of the booster: one located on the left hand side may be a (eg. 4 position) switch (including off); there may be an LED that may indicate the mode the Booster is in. A second switch may be located on the device; this may be a Battery Status switch which may be a push to activate switch, and may illuminate the LEDs located on the booster to inform the user of the internal batteries charge status. There may also be two volume keys (up/down) located on the rear case.

In an example, a speaker boost may have a (eg. Microelectromechanical systems (MEMS)) surface mount microphone to allow the speaker boost to be used as a speaker phone or for voice control of the speaker device or connected device The microphone may be incorporated into the bottom edge of the product.

In an example of Bluetooth antenna positioning, the Bluetooth antenna is located centrally within the device to avoid interference with Cellular antennas located inside the device (because cellular antennas are normally edge mounted).

Example Product Aspects

- Size 104 cc's (63.75 mm's 139.8 mm's 15.9 mm's)—(Iphone 5)
- Weight 70 gm's
- The housing made of PCABS
- The panel made of Carbon fibre—Pre-Preg
  - Actuator Frame made of Aluminum/magnesium
- The Hinges made of PC/ABS and or Aluminium.
- One 4 position slide switch to enable the different modes of the speaker boost.
- One press to activate battery status switch (May remove this and use volume keys both pressed simultaneously)
- Two volume switches (up/down)
- One tri color Status LED
- Three blue Battery status LED's
- a device interface connector (dependent on model) mounted in the lower removable section and used to connect the Speaker boost to the device.

Figure 2:
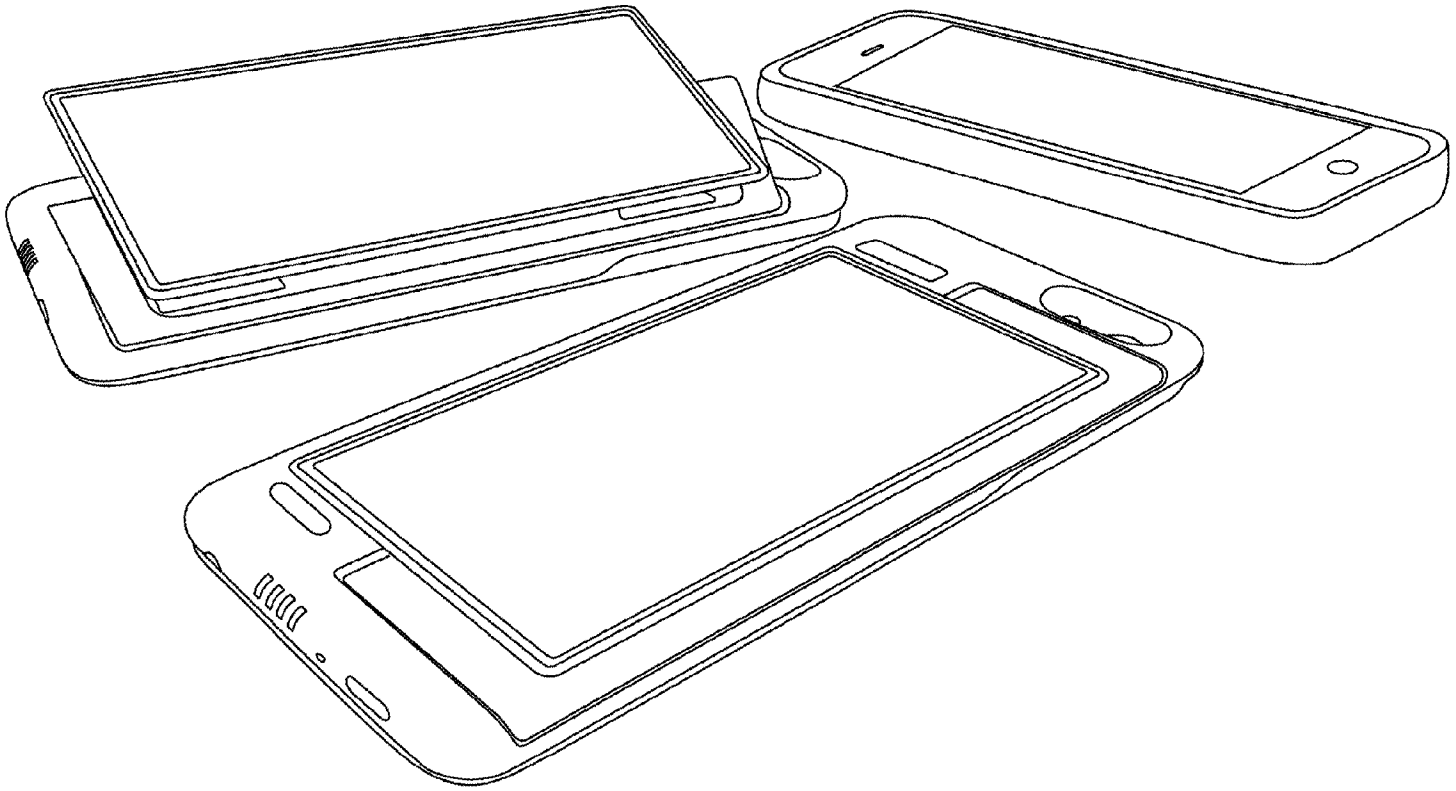
FIG. 2 shows some examples of a speaker boost product.

FIG. 2 shows some examples of a speaker boost product.

Technologies

Flat Panel Speaker Technology

Miniaturized actuators enable configurations to be considered that are suitable for inclusion into a mobile device. The speaker boost may include modifications of existing actuators.

Bluetooth

In order to make the platform compatible with as broad a range of smart devices as possible, Bluetooth technology may be used.

Speaker Panel

A custom speaker panel may be created in various panel sizes to enable different smart device form factors to be supported. This panel may be made from carbon fibre Pre Preg and may be 0.1 mm to 2.0 mm thick, reducing its mass whist providing it with the stiffness required to produce good quality audio.

Mass Customization Example

The Speaker boost has been designed to be Mass customizable via the speaker panel. The speaker panel may have different designs printed on both sides of it which can be displayed by articulating the speaker panel through 180 degrees. This will allow the user to have a different design (that may suit their environment or mood). The panels may be replaceable by removing them from the speaker frame assembly.

The panel may be printed onto using dye sublimation techniques (either directly on to carbon fibre Pre Preg or onto a PBT over mold placed on to the carbon Fibre).

Implementations Examples

There are provided eight different implementation examples of the speaker boost that offer different arrangements and market approaches. Each arrangement may have its own set of performance characteristics and consumer benefits. Arrangements may be as follows:

Arrangement 1—Single Panel, north south hinge location with two transducers.

Arrangement 2—Single Panel, with east west hinge location with two actuators.

Arrangement 3—Dual Split Panel (Garage door design) hinge mounting north south, with two actuators per panel.

Arrangement 4—Dual Split Panel (Garage door design) hinge mounting east west, with two actuators per panel.

Arrangement 5—Dual Panel with panels overlapping north south hinge location, with two transducers per panel.

Arrangement 6—Dual Panel with panels overlapping east west hinge location, with two transducers per panel.

Arrangement 7—Single Panel, in which a speaker frame and or panel are releasable from the case and or device housing in a vertical manner. Examples are shown in FIG. 39 (not released) and in FIG. 40 (released).

Figure 49:
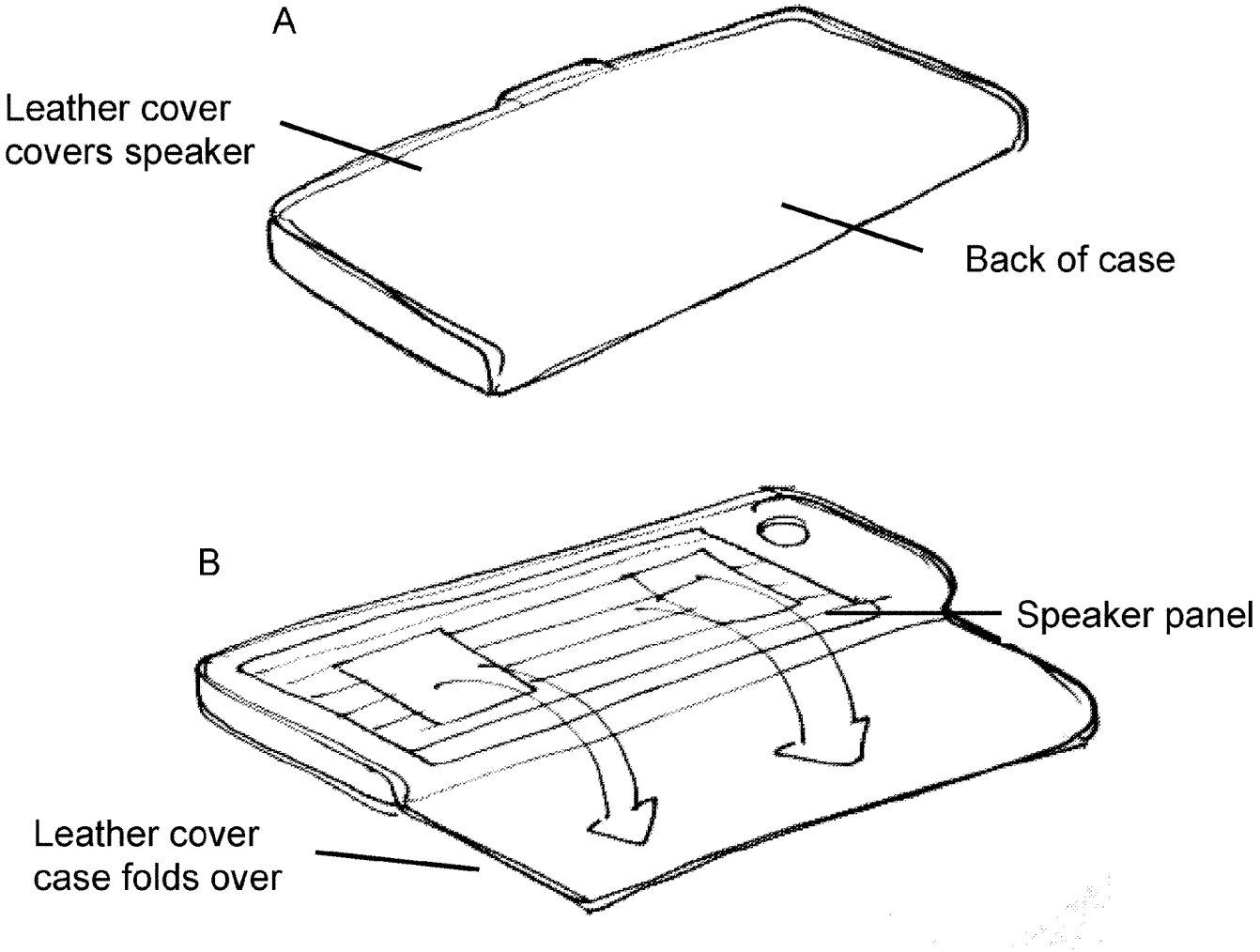
FIG. 49 shows examples of a speaker device with a wallet design.
Figure 51:
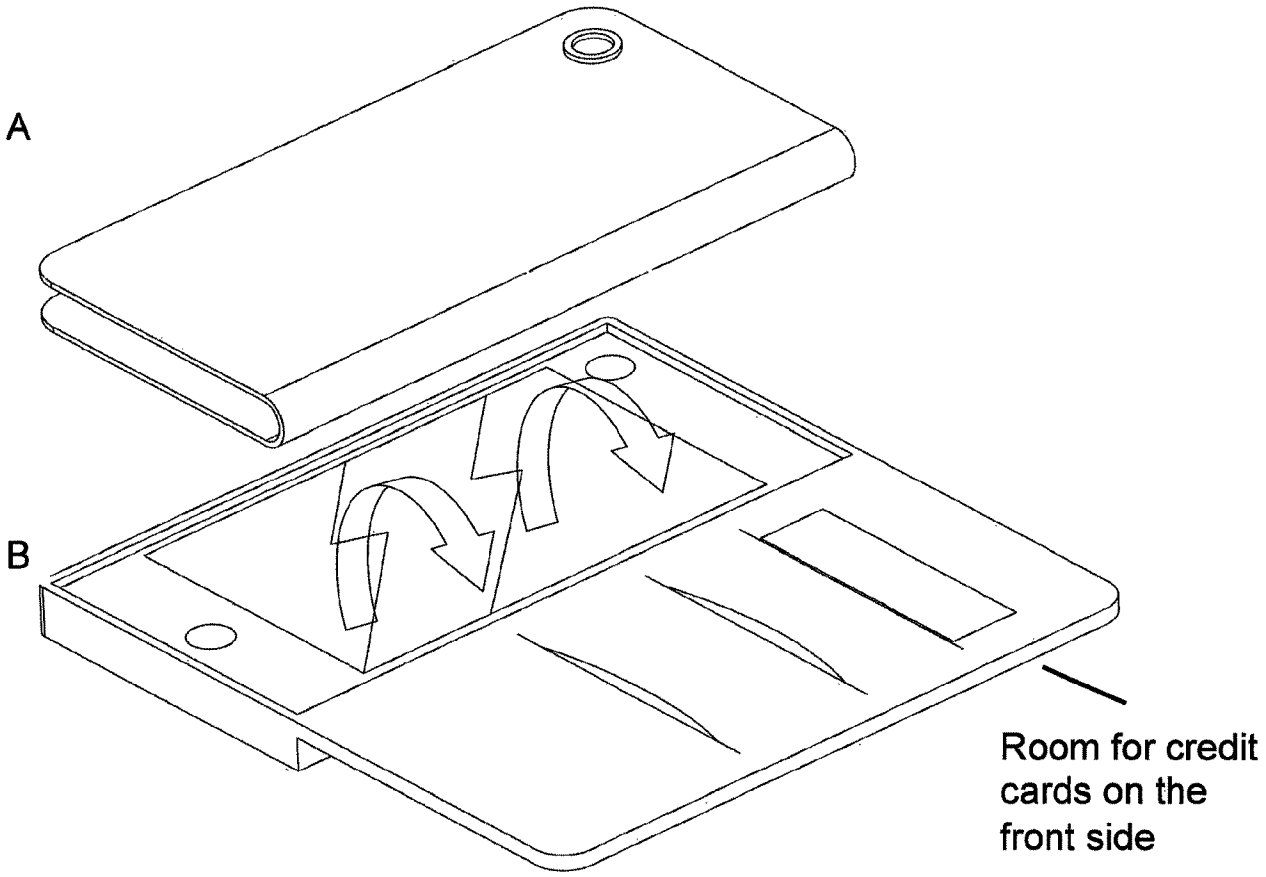
FIG. 51 shows examples of a speaker device with a wallet design.
Figure 52:
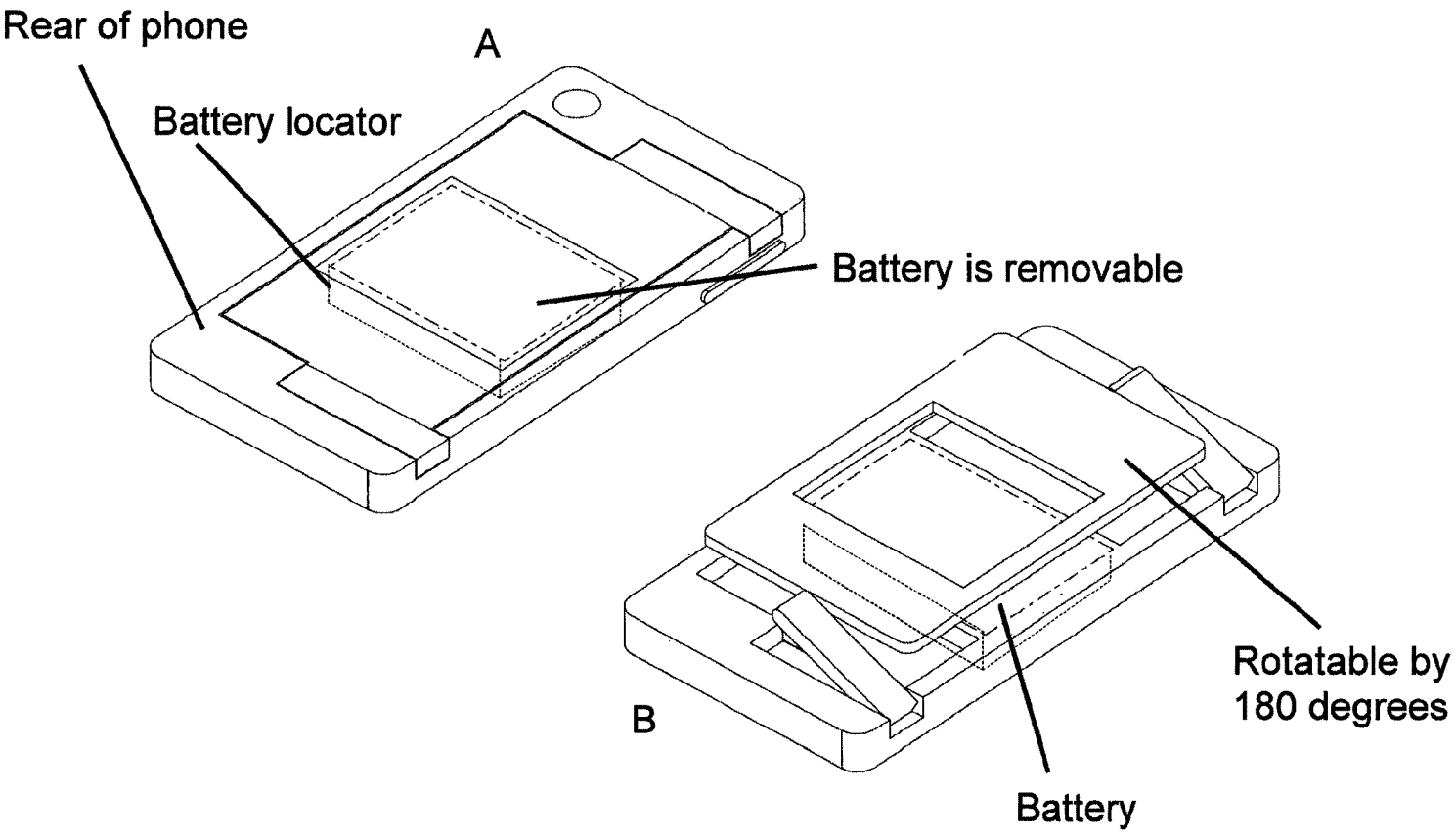
FIG. 52 shows examples of a speaker device with a removable battery.
Figure 53:
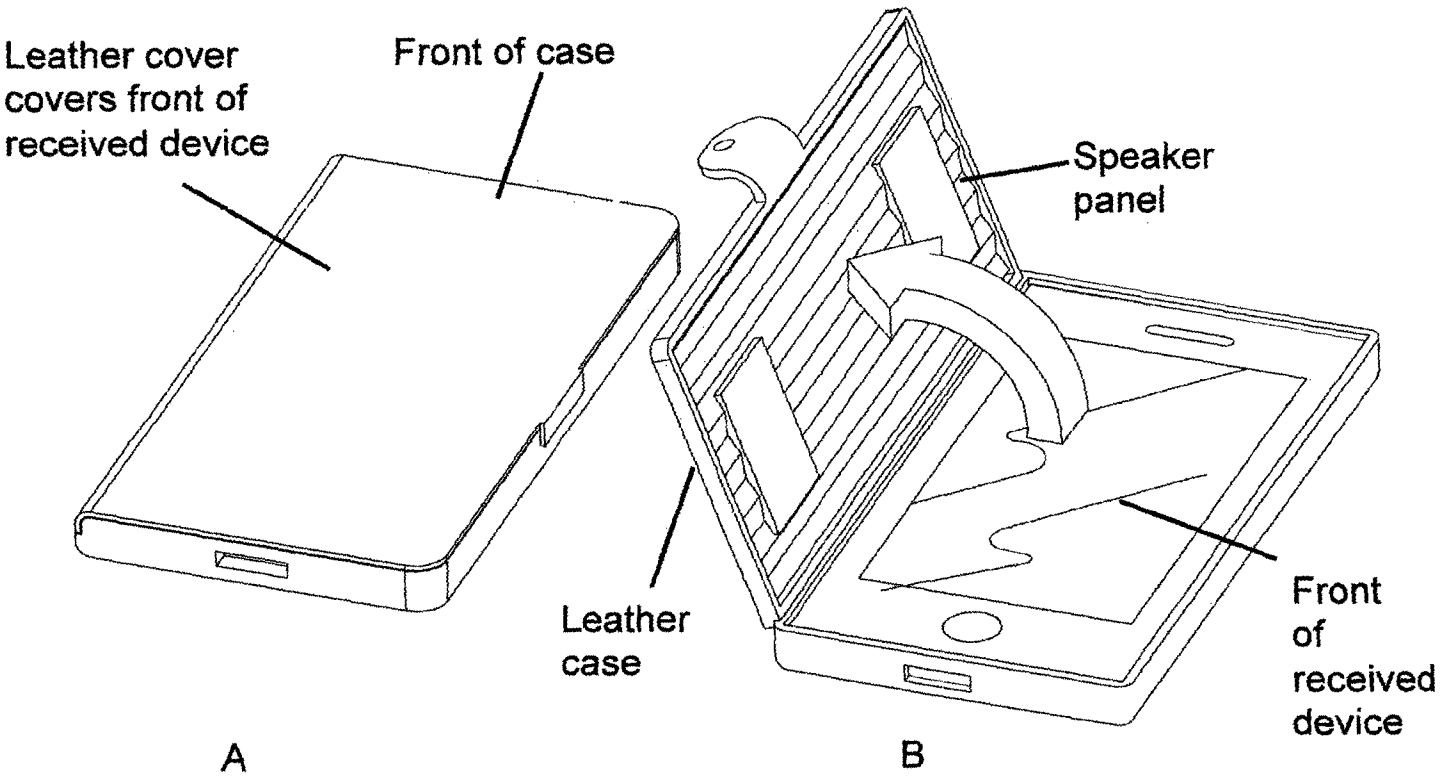
FIG. 53 shows examples of a speaker device with a wallet design.

Arrangement 8—Where the speaker panel and or speaker frame assembly is configured into a wallet design of a smart device case wherein the speaker frame is contained in the wallet housing. Examples are shown in FIGS. 49, 51 and 53. In a closed configuration of a wallet design, a cover (eg. a leather cover) may cover a speaker. An example is shown in FIG. 49(A). In an open configuration of a wallet design, a cover (eg. a leather cover) may fold open to reveal a speaker panel. An example is shown in FIG. 49(B). In a closed configuration of a wallet design, a cover (eg. a leather cover) may cover a front screen of a speaker device, or of a device received within a speaker device. An example is shown in FIG. 51(A). In an open configuration of a wallet design, a cover (eg. a leather cover) may open to reveal a front screen of a speaker device, or of a device received within a speaker device. The open wallet may have openings suitable for receiving credit cards. An example is shown in FIG. 51(B). In a closed configuration of a wallet design, a case (eg. including a leather cover) may cover a front screen of a device, or of a device received within a speaker device, with a speaker panel not being visible in the closed configuration. An example is shown in FIG. 53(A). In an open configuration of a wallet design, a case (eg. a leather cover) may open to reveal a front screen of a device, or of a device received within a speaker device, and also to reveal a speaker panel in the case. An example is shown in FIG. 53(B).

Figure 3:
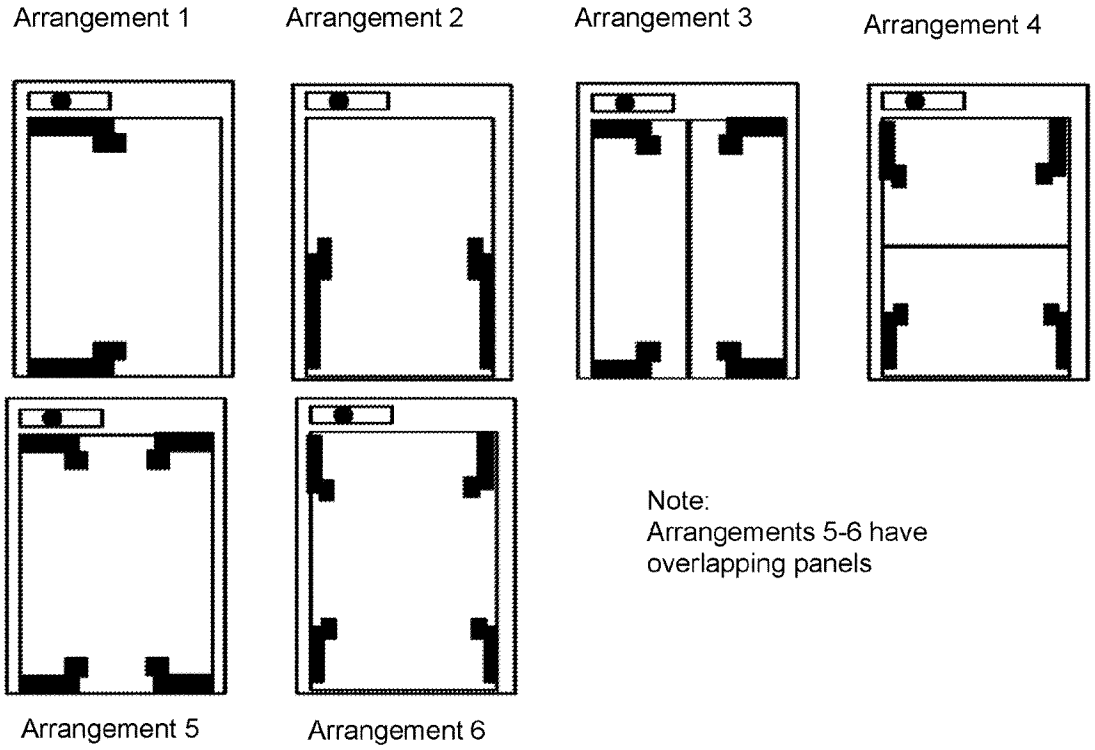
FIG. 3 shows examples of different speaker boost panel hinge arrangements.

Examples of Arrangements 1 to 6 are shown in FIG. 3.

All arrangements can also be implemented with a single transducer per panel and may be implemented in concepts shown in any of FIGS. 37, 38, 39, 40, 41, 42, 43.

In an example, the arrangements may be developed in such a way that platform commonality is maintained and that solutions to different engineering challenges such as hinge design, actuator cups and other solutions are scalable across the different concepts such that all that is required is the development of a particular concept/phone model variant and not the recreation of engineering solutions.

A micro USB socket may be provided in a speaker boost product.

The speaker boost product may be capable of mass customization with a no screws approach.

A speaker boost product may be provided which is compatible with at least one of: I-Phone 4; I-Phone 4S; I-Phone 5; I-Phone 5S; I-Phone 6; I-Phone 6+; Samsung Galaxy S3; Samsung Galaxy S4; Samsung Galaxy S5; Nokia Lumina 630; Nokia Lumina 635; Nokia Lumina 930 and other smart device products now or in the future.

Non-Retractable Speaker Device

There is provided a non-retractable speaker device, the speaker device including a case, a speaker panel and a speaker panel suspension system, wherein the speaker panel is surrounded by the case, wherein the speaker panel is arranged to vibrate, and wherein the speaker panel suspension system is configured to decouple speaker panel vibration from the case. The speaker panel may be arranged to vibrate using one, two or more actuators mounted on the speaker panel. The non-retractable speaker device may include no articulating hinges; the speaker panel may be suspended in the case, such as on a membrane, or using other means such as springs/foam attached to actuator cups or attached to an edge of speaker panel etc.

The non-retractable speaker device may be a smart device.

The non-retractable speaker device may be configured to receive and to store a mobile device.

Figure 50:
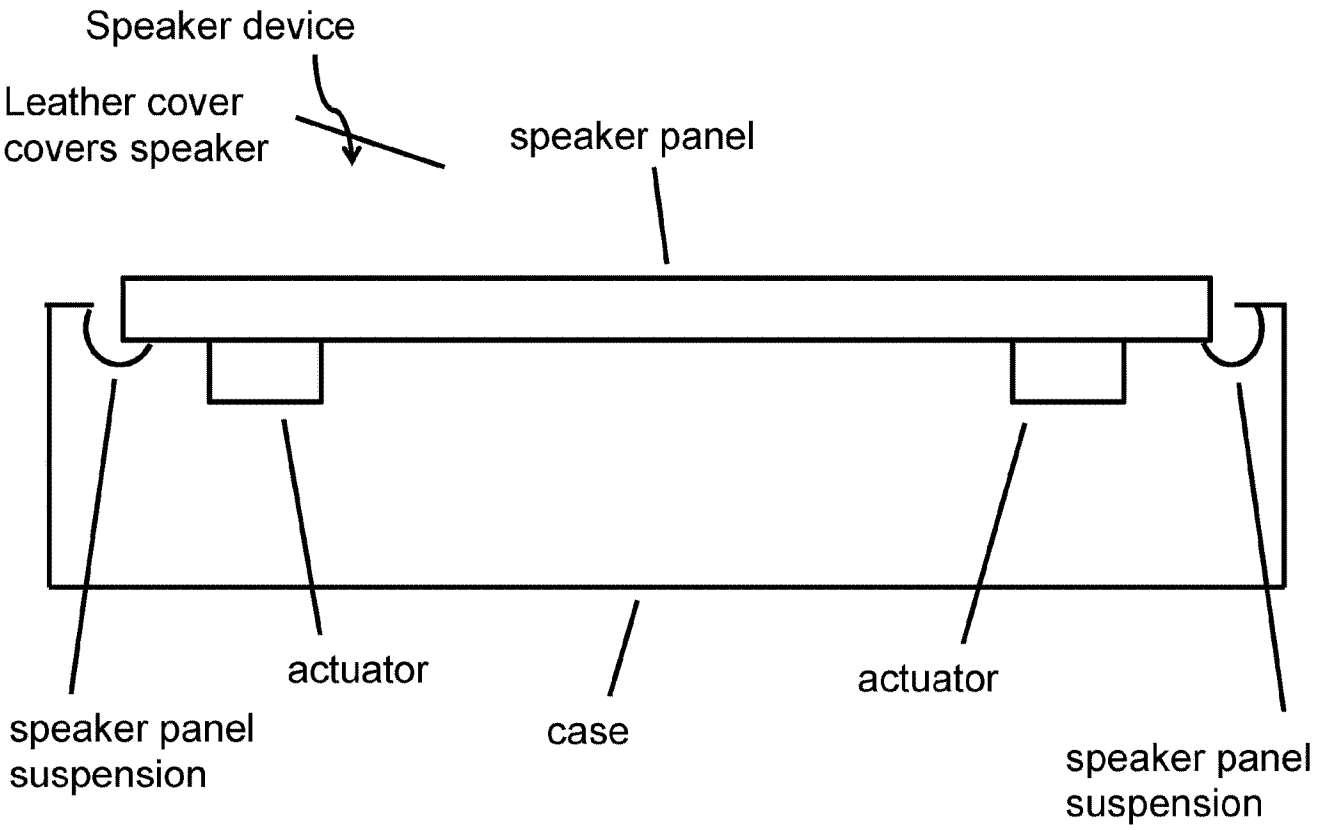
FIG. 50 shows an example of a speaker device in a vertical cross section, the speaker device including a case, a speaker panel and a speaker panel suspension system, wherein the speaker panel is surrounded by the case, wherein the speaker panel is arranged to vibrate, and wherein the speaker panel suspension system is configured to decouple speaker panel vibration from the case.

FIG. 50 shows an example of a speaker device in a vertical cross section, the speaker device including a case, a speaker panel and a speaker panel suspension system, wherein the speaker panel is surrounded by the case, wherein the speaker panel is arranged to vibrate, and wherein the speaker panel suspension system is configured to decouple speaker panel vibration from the case.

Note

It is to be understood that the above-referenced arrangements are only illustrative of the application for the principles of the present invention. Numerous modifications and alternative arrangements can be devised without departing from the spirit and scope of the present invention. While the present invention has been shown in the drawings and fully described above with particularity and detail in connection with what is presently deemed to be the most practical and preferred example(s) of the invention, it will be apparent to those of ordinary skill in the art that numerous modifications can be made without departing from the principles and concepts of the invention as set forth herein.

The invention claimed is:

1. A speaker device, the speaker device including a body and a speaker panel assembly, the speaker panel assembly movable between an open configuration and a closed configuration, wherein in the open configuration the speaker panel assembly is displaced relative to the body, and in the closed configuration the speaker panel assembly is retracted into the body, wherein the speaker panel assembly includes a frame and a speaker panel, wherein the speaker panel is housed by the frame, and wherein in the open configuration the frame provides an acoustic baffle to the speaker panel.

2. The speaker device of claim 1, wherein in the open configuration, the panel is suspended in free space.

3. The speaker device of claim 1, wherein the speaker panel assembly includes a speaker panel suspension system that provides frequency response optimization, and wherein the speaker panel suspension system is configured to enhance a frequency response of the panel.

4. The speaker device of claim 1, wherein when the speaker panel assembly is retracted into the body, the speaker panel assembly is articulated back into the body.

5. The speaker device of claim 1, wherein when the speaker device is in the closed configuration the speaker panel assembly is retracted into the body of the device such that the speaker panel of the speaker panel assembly cannot be seen on the outside surface of the device.

6. The speaker device of claim 1, wherein the speaker panel assembly is movable between an open configuration and a closed configuration using a push-push mechanism.

7. The speaker device of claim 1, wherein the speaker device is portable.

8. The speaker device of claim 1, wherein the speaker device is operable to receive power from a connected device.

9. The speaker device of claim 1, wherein the speaker device is configurable to communicate wirelessly.

10. The speaker device of claim 9, wherein the speaker device accommodates one connected device at a time, or wherein the speaker device can accommodate more than one connected device at a time, or wherein the speaker device can be connected to multiple other speaker devices.

11. The speaker device of claim 9, (i) wherein the speaker device, when put in an open configuration, automatically turns the speaker device on and activates wireless capabilities of the speaker device and checks the availability of other devices, or previously connected devices, or begins a search for new devices or becomes available to connect to new devices, or (ii) wherein the speaker device, when put in an open configuration, automatically begins playing music or audio.

12. The speaker device of claim 1, wherein the speaker device includes a battery, wherein the battery is removable or wherein the battery is non-removable.

13. The speaker device of claim 12, wherein the speaker device is operable to provide power to an external device via a power connection on the speaker device.

14. The speaker device of claim 1, wherein the speaker device is a portable device and includes a back cover, wherein the speaker device includes an actuator which is mounted to the back cover, wherein the back cover includes the speaker panel assembly that contains a speaker panel.

15. The speaker device of claim 14, wherein in the closed configuration, no speaker panel can be seen by a user of the speaker device, and in the open configuration in which the back cover of the speaker device opens, a speaker panel is revealed in the back cover of the device.

16. The speaker device of claim 1, wherein the speaker device includes a microphone, to enable voice control of the device or connected devices and or conference calling via the speaker device whilst connected to a smart device.

17. The speaker device of claim 16, wherein the speaker device is operable as a hands free speaker, or wherein the speaker device is arranged to receive voice prompts.

18. The speaker device of claim 1, the speaker device including a processor, wherein the speaker device is arranged to post process digital and or audio signals it receives from a connected device, using the processor.

19. The speaker device of claim 1, wherein the body includes a speaker case.

20. The speaker device of claim 19, wherein the speaker case and/or body is provided with tuned ports in the case with waveguides to optimise frequency response.

21. The speaker device of claim 20, wherein the tuned ports are under the speaker panel assembly when in the closed configuration.

22. The speaker device of claim 20, wherein the tuned ports provide an optimized frequency response passively or in combination with electronics or a program contained in the speaker device or in a connected device.

23. The speaker device of claim 1, wherein the speaker device does not include a battery.

24. The speaker device of claim 1, wherein the speaker device is a smart device.

25. The speaker device of claim 1, wherein the speaker device is a smart device case.

26. The speaker device of claim 25, wherein the smart device case includes a wallet, wherein the wallet includes an openable part and wherein the wallet includes a speaker panel which is mounted internally or externally in the wallet.

27. The speaker device of claim 1, wherein the speaker device is configured to receive and to store a mobile device.

28. The speaker device of claim 27, wherein the mobile device is a smartphone, a laptop, a tablet or a phablet, a mobile gaming device, a camera, a Personal Navigation Device, an E-Book reader, an MP3 player or a technology enabled wearable device.

29. The speaker device of claim 1, wherein the speaker device is generic and is not designed to fit a specific configuration of mobile device but can be used on a number of different mobile devices and is attached by clips or by another mechanism.

30. The speaker device of claim 1, wherein the frame includes one actuator or a plurality of actuators.

31. The speaker device of claim 30, wherein the frame provides mounting for the actuators.

32. The speaker device of claim 1, wherein the frame includes rubber or other materials around a frame edge and/or in other frame positions that can interact with the speaker panel to alter the frequency response of the panel and/or provide mechanical support and stabilization.

33. The speaker device of claim 1, wherein the frame provides acoustic and thermal porting, or wherein the frame and or body is provided with tuned ports with waveguides to optimize frequency response.

34. The speaker device of claim 1, wherein when the frame is in a closed position, the frame activates a different electronic manipulation of the audio signal or settings of the electronics producing sound so as to alter the performance of the speaker device between open and closed positions and other positions of the speaker panel.

35. The speaker device of claim 1, wherein the speaker panel assembly includes a plurality of speaker panels, or wherein the speaker panel assembly includes a single speaker panel.

36. The speaker device of claim 1, wherein the speaker device includes a release mechanism for the speaker panel assembly and the release mechanism activates the speaker device to activate a function eg. connect to a smart device or begin playing audio / or when closed, or stop playing audio and or activate a function or start or end a function on the smart devices or speaker devices.

37. The speaker device of claim 1, wherein the speaker device includes a finger print recognition sensor and the finger print sensor is connected to a microprocessor where the microprocessor stores or has access to finger print details of users, and wherein the sensor when activated then retrieves and matches the finger print details and then only scans or connects to devices which are associated to the users finger print details, or then only accesses services which are associated to the users finger print details.

38. The speaker device of claim 1, wherein the speaker device is a navigation device built into a vehicle, or wherein the speaker device is an in-vehicle audio device.

39. The speaker device of claim 1, wherein the speaker device is a technology enabled wearable device eg wrist-watch device eg. an Apple iWatch.

40. The speaker device of claim 1, wherein the speaker device is a MP3 player, a camera, a stand-alone speaker device eg. a smartphone sized stand-alone speaker device, or smaller, or a handheld gaming console, or a tablet computer, or a notebook computer, or a smartphone, or a laptop, or a phablet, or a mobile gaming device, or a Personal Navigation Device, or an E-Book reader, or a technology enabled wearable device.

41. A method of operating a speaker device, the speaker device including a body and a speaker panel assembly, the speaker panel assembly movable between an open configuration and a closed configuration, wherein in the open configuration the speaker panel assembly is displaced relative to the body, and in the closed configuration the speaker panel assembly is retracted into the body, wherein the speaker panel assembly includes a frame and a speaker panel, wherein the speaker panel is housed by the frame, and wherein in the open configuration the frame provides an acoustic baffle to the speaker panel, the method including the step of moving the speaker panel assembly from the closed configuration to the open configuration.

42. The speaker device of claim 29, wherein the mobile device is a smartphone, a laptop, a tablet or a phablet, a mobile gaming device, a camera, a Personal Navigation Device, an E-Book reader, an MP3 player or a technology enabled wearable device.

43. The speaker device of claim 1, wherein the device includes one actuator or a plurality of actuators, and wherein the speaker panel provides mounting for the actuators.

44. The speaker device of claim 1, wherein the frequency response is mechanically adjustable.

* * * * *